US012758848B2

(12) United States Patent
Boukadoum et al.

(10) Patent No.: US 12,758,848 B2
(45) Date of Patent: Oct. 13, 2026

(54) PROGRAMMABLE CONTEXT AWARE ALARM DEVICES AND METHODS

(71) Applicants: Mounir Boukadoum, Longueuil (CA); Frederic Nabki, Montreal (CA); Steve Vezeau, Longueuil (CA); Felix-Antoine Leclerc, Lac-Au-Saumon (CA); Jessica Champagne, Sainte-Julie (CA); Jasmin Bolduc, St-Jean-de-Richelieu (CA); Raphael Guimond, Verdun (CA)

(72) Inventors: Mounir Boukadoum, Longueuil (CA); Frederic Nabki, Montreal (CA); Steve Vezeau, Longueuil (CA); Felix-Antoine Leclerc, Lac-Au-Saumon (CA); Jessica Champagne, Sainte-Julie (CA); Jasmin Bolduc, St-Jean-de-Richelieu (CA); Raphael Guimond, Verdun (CA)

( * ) Notice: Subject to any disclaimer, the term of this patent is extended or adjusted under 35 U.S.C. 154(b) by 62 days.

(21) Appl. No.: 18/577,160

(22) PCT Filed: Jul. 8, 2022

(86) PCT No.: PCT/CA2022/000037
§ 371 (c)(1),
(2) Date: Jan. 5, 2024

(87) PCT Pub. No.: WO2023/279195
PCT Pub. Date: Jan. 12, 2023

(65) Prior Publication Data
US 2025/0090932 A1 Mar. 20, 2025

Related U.S. Application Data

(60) Provisional application No. 63/219,437, filed on Jul. 8, 2021.

(51) Int. Cl.
*A63B 71/06* (2006.01)
*A63B 67/14* (2006.01)
*A63B 69/00* (2006.01)

(52) U.S. Cl.
CPC ..... *A63B 71/0622* (2013.01); *A63B 67/14* (2013.01); *A63B 69/0026* (2013.01);
(Continued)

(58) Field of Classification Search
CPC . A63B 71/0622; A63B 67/14; A63B 69/0026; A63B 2071/0625;
(Continued)

(56) References Cited

U.S. PATENT DOCUMENTS 6,117,031 A 9/2000 Malinauskas et al.
6,148,271 A 11/2000 Marinelli
(Continued)

FOREIGN PATENT DOCUMENTS

EP 4035748 A1 * 8/2022 ..... A63B 24/0021
NO 20191153 A1 3/2021
(Continued)

*Primary Examiner* — Quan Zhen Wang
*Assistant Examiner* — Rajsheed O Black-Childress
(74) *Attorney, Agent, or Firm* — Rosenberg, Klein & Lee

(57) ABSTRACT

A wide variety of devices generate alarms when a particular condition is met. For example, a smoke detector generates an alarm upon detecting smoke whilst a motion detector generates an alarm upon detecting motion when the system to which the motion detector is connected is set or armed. However, in each instance the alarm is the same when the specific condition, e.g. smoke, motion; is met. Accordingly, it would be beneficial to provide users with an alarm which is generated in dependence upon an overall context within which the alarm is established and the resulting alarm generated varies in dependence upon the established context.

20 Claims, 35 Drawing Sheets

(52) U.S. Cl.
CPC ... *A63B 2071/0625* (2013.01); *A63B 2220/13* (2013.01); *A63B 2220/40* (2013.01); *A63B 2220/53* (2013.01); *A63B 2225/50* (2013.01)

(58) Field of Classification Search
CPC ..... A63B 2220/13; A63B 2220/40; A63B 2220/53; A63B 2225/50; A63B 24/0062; A63B 43/002; A63B 43/004; A63B 2024/0028; A63B 2024/0031; A63B 2024/0034; A63B 2024/0071; A63B 2071/0027; A63B 2071/0683; A63B 2220/10; A63B 2220/14; A63B 2220/16; A63B 2220/30; A63B 2220/34; A63B 2220/44; A63B 2220/801; A63B 2220/803; A63B 2220/833; A63B 2220/89; G01C 21/166; G08B 13/126
See application file for complete search history.

(56) References Cited

U.S. PATENT DOCUMENTS

2007/0238557 A1 10/2007 Saidi
2022/0088460 A1 3/2022 Roberts, II

FOREIGN PATENT DOCUMENTS

WO WO-2021058359 A1 * 4/2021 ..... A63B 71/0622
WO 2021091844 A1 5/2021

* cited by examiner

1100

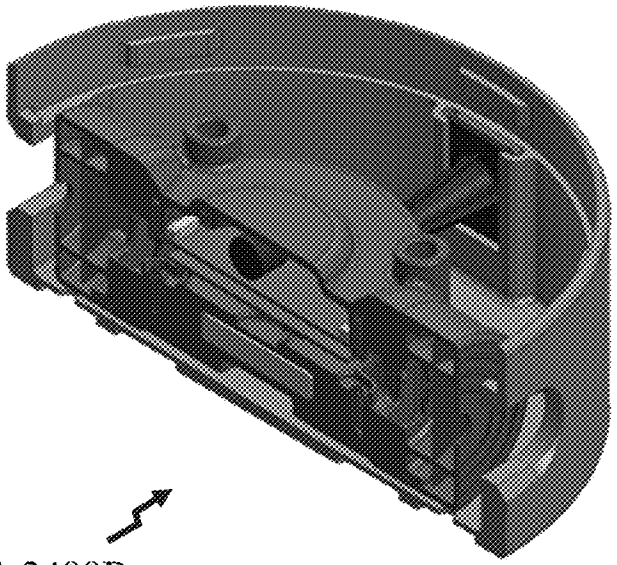
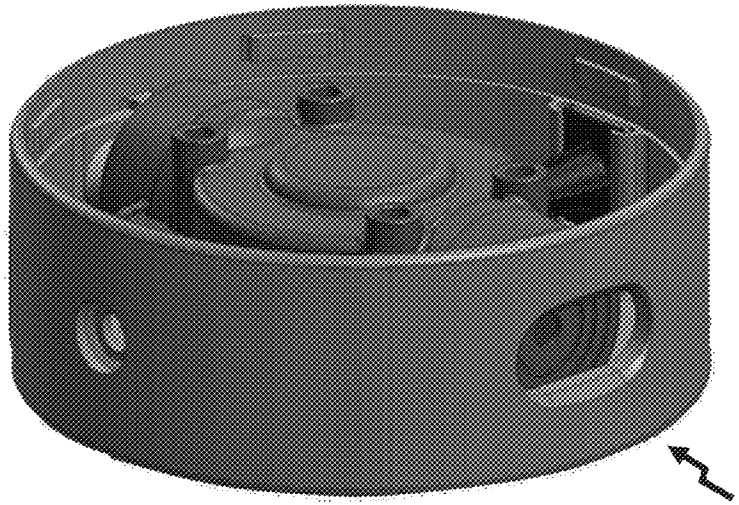
2400A 2400B
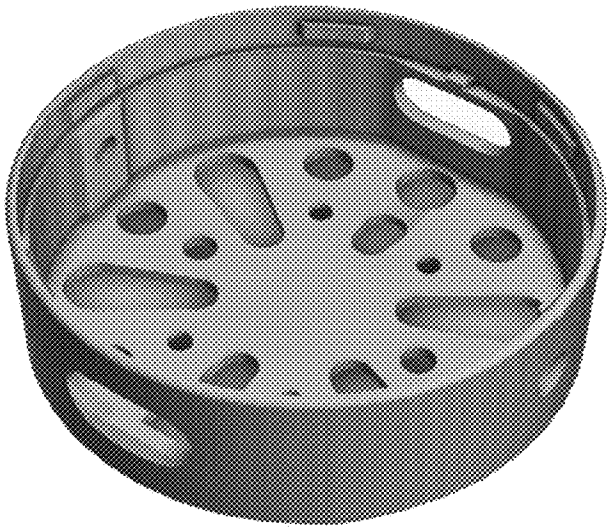
Figure 24
Figure 25

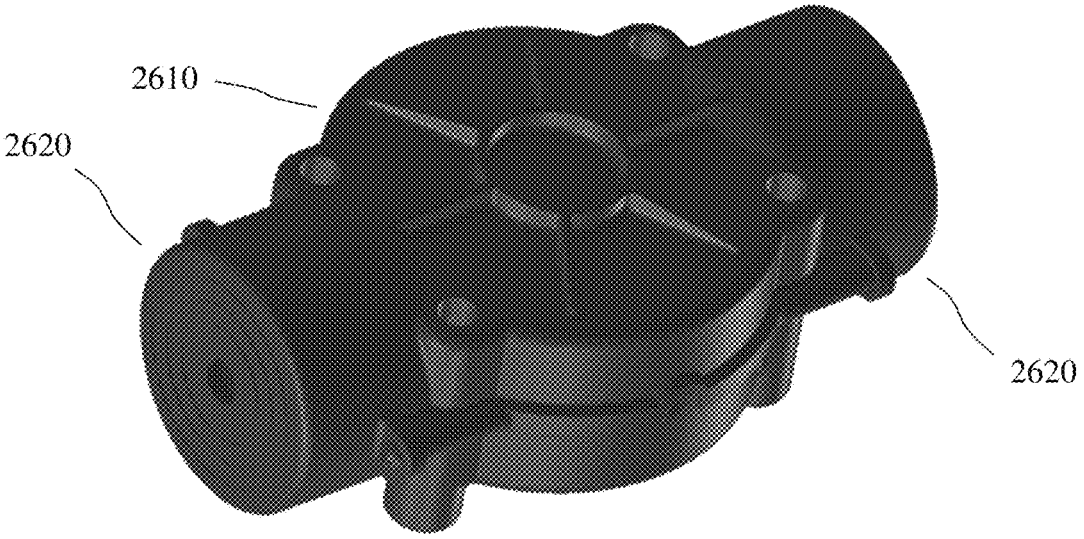
Figure 26
Figure 27
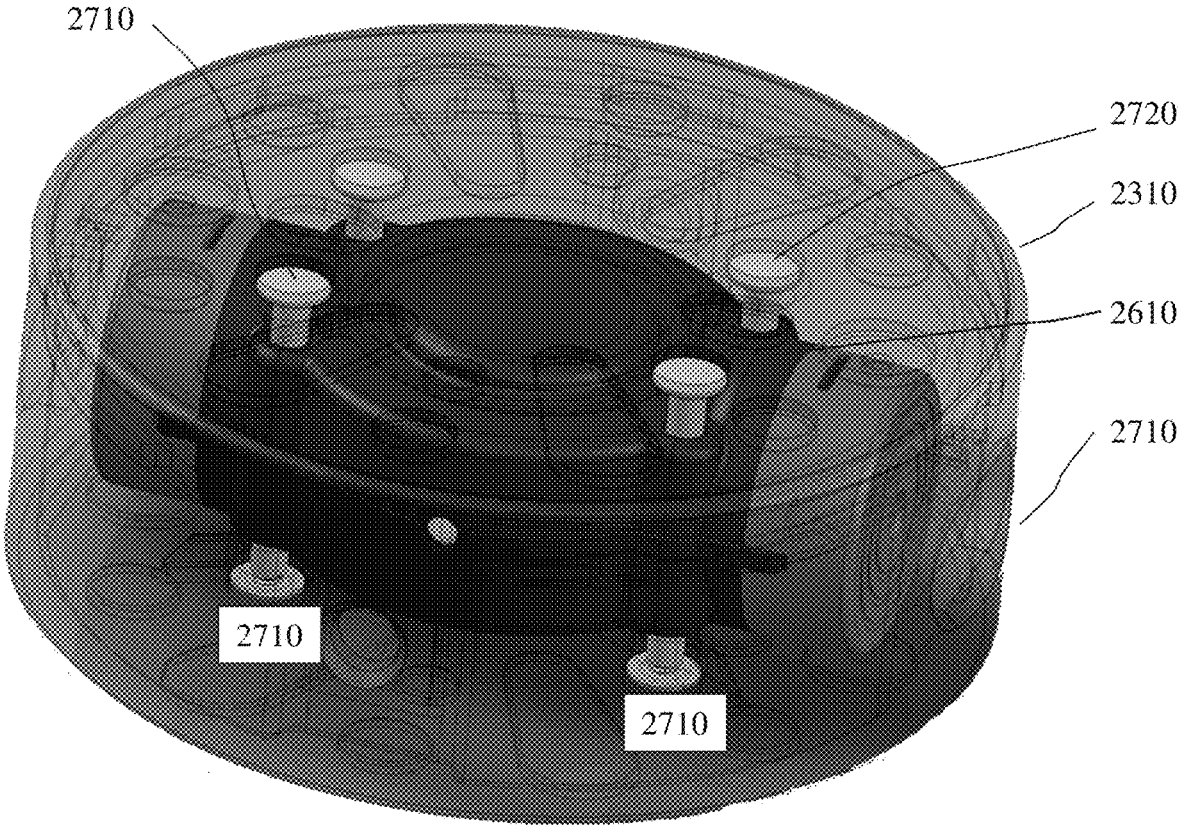

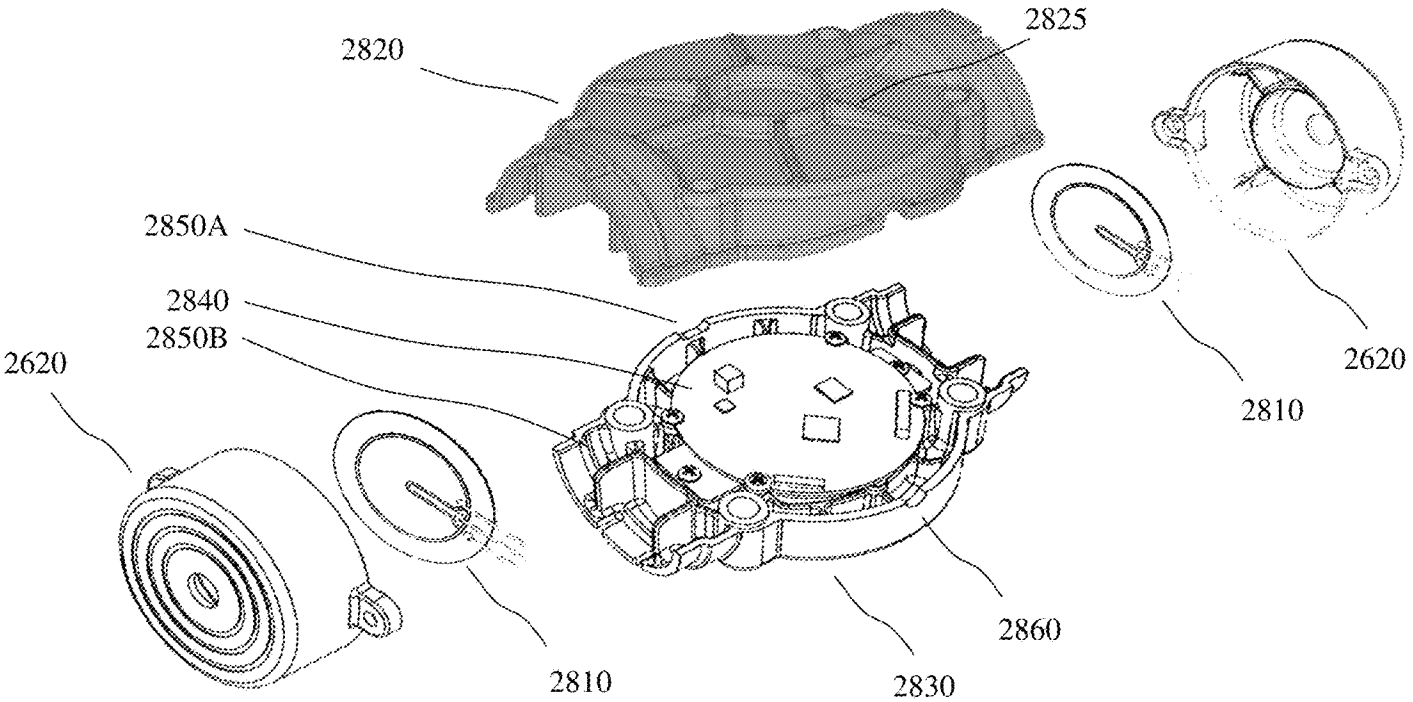
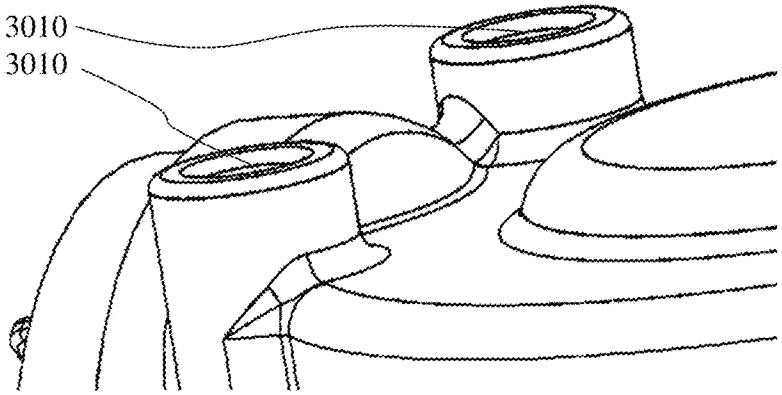
Figure 28
Figure 30

PROGRAMMABLE CONTEXT AWARE ALARM DEVICES AND METHODS

CROSS-REFERENCE TO RELATED APPLICATIONS

This patent application claims the benefit of priority as a 371 National Phase Entry application of PCT/CA2022/000037 filed Jul. 8, 2022; which itself claims the benefit of priority to U.S. Provisional Patent Application 63/219,437 filed Jul. 8, 2021; the entire contents of each being incorporated herein by reference.

FIELD OF THE INVENTION

This patent application relates to alarms such as visual and audible alarms for example and more particularly to alarms which are established and generated in dependence upon contextual information relating to a device associated with the alarm such that the alarms(s) provided may be varied in dependence upon the contextual information.

BACKGROUND OF THE INVENTION

A wide variety of devices generate alarms when a particular condition is met. For example, a smoke detector generates an alarm upon detecting smoke whilst a motion detector generates an alarm upon detecting motion when the system to which the motion detector is connected is set or armed. However, in each instance the alarm is the same when the specific condition, e.g. smoke, motion; is met.

Accordingly, it would be beneficial to provide users with an alarm which is generated in dependence upon an overall context within which the alarm is established. Accordingly, the actual alarm generated varies in dependence upon the context.

For example, considering a smoke detector then detection of smoke alone generates a first alarm whilst detection of smoke with identification of a heat source in the vicinity by another sensor (e.g. a fire) generates a second alarm.

Other aspects and features of the present invention will become apparent to those ordinarily skilled in the art upon review of the following description of specific embodiments of the invention in conjunction with the accompanying figures.

SUMMARY OF THE INVENTION

It is an object of the present invention to mitigate limitations within the prior art relating to alarms such as visual and audible alarms for example and more particularly to alarms which are established and generated in dependence upon contextual information relating to a device associated with the alarm such that the alarms(s) provided may be varied in dependence upon the contextual information.

In accordance with an embodiment of the invention there is provided a device comprising:

a microprocessor;

an alarm generator; and one or more sensors, each sensor generating data relating to a context of the device; wherein the microprocessor processes the data generated by the one or more sensors to determine a current overall context of the device; and the microprocessor generates a current alarm of a plurality of alarms with the alarm generator wherein the current alarm of the plurality of alarms relates to the current overall context of the device and each alarm of the plurality of alarms relates to an overall context of the device.

In accordance with an embodiment of the invention there is provided a method comprising providing a device comprising:

a microprocessor;

an alarm generator; and one or more sensors, each sensor generating data relating to a context of the device; wherein the microprocessor processes the data generated by the one or more sensors to determine a current overall context of the device; and the microprocessor generates a current alarm of a plurality of alarms with the alarm generator wherein the current alarm of the plurality of alarms relates to the current overall context of the device and each alarm of the plurality of alarms relates to an overall context of the device.

In accordance with an embodiment of the invention there is provided a device comprising:

a microprocessor; and an alarm generator; wherein the microprocessor receives data from one or more sensors, each sensor generating data relating to a context of the device;

the microprocessor processes the data generated by the one or more sensors to determine a current overall context of the device; and the microprocessor generates a current alarm of a plurality of alarms with the alarm generator wherein the current alarm of the plurality of alarms relates to the current overall context of the device and each alarm of the plurality of alarms relates to an overall context of the device.

In accordance with an embodiment of the invention there is provided a method comprising:

providing a device comprising a microprocessor and an alarm generator; wherein the microprocessor receives data from one or more sensors, each sensor generating data relating to a context of the device;

the microprocessor processes the data generated by the one or more sensors to determine a current overall context of the device; and the microprocessor generates a current alarm of a plurality of alarms with the alarm generator wherein the current alarm of the plurality of alarms relates to the current overall context of the device and each alarm of the plurality of alarms relates to an overall context of the device.

In accordance with an embodiment of the invention there is provided a method comprising:

providing to a user an alarm generated by an alarm generator forming part of a device; wherein the alarm generated is established in dependence upon an overall context of the device established by a microprocessor; and the overall context of the device is established in dependence upon data acquired by the microprocessor from one or more sensors associated directly or indirectly with the device.

In accordance with an embodiment of the invention there is provided a device comprising:

an outer case having an external geometry comprising a cylindrical segment where two planes defining upper and lower surfaces of the truncated cylinder are parallel to one another and perpendicular to a longitudinal axis of the cylindrical segment;

an electronics module disposed within the outer case comprising a casing within which are disposed a battery and a microprocessor based control circuit; and one or more acoustic signal generators coupled to the control circuit; wherein the outer case provides mechanical protection for the electronics module under impact; and the one or more acoustic signal generators generate one or more audible signals whilst the device is at least in motion.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIG. 24 depicts perspective and cross-sectional views of the exemplary CAAD as depicted in FIG. 23;

FIG. 25 depicts a perspective view of the case body of the CAAD as depicted in FIG. 24;

FIG. 26 depicts a perspective view of an electronics module for the CAAD of FIG. 23 with a pair of acoustic resonators attached at each end;

FIG. 27 depicts the electronics module of FIG. 26 within the CAAD as depicted in FIG. 23;

FIG. 28 depicts a partially exploded assembly view of the electronics module of FIG. 26 together with the acoustic resonators and piezoelectric acoustic transducers;

FIG. 30 depicts studs forming part of the electronics module of FIG. 26 for positioning the electronics module within the case of the CAAD according to FIG. 23;

DETAILED DESCRIPTION

Figure 1:
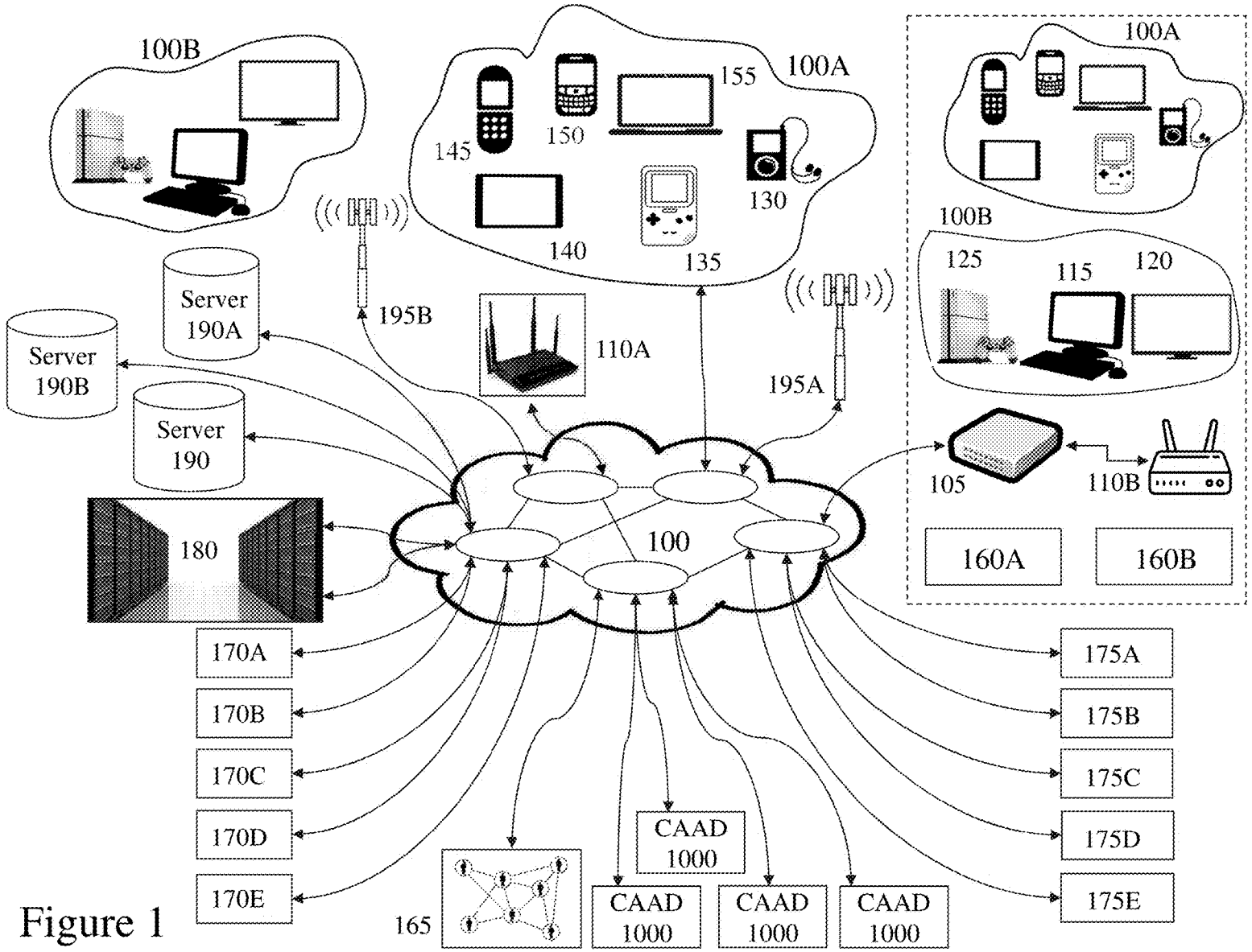
FIG. 1 depicts an exemplary network environment within which configurable electrical devices according to and supporting embodiments of the invention may be deployed and operate.

The present invention is directed to alarms such as visual and audible alarms for example and more particularly to alarms which are established and generated in dependence upon contextual information relating to a device associated with the alarm such that the alarms(s) provided may be varied in dependence upon the contextual information.

The ensuing description provides representative embodiment(s) only, and is not intended to limit the scope, applicability or configuration of the disclosure. Rather, the ensuing description of the embodiment(s) will provide those skilled in the art with an enabling description for implementing an embodiment or embodiments of the invention. It being understood that various changes can be made in the function and arrangement of elements without departing from the spirit and scope as set forth in the appended claims. Accordingly, an embodiment is an example or implementation of the inventions and not the sole implementation. Various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention can also be implemented in a single embodiment or any combination of embodiments.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions. The phraseology and terminology employed herein is not to be construed as limiting but is for descriptive purpose only. It is to be understood that where the claims or specification refer to "a" or "an" element, such reference is not to be construed as there being only one of that element. It is to be understood that where the specification states that a component feature, structure, or characteristic "may", "might", "can" or "could" be included, that particular component, feature, structure, or characteristic is not required to be included.

Reference to terms such as "left", "right", "top", "bottom", "front" and "back" are intended for use in respect to the orientation of the particular feature, structure, or element within the figures depicting embodiments of the invention. It would be evident that such directional terminology with respect to the actual use of a device has no specific meaning as the device can be employed in a multiplicity of orientations by the user or users.

Reference to terms "including", "comprising", "consisting" and grammatical variants thereof do not preclude the addition of one or more components, features, steps, integers or groups thereof and that the terms are not to be construed as specifying components, features, steps or integers. Likewise, the phrase "consisting essentially of", and grammatical variants thereof, when used herein is not to be construed as excluding additional components, steps, features integers or groups thereof but rather that the additional features, integers, steps, components or groups thereof do not materially alter the basic and novel characteristics of the claimed composition, device or method. If the specification or claims refer to "an additional" element, that does not preclude there being more than one of the additional element.

An "electrical connector" is an electro-mechanical device used to join electrical terminations and create an electrical circuit. Electrical connectors typically consist of plugs (male-ended) and jacks (female-ended). The connection may be made/unmade manually or may require a tool for assembly and removal.

An "electrical contact" as used herein and throughout this disclosure, refer to, but is not limited to, an electrical connection between a first element (e.g. a pin of a plug) with a second element (e.g. a receptacle within a socket). Such electrical contacts may be around the periphery of the pin, on a particular surface of the pin, or particular surface of the pin. Some electrical contacts may be sprung to maintain connection over a range of relative positions of the two elements.

A "demountable insert" or "insert" as used herein and throughout this disclosure, refer to, but is not limited to, an assembly designed to be inserted within an opening/recess within an electrical and/or switch receptacle. Accordingly, a demountable insert may be inserted/removed through the faceplate without requiring the removal of the face plate.

A "retention means" as used herein and throughout this disclosure, refer to, but is not limited to, a means of attaching one element to another element. As such a retention means may include, but not be limited, a screw, a bolt, a nut and bolt, a latch, and a clip.

A "wireless standard" as used herein and throughout this disclosure, refer to, but is not limited to, a standard for transmitting signals and/or data through electromagnetic radiation which may be optical, radio-frequency (RF) or microwave although typically RF wireless systems and techniques dominate. A wireless standard may be defined globally, nationally, or specific to an equipment manufacturer or set of equipment manufacturers. Dominant wireless standards at present include, but are not limited to IEEE 802.11, IEEE 802.15, IEEE 802.16, IEEE 802.20, UMTS, GSM 850, GSM 900, GSM 1800, GSM 1900, GPRS, ITU-R 5.138, ITU-R 5.150, ITU-R 5.280, IMT-1000, Bluetooth, Wi-Fi, Ultra-Wideband and WiMAX. Some standards may be a conglomeration of sub-standards such as IEEE 802.11 which may refer to, but is not limited to, IEEE 802.1a, IEEE 802.11b, IEEE 802.11g, or IEEE 802.11n as well as others under the IEEE 802.11 umbrella.

A "wired standard" as used herein and throughout this disclosure, generally refer to, but is not limited to, a standard for transmitting signals and/or data through an electrical cable discretely or in combination with another signal. Such wired standards may include, but are not limited to, digital subscriber loop (DSL), Dial-Up (exploiting the public switched telephone network (PSTN) to establish a connection to an Internet service provider (ISP)), Data Over Cable Service Interface Specification (DOCSIS), Ethernet, Gigabit home networking (G.hn), Integrated Services Digital Network (ISDN), Multimedia over Coax Alliance (MoCA), and Power Line Communication (PLC, wherein data is overlaid to AC/DC power supply). In some embodiments a "wired standard" may refer to, but is not limited to, exploiting an optical cable and optical interfaces such as within Passive Optical Networks (PONs) for example.

A "user" as used herein may refer to, but is not limited to, an individual or group of individuals. This includes, private individuals, employees of organizations and/or enterprises, members of community organizations, members of charity organizations, men, women and children. In its broadest sense the user may further include, but not be limited to, mechanical systems, robotic systems, android systems, etc. that may be characterised by an ability to exploit one or more embodiments of the invention.

A "sensor" as used herein may refer to, but is not limited to, a transducer providing an electrical output generated in dependence upon a magnitude of a measure and selected from the group comprising, but is not limited to, environmental sensors, medical sensors, biological sensors, chemical sensors, ambient environment sensors, pressure sensors, single axis accelerometers, dual axis accelerometers, three axis accelerometers, position sensors, motion sensors, thermal sensors, infrared sensors, visible sensors, RFID sensors, and medical testing and diagnosis devices.

A "portable electronic device" (PED) as used herein and throughout this disclosure, refers to a wireless device used for communications and other applications that requires a battery or other independent form of energy for power. This includes devices, but is not limited to, such as a cellular telephone, smartphone, personal digital assistant (PDA), portable computer, pager, portable multimedia player, portable gaming console, laptop computer, tablet computer, a wearable device and an electronic reader.

A "fixed electronic device" (FED) as used herein and throughout this disclosure, refers to a wireless and/or wired device used for communications and other applications that requires connection to a fixed interface to obtain power. This includes, but is not limited to, a laptop computer, a personal computer, a computer server, a kiosk, a gaming console, a digital set-top box, an analog set-top box, an Internet enabled appliance, an Internet enabled television, and a multimedia player.

A "server" as used herein, and throughout this disclosure, refers to one or more physical computers co-located and/or geographically distributed running one or more services as a host to users of other computers, PEDs, FEDs, etc. to serve the client needs of these other users. This includes, but is not limited to, a database server, file server, mail server, print server, web server, gaming server, or virtual environment server.

An "application" (commonly referred to as an "app") as used herein may refer to, but is not limited to, a "software application", an element of a "software suite", a computer program designed to allow an individual to perform an activity, a computer program designed to allow an electronic device to perform an activity, and a computer program designed to communicate with local and/or remote electronic devices. An application thus differs from an operating system (which runs a computer), a utility (which performs maintenance or general-purpose chores), and a programming tools (with which computer programs are created). Generally, within the following description with respect to embodiments of the invention an application is generally presented in respect of software permanently and/or temporarily installed upon a PED and/or FED.

An "enterprise" as used herein may refer to, but is not limited to, a provider of a service and/or a product to a user, customer, or consumer. This includes, but is not limited to, a retail outlet, a store, a market, an online marketplace, a manufacturer, an online retailer, a charity, a utility, and a service provider. Such enterprises may be directly owned and controlled by a company or may be owned and operated by a franchisee under the direction and management of a franchiser.

A "service provider" as used herein may refer to, but is not limited to, a third party provider of a service and/or a product to an enterprise and/or individual and/or group of individuals and/or a device comprising a microprocessor. This includes, but is not limited to, a retail outlet, a store, a market, an online marketplace, a manufacturer, an online retailer, a utility, an own brand provider, and a service provider wherein the service and/or product is at least one of marketed, sold, offered, and distributed by the enterprise solely or in addition to the service provider.

A "third party" or "third party provider" as used herein may refer to, but is not limited to, a so-called "arm's length" provider of a service and/or a product to an enterprise and/or individual and/or group of individuals and/or a device comprising a microprocessor wherein the consumer and/or customer engages the third party but the actual service and/or product that they are interested in and/or purchase and/or receive is provided through an enterprise and/or service provider.

A "user" as used herein may refer to, but is not limited to, an individual or group of individuals. This includes, but is not limited to, private individuals, employees of organizations and/or enterprises, members of community organizations, members of charity organizations, men and women. In its broadest sense the user may further include, but not be limited to, software systems, mechanical systems, robotic systems, android systems, etc. that may be characterised by an ability to exploit one or more embodiments of the invention. A user may also be associated through one or more accounts and/or profiles with one or more of a service provider, third party provider, enterprise, social network, social media etc. via a dashboard, web service, website, software plug-in, software application, and graphical user interface.

"Biometric" information as used herein may refer to, but is not limited to, data relating to a user characterised by data relating to a subset of conditions including, but not limited to, their environment, medical condition, biological condition, physiological condition, chemical condition, ambient environment condition, position condition, neurological condition, drug condition, and one or more specific aspects of one or more of these said conditions. Accordingly, such biometric information may include, but not be limited, blood oxygenation, blood pressure, blood flow rate, heart rate, temperate, fluidic pH, viscosity, particulate content, solids content, altitude, vibration, motion, perspiration, EEG, ECG, energy level, etc. In addition, biometric information may include data relating to physiological characteristics related to the shape and/or condition of the body wherein examples may include, but are not limited to, fingerprint, facial geometry, baldness, DNA, hand geometry, odour, and scent. Biometric information may also include data relating to behavioral characteristics, including but not limited to, typing rhythm, gait, and voice.

"User information" as used herein may refer to, but is not limited to, user behavior information and/or user profile information. It may also include a user's biometric information, an estimation of the user's biometric information, or a projection/prediction of a user's biometric information derived from current and/or historical biometric information.

A "wearable device" or "wearable sensor" relates to miniature electronic devices that are worn by the user including those under, within, with or on top of clothing and are part of a broader general class of wearable technology which includes "wearable computers" which in contrast are directed to general or special purpose information technologies and media development. Such wearable devices and/or wearable sensors may include, but not be limited to, smartphones, smart watches, e-textiles, smart shirts, activity trackers, smart glasses, environmental sensors, medical sensors, biological sensors, physiological sensors, chemical sensors, ambient environment sensors, position sensors, neurological sensors, drug delivery systems, medical testing and diagnosis devices, and motion sensors.

"Electronic content" (also referred to as "content" or "digital content") as used herein may refer to, but is not limited to, any type of content that exists in the form of digital data as stored, transmitted, received and/or converted wherein one or more of these steps may be analog although generally these steps will be digital. Forms of digital content include, but are not limited to, information that is digitally broadcast, streamed or contained in discrete files. Viewed narrowly, types of digital content include popular media types such as MP3, JPG, AVI, TIFF, AAC, TXT, RTF, HTML, XHTML, PDF, XLS, SVG, WMA, MP4, FLV, and PPT, for example, as well as others, see for example http://en.wikipedia.org/wiki/List_of_file_formats. Within a broader approach digital content mat include any type of digital information, e.g. digitally updated weather forecast, a GPS map, an eBook, a photograph, a video, a Vine™, a blog posting, a Facebook™ posting, a Twitter™ tweet, online TV, etc. The digital content may be any digital data that is at least one of generated, selected, created, modified, and transmitted in response to a user request, said request may be a query, a search, a trigger, an alarm, and a message for example.

A "profile" as used herein, and throughout this disclosure, refers to a computer and/or microprocessor readable data file comprising data relating to settings and/or limits of an adult device. Such profiles may be established by a manufacturer/supplier/provider of a device, service, etc. or they may be established by a user through a user interface for a device, a service or a PED/FED in communication with a device, another device, a server or a service provider etc.

A "computer file" (commonly known as a file) as used herein, and throughout this disclosure, refers to a computer resource for recording data discretely in a computer storage device, this data being electronic content. A file may be defined by one of different types of computer files, designed for different purposes. A file may be designed to store electronic content such as a written message, a video, a computer program, or a wide variety of other kinds of data. Some types of files can store several types of information at once. A file can be opened, read, modified, copied, and closed with one or more software applications an arbitrary number of times. Typically, files are organized in a file system which can be used on numerous different types of storage device exploiting different kinds of media which keeps track of where the files are located on the storage device(s) and enables user access. The format of a file is defined by its content since a file is solely a container for data, although, on some platforms the format is usually indicated by its filename extension, specifying the rules for how the bytes must be organized and interpreted meaningfully. For example, the bytes of a plain text file are associated with either ASCII or UTF-8 characters, while the bytes of image, video, and audio files are interpreted otherwise. Some file types also allocate a few bytes for metadata, which allows a file to carry some basic information about itself.

"Metadata" as used herein, and throughout this disclosure, refers to information stored as data that provides information about other data. Many distinct types of metadata exist, including but not limited to, descriptive metadata, structural metadata, administrative metadata, reference metadata and statistical metadata. Descriptive metadata may describe a resource for purposes such as discovery and identification and may include, but not be limited to, elements such as title, abstract, author, and keywords. Structural metadata relates to containers of data and indicates how compound objects are assembled and may include, but not be limited to, how pages are ordered to form chapters, and typically describes the types, versions, relationships and other characteristics of digital materials. Administrative metadata may provide information employed in managing a resource and may include, but not be limited to, when and how it was created, file type, technical information, and who can access it. Reference metadata may describe the contents and quality of statistical data whereas statistical metadata may also describe processes that collect, process, or produce statistical data. Statistical metadata may also be referred to as process data.

An "artificial intelligence system" (referred to hereafter as artificial intelligence, AI) as used herein, and throughout disclosure, refers to machine intelligence or machine learning in contrast to natural intelligence. An AI may refer to analytical, human inspired, or humanized artificial intelligence. An AI may refer to the use of one or more machine learning algorithms and/or processes. An AI may employ one or more of an artificial network, decision trees, support vector machines, Bayesian networks, and genetic algorithms. An AI may employ a training model or federated learning.

"Machine Learning" (ML) or more specifically machine learning processes as used herein refers to, but is not limited, to programs, algorithms or software tools, which allow a given device or program to learn to adapt its functionality based on information processed by it or by other independent processes. These learning processes are in practice, gathered from the result of said process which produce data and or algorithms that lend themselves to prediction. This prediction process allows ML-capable devices to behave according to guidelines initially established within its own programming but evolved as a result of the ML. A machine learning algorithm or machining learning process as employed by an AI may include, but not be limited to, supervised learning, unsupervised learning, cluster analysis, reinforcement learning, feature learning, sparse dictionary learning, anomaly detection, association rule learning, inductive logic programming.

A "Chicago" screw (also known as a sex bolt, barrel nut, barrel bolt, post and screw or connector bolt) as used herein, and throughout the disclosure, refers to a type of fastener (nut) that has a barrel-shaped flange and protruding boss that is internally threaded. The boss sits within the component(s) being fastened with its flange providing the bearing surface. The Chicago screw and accompanying machine screw sit flush on either side of the surfaces being fastened.

An "alarm generator" as used herein, and throughout the disclosure, refers to a component or device which generates an alarm, such as for example an audible alarm, visible alarm, tactile alarm. An alarm generator may include, but not be limited to, a buzzer, a loudspeaker, a light emitting diode (LED), an optical emitter, an acoustic signal generator, and a piezoelectric vibrator.

Overview Description of Network Environment and Architecture of Contextually Aware Alarm Devices (CAADs)

Referring to FIG. 1 there is depicted a Network 100 within which embodiments of the invention may be employed supporting Contextually Aware Alarm (CAA) Systems, Devices, Applications and Platforms (CAA-SDAPs) according to embodiments of the invention. Such CAA-SDAPs, for example, supporting multiple communication channels, dynamic filtering, etc. As shown first and second user groups 100A and 100B respectively interface to a telecommunications Network 100. Within the representative telecommunication architecture, a remote central exchange 180 communicates with the remainder of a telecommunication service providers network via the Network 100 which may include for example long-haul OC-48/OC-192 backbone elements, an OC-48 wide area network (WAN), a Passive Optical Network, and a Wireless Link. The central exchange 180 is connected via the Network 100 to local, regional, and international exchanges (not shown for clarity) and therein through Network 100 to first and second cellular APs 195A and 195B respectively which provide Wi-Fi cells for first and second user groups 100A and 100B respectively. Also connected to the Network 100 are first and second Wi-Fi nodes 110A and 110B, the latter of which being coupled to Network 100 via router 105. Second Wi-Fi node 110B is associated with commercial service provider 160, e.g. Gillette Stadium™, comprising other first and second user groups 100A and 100B. Second user group 100B may also be connected to the Network 100 via wired interfaces including, but not limited to, DSL, Dial-Up, DOCSIS, Ethernet, G.hn, ISDN, MoCA, PON, and Power line communication (PLC) which may or may not be routed through a router such as router 105.

Within the cell associated with first AP 110A the first group of users 100A may employ a variety of PEDs including for example, laptop computer 155, portable gaming console 135, tablet computer 140, smartphone 150, cellular telephone 145 as well as portable multimedia player 130. Within the cell associated with second AP 110B are the second group of users 100B which may employ a variety of FEDs including for example gaming console 125, personal computer 115 and wireless/Internet enabled television 120 as well as cable modem 105. First and second cellular APs 195A and 195B respectively provide, for example, cellular GSM (Global System for Mobile Communications) telephony services as well as 3G and 4G evolved services with enhanced data transport support. Second cellular AP 195B provides coverage in the exemplary embodiment to first and second user groups 100A and 100B. Alternatively the first and second user groups 100A and 100B may be geographically disparate and access the Network 100 through multiple APs, not shown for clarity, distributed geographically by the network operator or operators. First cellular AP 195A as show provides coverage to first user group 100A and environment 170, which comprises second user group 100B as well as first user group 100A. Accordingly, the first and second user groups 100A and 100B may according to their particular communications interfaces communicate to the Network 100 through one or more wireless communications standards such as, for example, IEEE 802.11, IEEE 802.15, IEEE 802.16, IEEE 802.20, UMTS, GSM 850, GSM 900, GSM 1800, GSM 1900, GPRS, ITU-R 5.138, ITU-R 5.150, ITU-R 5.280, and IMT-1000. It would be evident to one skilled in the art that many portable and fixed electronic devices may support multiple wireless protocols simultaneously, such that for example a user may employ GSM services such as telephony and SMS and Wi-Fi/WiMAX data transmission, VOIP and Internet access. Accordingly, portable electronic devices within first user group 100A may form associations either through standards such as IEEE 802.15 or Bluetooth as well in an ad-hoc manner.

Also connected to the Network 100 are Social Networks (SOCNETS) 165, first and second service providers 170A and 170B respectively, first and second third party service providers 170C and 170D respectively, and a user 170E. Also connected to the Network 100 are first and second enterprises 175A and 175B respectively, first and second organizations 175C and 175D respectively, and a government entity 175E. Also depicted are first and second servers 190A and 190B may host according to embodiments of the inventions multiple services associated with a provider of Contextually Aware Alarm (CAA) Systems, Devices, Applications and Platforms (CAA-SDAPs); a provider of a SOCNET or Social Media (SOME) exploiting CAA-SDAP features; a provider of a SOCNET and/or SOME not exploiting CAA-SDAP features; a provider of services to PEDS and/or FEDS; a provider of one or more aspects of wired and/or wireless communications; an Enterprise 160 such as Canadian Blind Hockey Association (CBHA) exploiting CAA-SDAP features; license databases; content databases; image databases; content libraries; customer databases; websites; and software applications for download to or access by FEDs and/or PEDs exploiting and/or hosting CAA-SDAP features. First and second primary content servers 190A and 190B may also host for example other Internet services such as a search engine, financial services, third party applications and other Internet based services.

Also depicted in FIG. 1 are Contextually Aware Alarm Devices (CAADs) 100 according to embodiments of the invention such as described and depicted below in respect of FIGS. 3A to 14 supporting Contextually Aware Alarm (CAA) Systems, Devices, Applications and Platforms (CAA-SDAPs) according to embodiments of the invention. As depicted in FIG. 1 the CAADs 100 communicate directly to the Network 100. The CAADs 100 may communicate to the Network 100 through one or more wireless or wired interfaces included those, for example, selected from the group comprising IEEE 802.11, IEEE 802.15, IEEE 802.16, IEEE 802.20, UMTS, GSM 850, GSM 900, GSM 1800, GSM 1900, GPRS, ITU-R 5.138, ITU-R 5.150, ITU-R 5.280, IMT-1000, DSL, Dial-Up, DOCSIS, Ethernet, G.hn, ISDN, MoCA, PON, and Power line communication (PLC).

Accordingly, a consumer, an enterprise, a customer, an organization or a user (CECOU) may exploit a PED and/or FED within an Enterprise 160, for example, and access one of the first or second primary content servers 190A and 190B respectively to perform an operation such as accessing/downloading an application which provides CAA-SDAP features according to embodiments of the invention; execute an application already installed providing CAA-SDAP features; execute a web based application providing CAA-SDAP features; or access content. Similarly, a CECOU may undertake such actions or others exploiting embodiments of the invention exploiting a PED or FED within first and second user groups 100A and 100B respectively via one of first and second cellular APs 195A and 195B respectively and first Wi-Fi nodes 110A. It would also be evident that a CECOU may, via exploiting Network 100 communicate via telephone, fax, email, SMS, social media, etc.

Figure 2:
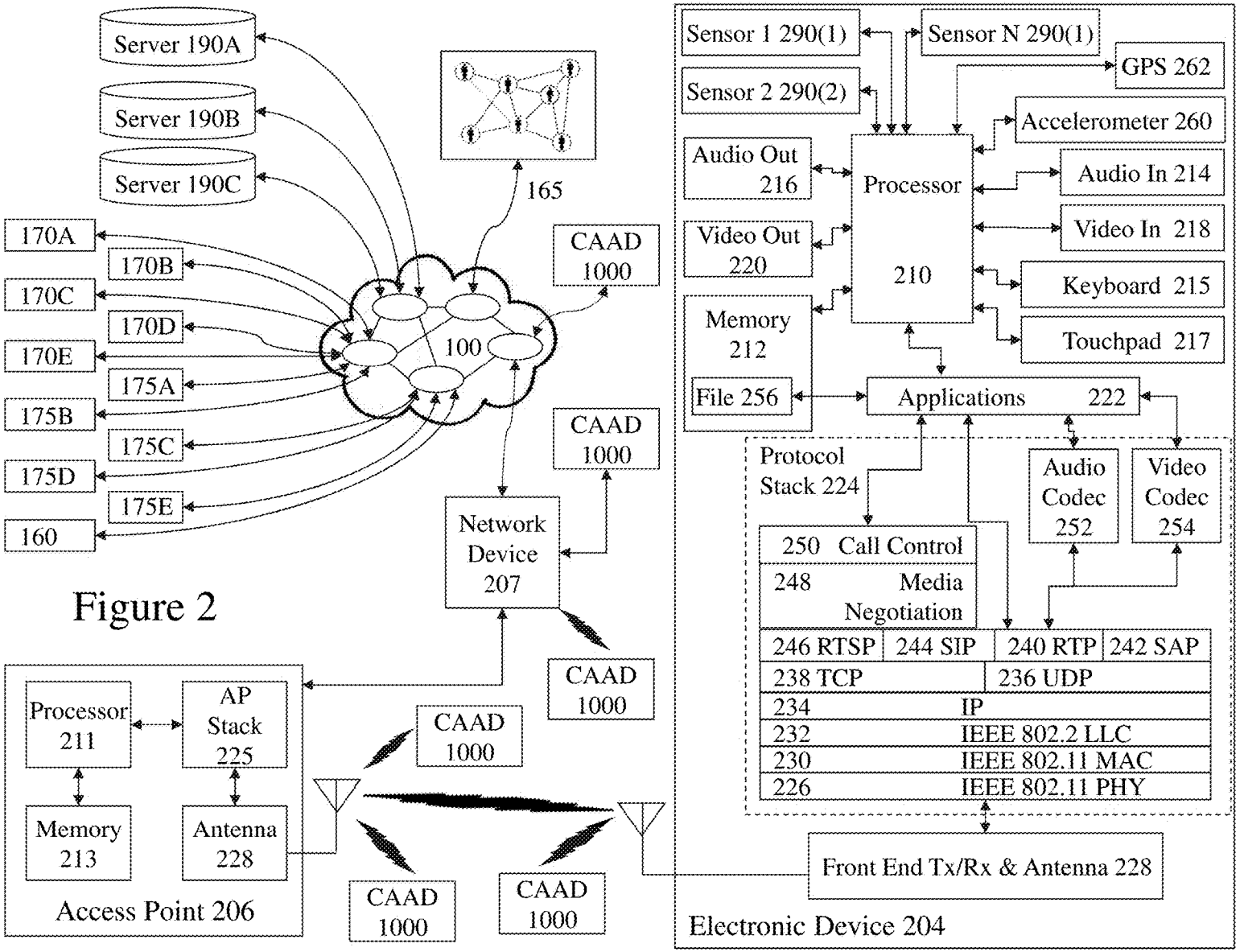
FIG. 2 depicts an exemplary wireless portable electronic device supporting communications to a network such as depicted in FIG. 1 and configurable electrical devices according to and supporting embodiments of the invention.

Now referring to FIG. 2 there is depicted an Electronic Device 204, e.g. a Contextually Aware Alarm Device (CAAD) 100 as depicted in FIG. 1, and network access point 207 supporting CAA-SDAP features according to embodiments of the invention. Electronic Device 204 may, for example, be a PED and/or FED and may include additional elements above and beyond those described and depicted. Also depicted within the Electronic Device 204 is the protocol architecture as part of a simplified functional diagram of a system 200 that includes an Electronic Device 204, such as a smartphone 155, an access point (AP) 206, such as first AP 110, and one or more network devices 207, such as communication servers, streaming media servers, and routers for example such as first and second servers 190A and 190B respectively. Network devices 207 may be coupled to AP 206 via any combination of networks, wired, wireless and/or optical communication links such as discussed above in respect of FIG. 1 as well as directly as indicated. Network devices 207 are coupled to Network 100 and therein Social Networks (SOCNETS) 165, first and second service providers 170A and 170B respectively, first and second third party service providers 170C and 170D respectively, a user 170E, first and second enterprises 175A and 175B respectively, first and second organizations 175C and 175D respectively, and a government entity 175E.

The Electronic Device 204 includes one or more processors 210 and a memory 212 coupled to processor(s) 210. AP 206 also includes one or more processors 211 and a memory 213 coupled to processor(s) 210. A non-exhaustive list of examples for any of processors 210 and 211 includes a central processing unit (CPU), a digital signal processor (DSP), a reduced instruction set computer (RISC), a complex instruction set computer (CISC) and the like. Furthermore, any of processors 210 and 211 may be part of application specific integrated circuits (ASICs) or may be a part of application specific standard products (ASSPs). A non-exhaustive list of examples for memories 212 and 213 includes any combination of the following semiconductor devices such as registers, latches, ROM, EEPROM, flash memory devices, non-volatile random access memory devices (NVRAM), SDRAM, DRAM, double data rate (DDR) memory devices, SRAM, universal serial bus (USB) removable memory, and the like.

Electronic Device 204 may include an audio input element 214, for example a microphone, and an audio output element 216, for example, a speaker, coupled to any of processors 210. Electronic Device 204 may include a video input element 218, for example, a video camera or camera, and a video output element 220, for example an LCD display, coupled to any of processors 210. Electronic Device 204 also includes a keyboard 215 and touchpad 217 which may for example be a physical keyboard and touchpad allowing the user to enter content or select functions within one of more applications 222. Alternatively, the keyboard 215 and touchpad 217 may be predetermined regions of a touch sensitive element forming part of the display within the Electronic Device 204. The one or more applications 222 that are typically stored in memory 212 and are executable by any combination of processors 210. Electronic Device 204 also includes accelerometer 260 providing three-dimensional motion input to the process 210 and GPS 262 which provides geographical location information to processor 210.

Electronic Device 204 includes a protocol stack 224 and AP 206 includes a communication stack 225. Within system 200 protocol stack 224 is shown as IEEE 802.11 protocol stack but alternatively may exploit other protocol stacks such as an Internet Engineering Task Force (IETF) multimedia protocol stack for example. Likewise, AP stack 225 exploits a protocol stack but is not expanded for clarity. Elements of protocol stack 224 and AP stack 225 may be implemented in any combination of software, firmware and/or hardware. Protocol stack 224 includes an IEEE 802.11-compatible PHY module 226 that is coupled to one or more Front-End Tx/Rx & Antenna 228, an IEEE 802.11-compatible MAC module 230 coupled to an IEEE 802.2-compatible LLC module 232. Protocol stack 224 includes a network layer IP module 234, a transport layer User Datagram Protocol (UDP) module 236 and a transport layer Transmission Control Protocol (TCP) module 238.

Protocol stack 224 also includes a session layer Real Time Transport Protocol (RTP) module 240, a Session Announcement Protocol (SAP) module 242, a Session Initiation Protocol (SIP) module 244 and a Real Time Streaming Protocol (RTSP) module 246. Protocol stack 224 includes a presentation layer media negotiation module 248, a call control module 250, one or more audio codecs 252 and one or more video codecs 254. Applications 222 may be able to create maintain and/or terminate communication sessions with any of devices 207 by way of AP 206. Typically, applications 222 may activate any of the SAP, SIP, RTSP, media negotiation and call control modules for that purpose. Typically, information may propagate from the SAP, SIP, RTSP, media negotiation and call control modules to PHY module 226 through TCP module 238, IP module 234, LLC module 232 and MAC module 230.

It would be apparent to one skilled in the art that elements of the Electronic Device 204 may also be implemented within the AP 206 including but not limited to one or more elements of the protocol stack 224, including for example an IEEE 802.11-compatible PHY module, an IEEE 802.11-compatible MAC module, and an IEEE 802.2-compatible LLC module 232. The AP 206 may additionally include a network layer IP module, a transport layer User Datagram Protocol (UDP) module and a transport layer Transmission Control Protocol (TCP) module as well as a session layer Real Time Transport Protocol (RTP) module, a Session Announcement Protocol (SAP) module, a Session Initiation Protocol (SIP) module and a Real Time Streaming Protocol (RTSP) module, media negotiation module, and a call control module. Portable and fixed electronic devices represented by Electronic Device 204 may include one or more additional wireless or wired interfaces in addition to the depicted IEEE 802.11 interface which may be selected from the group comprising IEEE 802.15, IEEE 802.16, IEEE 802.20, UMTS, GSM 850, GSM 900, GSM 1800, GSM 1900, GPRS, ITU-R 5.138, ITU-R 5.150, ITU-R 5.280, IMT-1000, DSL, Dial-Up, DOCSIS, Ethernet, G.hn, ISDN, MoCA, PON, and Power line communication (PLC).

Also depicted in FIG. 2 are Contextually Aware Alarm Devices (CAADs) 100 according to embodiments of the invention such as described and depicted below in respect of FIGS. 3A to 12 which support Contextually Aware Alarm (CAA) Systems, Devices, Applications and Platforms (CAA-SDAPs) according to embodiments of the invention. As depicted in FIG. 2 an CAAD 100 may communicate directly to the Network 100. Other CAADs 100 may communicate to the Network Device 207, Access Point 206, and Electronic Device 204. Some CAADs 100 may communicate to other CAADs 100 directly. Within FIG. 2 the CAADs 100 coupled to the Network 100 and Network Device 207 communicate via wired interfaces. The CAADs 100 coupled to the Access Point 206 and Electronic Device 204 communicate via wireless interfaces. Each CAAD 100 may communicate to another electronic device, e.g. Access Point 206, Electronic Device 204 and Network Device 207, or a network, e.g. Network 100. Each CAAD 100 may support one or more wireless or wired interfaces including those, for example, selected from the group comprising IEEE 802.11, IEEE 802.15, IEEE 802.16, IEEE 802.20, UMTS, GSM 850, GSM 900, GSM 1800, GSM 1900, GPRS, ITU-R 5.138, ITU-R 5.150, ITU-R 5.280, IMT-1000, DSL, Dial-Up, DOCSIS, Ethernet, G.hn, ISDN, MoCA, PON, and Power line communication (PLC).

Accordingly, FIG. 2 depicts an Electronic Device 204, e.g. a PED, wherein one or more parties including, but not limited to, a user, users, an enterprise, enterprises, third party provider, third party providers, wares provider, wares providers, financial registry, financial registries, financial provider, and financial providers may engage in one or more financial transactions relating to an activity including, but not limited to, e-business, P2P, C2B, B2B, C2C, B2G, C2G, P2D, and D2D via the Network 100 using the electronic device or within either the access point 206 or network device 207 wherein details of the transaction are then coupled to the Network 100 and stored within remote servers.

Optionally, rather than wired and/or wireless communication interfaces devices may exploit other communication interfaces such as optical communication interfaces and/or satellite communications interfaces. Optical communications interfaces may support Ethernet, Gigabit Ethernet, SONET, Synchronous Digital Hierarchy (SDH) etc.

A Contextually Aware Alarm Device (CAAD) such as the Contextually Aware Alarm Devices (CAADs) 100 in FIGS. 1 and 2 as described with respect to FIGS. 3A to 12 respectively, may include a visually impaired ice puck (VIIP) 300, also referred herein as a CAAD VIIP. It would be evident to one of skill in the art that the VIIP 300 represents one form of CAAD which in the descriptions with respect to FIGS. 3A to 12 employs audible alarms as the CAAD is directed to the visually impaired. However, within other embodiments of the invention the alarms may be visible, or they may be both audible and visual. However, within other embodiments of the invention an alarm may be directed to a local user by visual means (sight or optical based), audible means (hearing or auditory based), tactile means (touch based), smell means (olfactory based) and taste means (gustatory based) or a combination of these. The alarm may be generated directly by the CAAD itself or by another device in communication with the CAAD which generates the alarms itself rather than the CAAD itself. Within other embodiments of the invention an alarm may be directed to a remote user such as via one or more of an optical means, wireless means, wired means etc. Within other embodiments of the invention data generated and/or acquired by the CAAD may be communicated to a remote device or user wherein this data may be transmitted independent of an alarm condition, independent of an alarm, in dependence upon an alarm, etc.

Figure 3A:
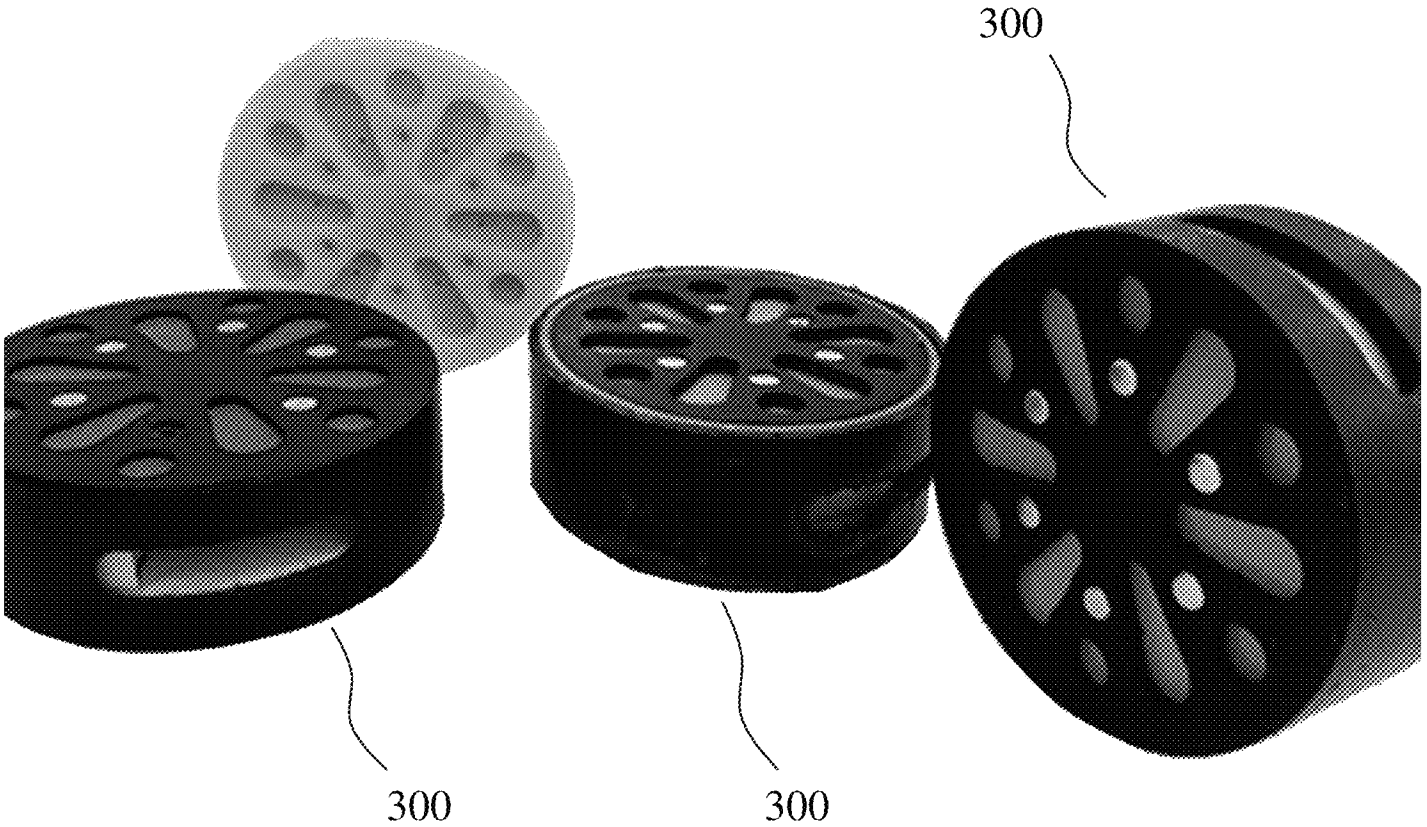
FIG. 3A depicts an ice puck for the visually impaired ice puck (VIIP) providing an exemplary contextually aware alarm device (CAAD) according to an embodiment of the invention.

Overview Description of Contextually Aware Alarm Device (CAAD) Visually Impaired Ice Puck (VIIP)—Design A As depicted in FIG. 3A CAAD VIIPs 300, hereinafter VIIPs 300 or VIIP 300, according to an embodiment of the invention are depicted which each comprise a 2"×6" hockey puck with an electronic sound system. Accordingly, a VIIP 300 provides players with visual disabilities the information they need to know regarding to the position and trajectory of the puck as well as additional information relating to the ice hockey game etc. Accordingly, the VIIPs 300 provide CAADs, such as CAADs 100 in FIGS. 1 and 2, wherein, for example, the intelligence embedded into the VIIP 300 allows for a user to configure the alarms, e.g. to modulate the sound generated by the VIIP 300. Accordingly, the VIIP 300 may generate a first alarm which is dependent upon the speed and height of the VIIP 300 relative to the ice surface whilst play is active but may generate a second alarm which is also dependent upon the speed and height of the VIIP 300 relative to the ice surface whilst play is inactive. The VIIP 300 may generate multiple alarms (e.g. audible tones or signals) where each alarm is associated with at least one of an orientation of the VIIP 300 and a range of speed of motion for the VIIP 300. Accordingly, for example if the VIIP 300 is stationary or moving below a first threshold velocity whilst "flat" with respect to a playing surface for example a first alarm is generated otherwise in this speed range and the VIIP 300 is not flat a second alarm. However, if the puck is moving between the first threshold velocity and a second threshold velocity and flat then a third alarm is generated whilst if within this range but not flat a fourth alarm is generated.

The alarms generated by the VIIP 300 may also be established in dependence upon the region of the ice hockey rink (rink) the VIIP 300 is currently within, which rink, arena or amphitheater the VIIP 300 is in use within, etc. Further, the VIIP 300 may be configured through an application, e.g. a software application upon a PED or FED, as well as providing the user with a variety of statistical data related to the VIIP 300 allowing performance to be monitored, assessed through the ice hockey game, by the player(s) interacting with the VIIP 300. The VIIP 300 may include multiple sensors such as accelerometers, magnetometers, pressure sensors, etc. as well as multiple wireless interfaces including, for example, wireless network connectivity (e.g. GSM, 5G etc.), short range wireless connectivity (e.g. Bluetooth), and near-field wireless connectivity (e.g. near field communications (NFC), radio frequency identification (RFID) etc.).

Accordingly, a VIIP 300 provides a CAAD which provides an electronic and intelligent sound system that modulates sound according to speed and/or acceleration of the VIIP 300 in order to establish data which provides users with the position and trajectory of the VIIP 300 even when it is stationary, on the rink or in the air, and modulates the sound intensity/frequency according to the speed of the puck, its altitude, different regions of rink, different types of arena etc. The VIIP 300 should also provide an optimal sound and be audible even allowing for the noise levels that may be present, e.g. during a game, the reverberation of the amphitheaters, and according to the other sound equipment used by the referee etc. during the game. It would also be beneficial for the VIIP 300 to be activated easily, have sufficient battery power to remain active for a game with intermissions etc. (e.g. for 150 minutes or more). Further, for a VIIP 300 the exterior assembly should protect the internal electronics, sound generator, etc. under harsh conditions include, but not limited to, high impacts up to 100 G arising from the VIIP 300 being dropped (for faceoff) or thrown etc. and impacts up to 5,000 G when hit with a hockey stick or when the VIIP 300 hits the glass, boards, goal posts etc. as well as be resistant to effects of moisture arising from ice, snow and rink water for example. Within the specific embodiments of the VIIP 300 should be approximately 6 cm×15 cm (2"×6") and lightweight (maximum weight 250 g (below approximately 9 oz.)). Further, the exterior of the VIIP 300 should allow the VIIP 300 to cross the rink surface without deviating from its trajectory requiring distribution of the weight.

Figure 3B:
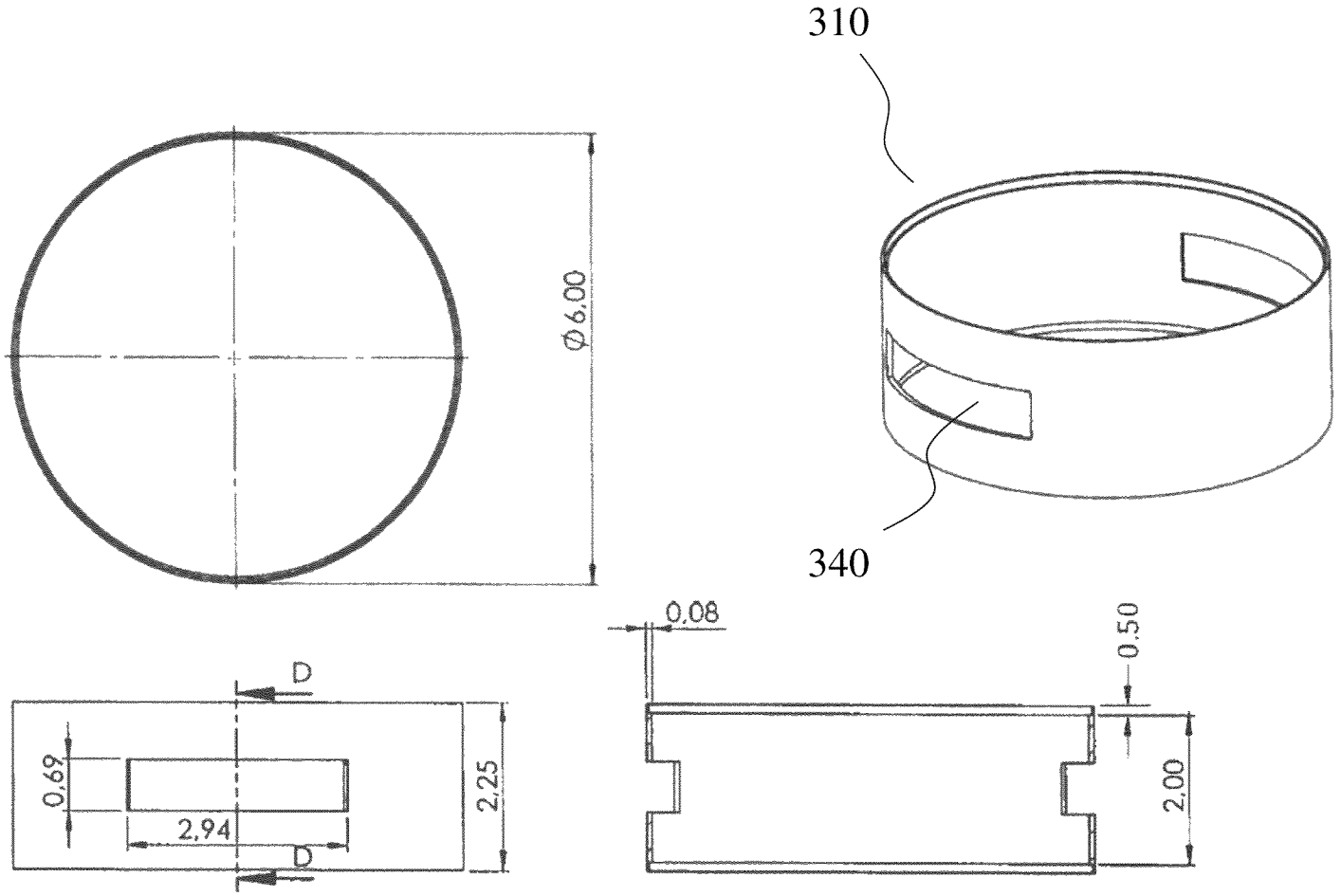
FIG. 3B depicts an outer casing for the CAAD VIIP providing an exemplary CAAD according to an embodiment of the invention.
Figure 3C:
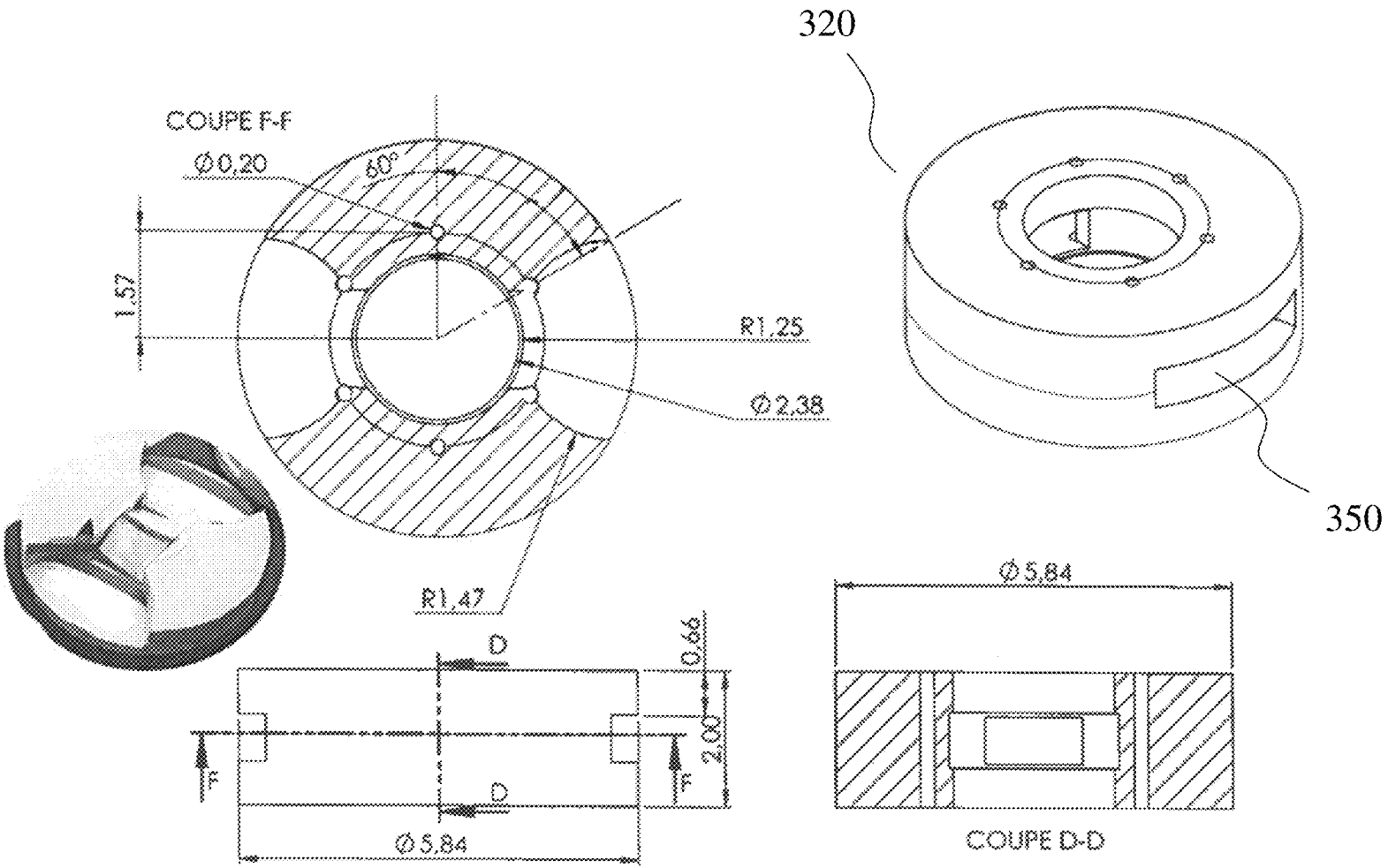
FIG. 3C depicts a sound duct module for the CAAD VIIP providing an exemplary CAAD according to an embodiment of the invention.
Figure 3D:
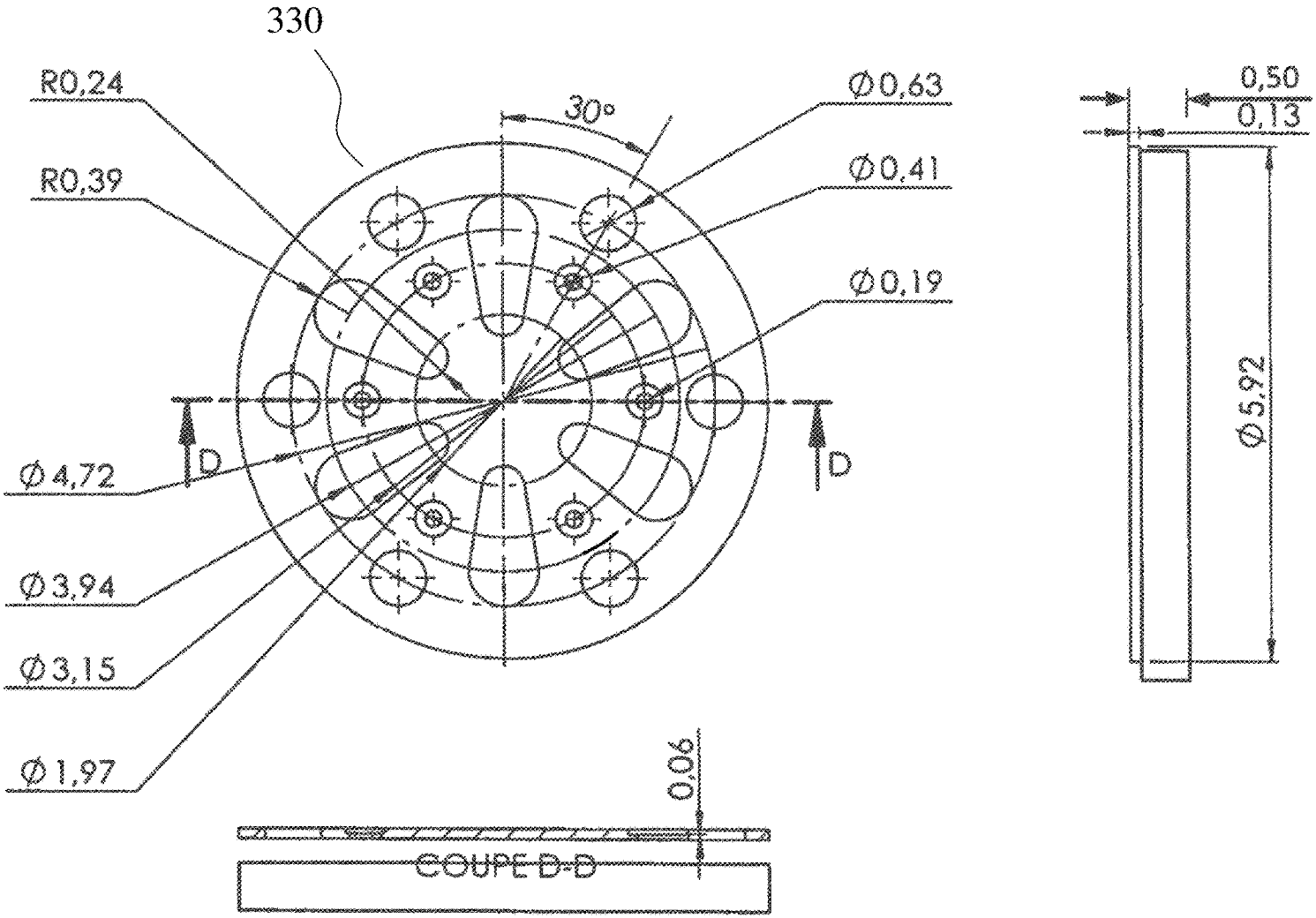
FIG. 3D depicts a lid for the CAA VIIP providing an exemplary CAAD according to an embodiment of the invention.

The prior art solution to a puck for the visually impaired is essentially a steel can filled with steel balls which provides an audible signal when the puck moves across the ice surface but not when it is stationary or in the air (until it hits something). As such the prior art puck for the visually impaired becomes undetectable to the players when it is still and is painful when it hits a player. Accordingly, the inventors have established a VIIP 300 which comprises a 5.7 cm×15 cm (2.25"×6") outer body, for example outer body 310 as depicted in FIG. 3B, formed from ultra-high molecular weight (UHMW) polyethylene to which a lid is attached, for example lid 330 as depicted in FIG. 3D. The lid 330 may be formed from UHMW polyethylene or polycarbonate. The VIIP 300 houses a bi-cylindrical sound pipe, for example sound pipe 320 as depicted in FIG. 3C, acting as a loudspeaker and transmitting a signal from a buzzer controlled by an intelligent electronic module (IEM), for example IEM 400, which is powered by a Li-ion battery.

After extensive testing of various materials, geometries, and prototypes the inventors established a shell shape that withstands high impacts in icy conditions whilst maintaining its mechanical stability with the right rebound characteristics to the ice, boards etc. to ensure the players pleasure of the game is maintained. At this point UHMW polyethylene is the only material which has established the appropriate impact resistance etc. Using UHMW polyethylene resin the case is split into two parts that fit into each other, the cylindrical 5.7 cm×15 cm (2.25" high×6" diameter) outer body 310 into which the cylindrical sound pipe 320 of dimensions 5.08 cm×14.83 cm (2.00" high×5.84" diameter) fits and to which the lid 330 of dimensions 1.27 cm×15.04 cm (0.5" thick×5.92" diameter) is attached.

The geometries of the openings within the lid 320 together with the outer body 310 and sound pipe 320 are provided within this specific implementation of a CAAD through the VIIP 300 in a specific pattern which the inventors established in order to allow for both offloading of as much of the weight of the materials but also to distribute the forces related to impacts received by the puck and to ensure its solidity. Further, a fillet radius of 0.15 cm (0.0625") on the VIIP 300 ridges ensures the stability of the VIIP 300 and limits the "jumping" of the VIIP 300 on the ice during its motion upon the ice surface. In order to attach the lid 330 to the sound pipe 320 six Chicago screws positioned 4.1 cm (~1.57") from outer diameter of the outer cylindrical surface of the VIIP 300 to ensure the strength of the assembly between the lid and the container. Within the VIIP 300 the pair of first openings 340 within the outer body 310 and the pair of second openings 350 within the sound pipe 320 provide a pair of openings of dimensions 1 cm×8 cm (0.625"×3.125") ensure diffusion of the sound from the buzzer distributed via the sound pipe 320.

The sound pipe 320 is formed from a pair of rings with square section (or crowns) which are thermoformed and nestable assembly of thickness 5.08 cm (2.00") with each ring being 2.54 cm (1.0") thick with an outside diameter of 14.8 cm (5.84") and an inner diameter of the ring of 6.1 cm (2.4"). The design of the conduit lies in the form specific speaker that ensures effective propagation of sound. The inner surface of sound tube comprises a pair of truncated cylindrical element (radius of 3.8 cm (1.5"). offset on the ring and positioned 180° to one another in order to provide internal ducts with openings of dimensions of 5.08 cm (2") on the inside and 7.3 cm (2.875") on the outside. The shape of the sound tube 320 upon the upper surface integrates six additional features which ensure adequate support on the Chicago screws.

Considering the acoustics then the shape of the housing of the intelligent electronic module (IEM), for example IEM 400, integrating the buzzer 450 participates also to the sound phenomenon and acts as a conduit of propagation. The box of the module 400 is a cylinder in Acrylonitrile Butadiene Styrene (ABS) 5.4 cm (2.25") in diameter by 3.9 cm (1.5") in height. The buzzer 450 positioned at the base of the cylinder diffuses the acoustic signal vertically (towards the center of the VIIP 300) wherein two concave walls redirect the sound signal horizontally (when the puck is sitting flat on the ice). The concave walls within the IEM 400 redirect the acoustic signal towards apertures 460 within the IEM 400, each of dimensions 4.45 cm×0.95 cm (1.75"×0.375"). When assembled these apertures 460 within the IEM 400 are aligned to the second openings 350 within the sound tube 320 and therein the first openings 340 within the outer body 310.

The behavior of the VIIP 300 is analyzed by means of an accelerometer (an embodiment of the invention employing an accelerometer capable of measuring up to 200 G, a gyroscope and a magnetometer which are connected to a microcontroller which will activate the buzzer 450, for example a piezoelectric buzzer operating from 12 V voltage, with a loudness of 100 dB at a distance of 1 meter. An exemplary circuit diagram of the electronics within the VIIP 300 being depicted in FIG. 7. The entire system is powered by a Lithium-Polymer battery (3.7 V) with built-in protection circuitry which was selected due to its ultra-thin profile and light weight (8 g), in addition to offering a battery life of 6 hours for the VIIP 300. Microcontroller programming allows for dynamic power consumption control so that power consumption is minimized wherever possible. In order to provide for a re-chargeable VIIP 300 the Lithium-Polymer battery is interfaced to a USB micro-B connector with typical recharging taking 3 to 4 hours for a full charge.

Activation of the system is carried out with a magnet through interaction with an omnipolar Hall effect sensor without opening the case of the VIIP 300. Moreover. the VIIP 300 goes dormant after a predetermined time period and is reactivated upon sufficient movement being detected. Within embodiments of the invention the VIIP 300 can react and differentiate between four types of motion; stationary motion, motion on the ice, motion in the air, and impact. With the help of regulators, the buzzer is started by detecting a movement. It is deactivated after a set period of inactivity. After some time of inactivity complete, the system allows the VIIP 300 to go out of game mode and to go into energy saving mode in order to avoid ringing during transport, for example.

As noted, the VIIP 300 is transitioned out of standby mode with a magnet although detecting sufficient movement may also be a trigger, e.g. dropping the VIIP 300 or hitting the VIIP 300 for example. The electronics within the IEM 400 also integrates a flash memory to record telemetry data. The IEM 400 electronics also contains a Bluetooth transceiver whilst the microcontroller executes an Android application. The application providing features including, but not limited to, transferring the battery level of the VIIP 300 to a remote user, allow another software application to detect and connect to the VIIP 300, manage and upload data to the VIIP 300 which may include, for example, multiple user profiles, multiple sound profiles, identify the four types of movements, track work cycles/periods etc., monitor activities, control sound modulation etc. and statistics related to the use of the VIIP 300. As mentioned above, the electronics within the IEM 400 are disposed within an ABS housing whose specific shape absorbs impacts. Further, through 6 Chicago screws the IEM 400 fits within the VIIP 400 in order to protect the wires from the battery, printed circuit board (PCB) solder connections etc., through mechanisms including the use of a strain relief grommet whilst also allowing for quick maintenance by users.

Accordingly, the VIIP 300 provides the following benefits:

- resists the impacts of the VIIP 300 during the hockey game;
- resists the low ambient temperature environment;
- waterproof;
- identifies location of the VIIP 300 even when immobile or in the air;
- dynamic alarms according to the speed/acceleration of the puck as well as its altitude;
- no mechanical switch external to VIIP 300 to activate;
- energy-saving and rechargeable; and
- real time and programmable adjustment of sounds and sound levels by user through wireless interface to accommodate ambient sound of arena.

Detailed Description of Contextually Aware Alarm Device (CAAD) Visually Impaired Ice Puck (VIIP)

The VIIP 300 as described and depicted with respect to FIGS. 3A to 10 is essentially a 50 mm high×150 mm diameter (2"×6") plastic case formed from UHMW polyethylene with a container and a screwable lid within which is a bi-cylindrical sound pipe acting as a loudspeaker and broadcasting a signal from a buzzer controlled by an intelligent electronic module powered by a lithium ion (Li-ion) battery.

VIIP Casing: The case is divided into two parts that fit together, namely outer body 310 as depicted in FIG. 3A and the lid 330 as depicted in FIG. 3C. The outer body 310 providing a hollow cylindrical container of dimensions 5 cm×15 cm (2"×6"). FIG. 3A depicts the outer body 310 together with the dimension, shape and thickness of the component. FIG. 3C depicts the lid 330 wherein the piercings on the flat surfaces of the lid 330 and the outer body 310 allows for both disposing of most of the weight of the material whilst strategically distributing the forces related to impacts to the center of VIIP 300 and ensuring its strength. The distribution of an impact being depicted in FIG. 3D through Finite Element Modelling of the structure.

Figure 3E:
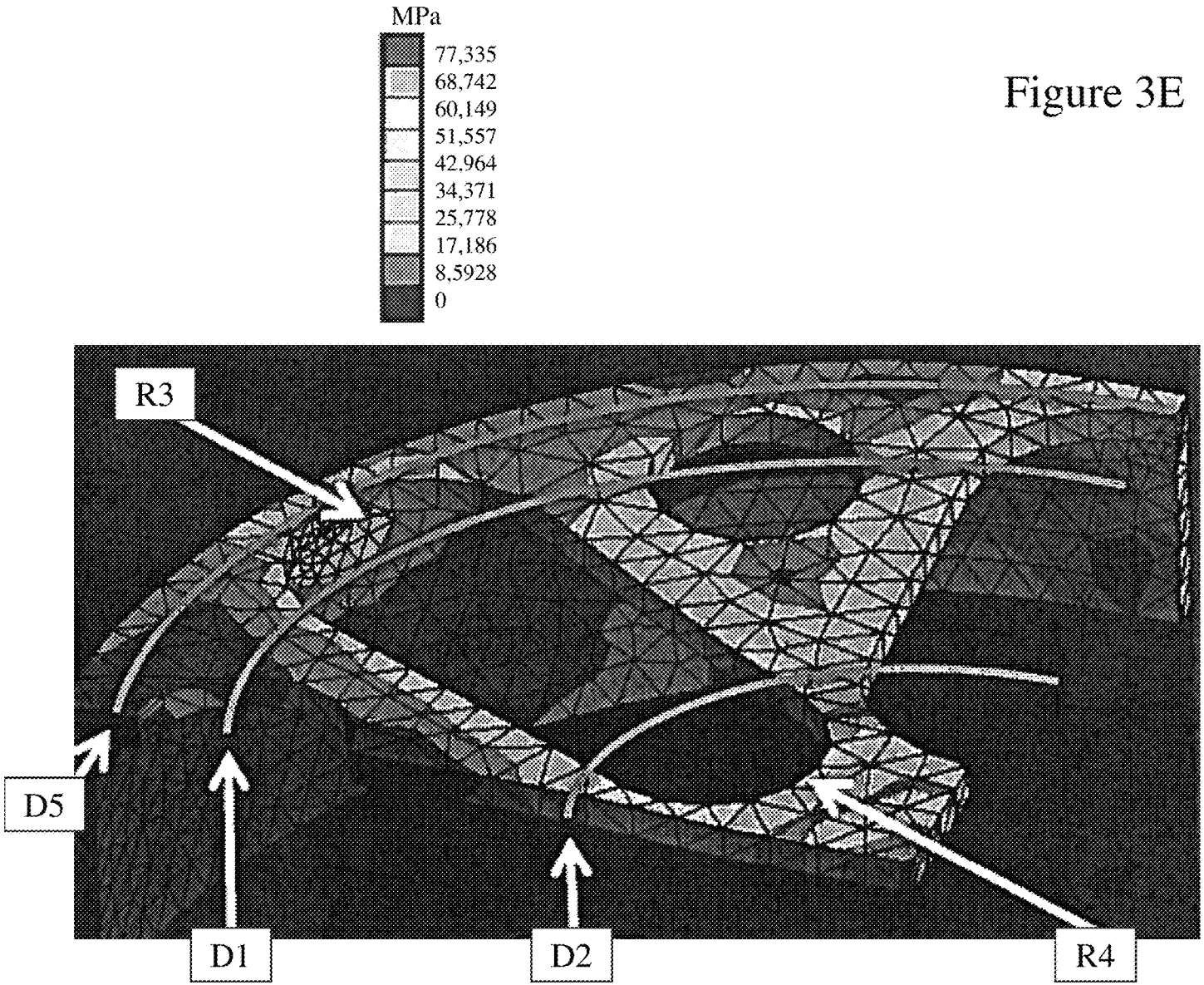
FIG. 3E depicts Finite Element Modelling simulation results for stress distribution within the CAAD VIIP arising from an impact.
Figure 4:
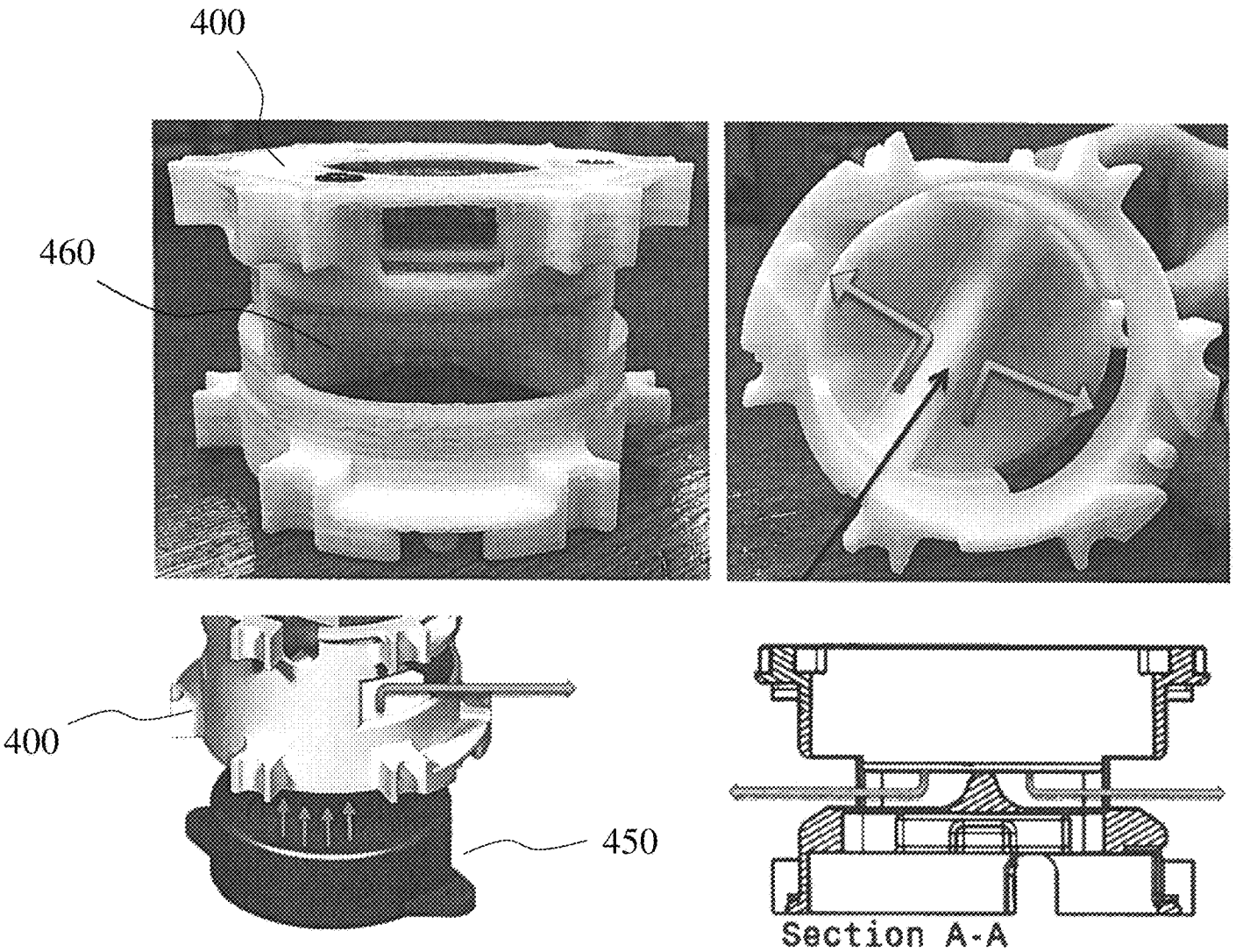
FIG. 4 depicts the sound duct module and electronics module for the CAAD VIIP providing an exemplary CAAD according to an embodiment of the invention.

Referring to FIG. 3E the inventors established a design space for the lid 330 of the VIIP 300 to ensure the solidarity and distribution of forces towards the center of the VIIP 300. This design space included establishing a minimum margin of 1 cm (0.39 in) of material to be left intact between the outer diameter of the lid 330 (15.2 cm or 6") and the beginning of any drilling as depicted by reference D5 in FIG. 3E. The largest openings should be of ovoid shape whose nearest part of the center of the puck ends in a circle of one radius (R4) 0.6 cm (0.24") whose center is 2.5 cm (0.99 inches) from the center of the VIIP 300 (represented by D2 on FIG. 3E) and the most elongated part of the center of the VIIP 300 ends in a circle with a radius (R3) of 1 cm (0.39") whose center is 6 cm (2.36 inches) from the center of the VIIP 300 (represented by D1 in FIG. 3E). Six circles of 1.35 cm (0.53") in diameter aligned on D5 in FIG. 3E were distributed at angular offsets of 60° to one another were also drilled for to remove weight. The drilling axes are distributed at an angle of 30°• and similar elements at an angle of 60°, e.g. the axis, ovoid orifices and the axis, screws and circles. A recess of 1.04 cm in diameter (0.41")×0.15 cm (0.06") in depth at the screw positions allows embedding of the head of the Chicago screws so that do rub on the ice. A clearance of 0.16 cm (0.0625") radius on the cylinder ridge ensures stability of the VIIP 30 and limit its bounce. The six Chicago screws positioned 4.1 cm (1.5625") from the outer diameter of the VIIP 300 ensure solidity of the assembly between the lid and container. On the circular surface of the cylinder, two holes of 1.5 cm×8 cm (0.625"×3.125") provide the ends of the sound ducts and ensure sound diffusion.

Sound Duct—Speaker Assembly: The sound duct consists of two rings of square section (or crowns) thermoformed which are nestable and each of thickness 1.9 cm (0.750") with an outer diameter of 13.7 cm (5.375 inches) and an inner ring diameter of 6.3 cm (2.5"). As illustrated in FIG. 3C, the particularity of the duct lies in the specific form of the loudspeaker which assumes an effective propagation of sound. It is formed from two truncated cylindrical slots (radius of 3.8 cm (1.500")) misaligned on the ring and positioned at 180° from one another providing a 5.1 cm (2") at the interior opening and 7.5 cm (2.875") external opening. The inner ribbed form integrates six semicircles which ensure adequate support on the Chicago screws.

Sound Duct—Electronic Module: The shape of the box of the electronic module integrating the sounder and participating in the sound phenomenon by acting as propagation conduit is an ABS cylinder of 5.4 cm (2.125") diameter×3.9 cm (1.50") high. The buzzer is positioned at the base of the cylinder which broadcasts its acoustic signal vertically (towards the center of the VIIP 300), then two concave walls redirect the sound signal horizontally on an axis of 180° with respect to one another on either side of the VIIP 300 leading to a 4.45 cm×1 cm (1.750"×0.375") orifice. This orifice coincides with the orifice of the sound pipe within the rings. Accordingly, the sound duct construction is specific to the form of the module and the ring which together constitute the entire sound path and ensure the quality of sound propagation from the buzzer to the exterior.

Figure 5A:
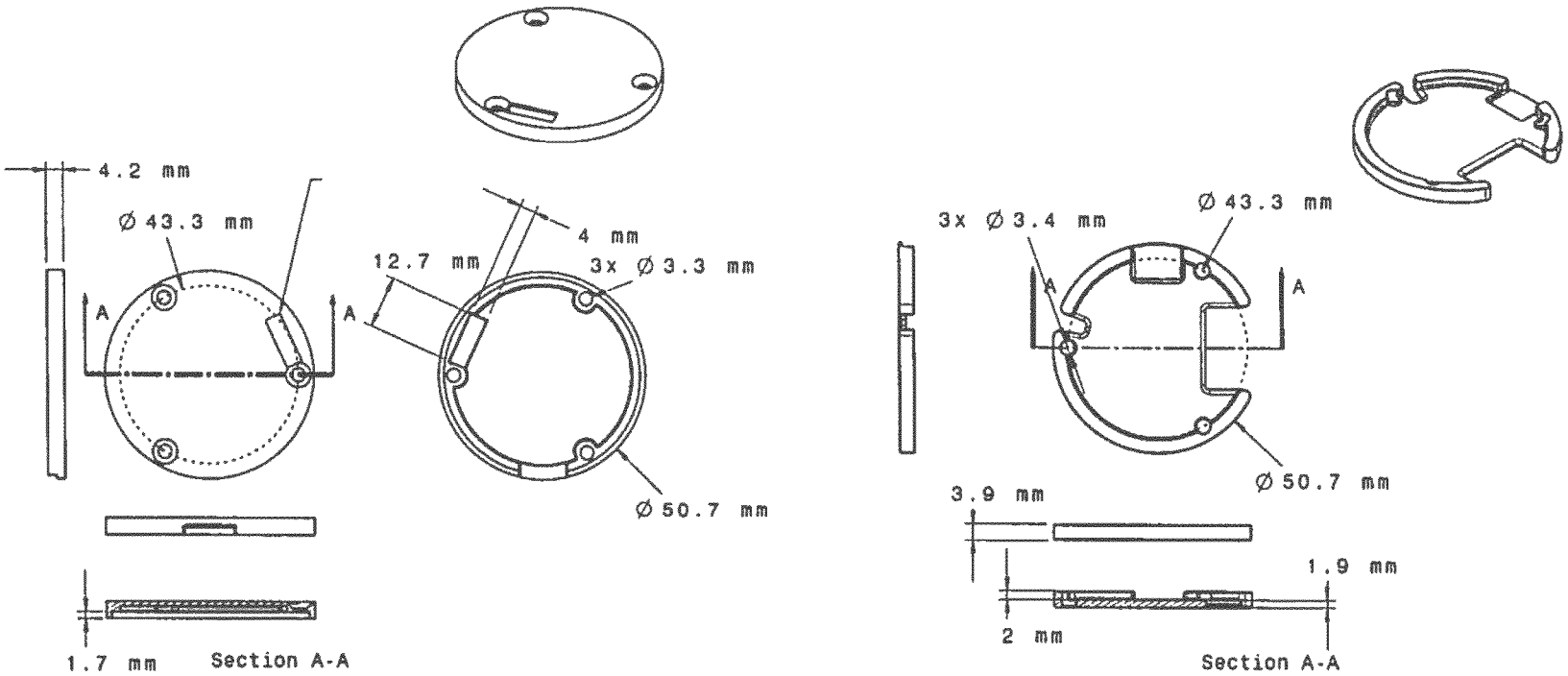
FIGS. 5A and 5B depicts the lid and sound duct module respectively for the CAAD VIIP providing an exemplary CAAD according to an embodiment of the invention.
Figure 5B:
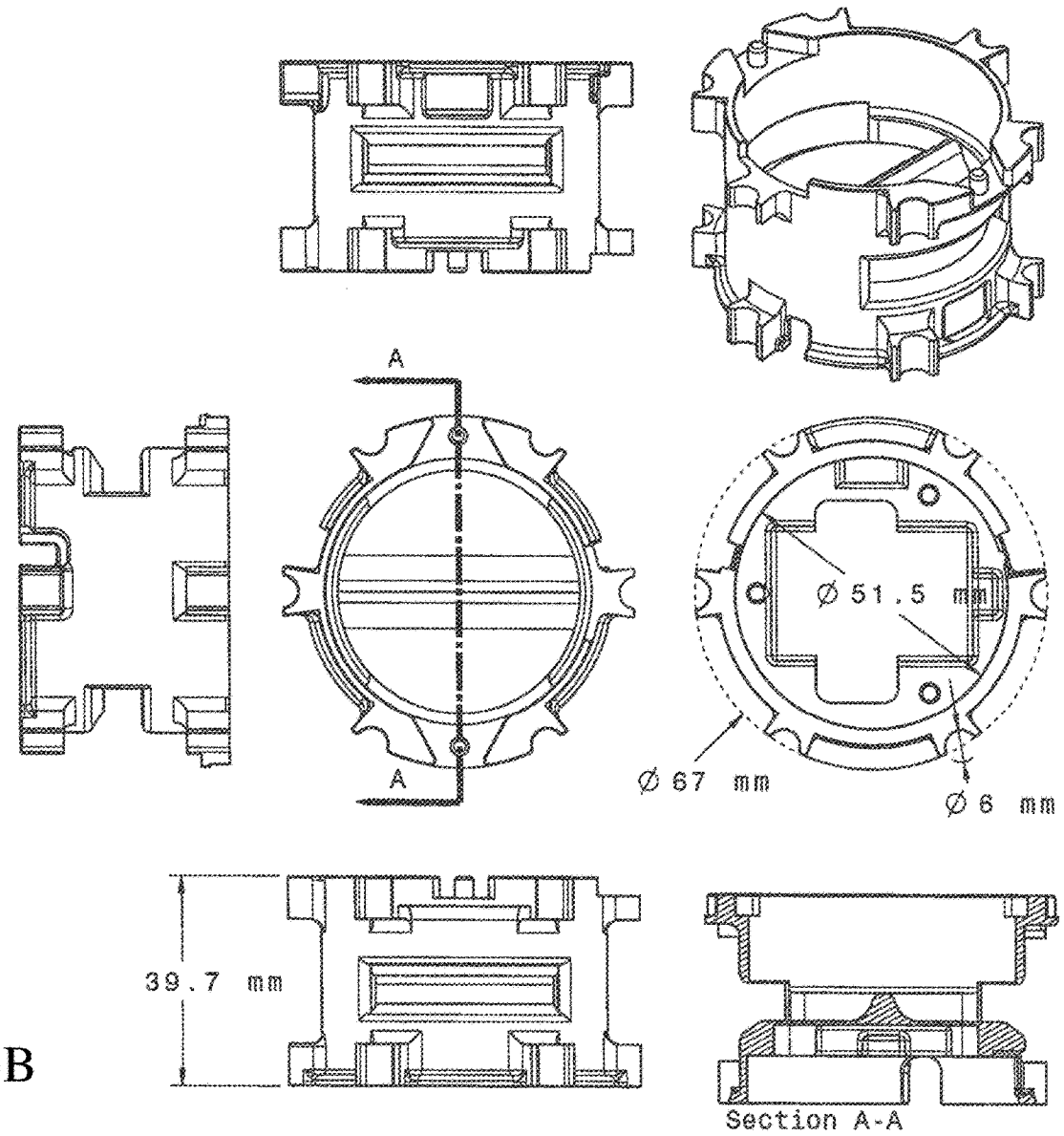

Electronic Module—Box, Modules and Components: The different electronic modules of the VIIP 300 are kept in a box formed from ABS comprising three sections inside of which are placed the buzzer, a battery and an electronic circuit whose specific shape can absorb the impacts and fits perfectly between the 6 screws of the casing (see FIGS. 6A and 6B). A strain relief protects the wires and solder joints. The module design also ensures fast maintenance for users. The dimensions of the plastic case and its cover are depicted in FIGS. 5A and 5B.

Figure 6B:
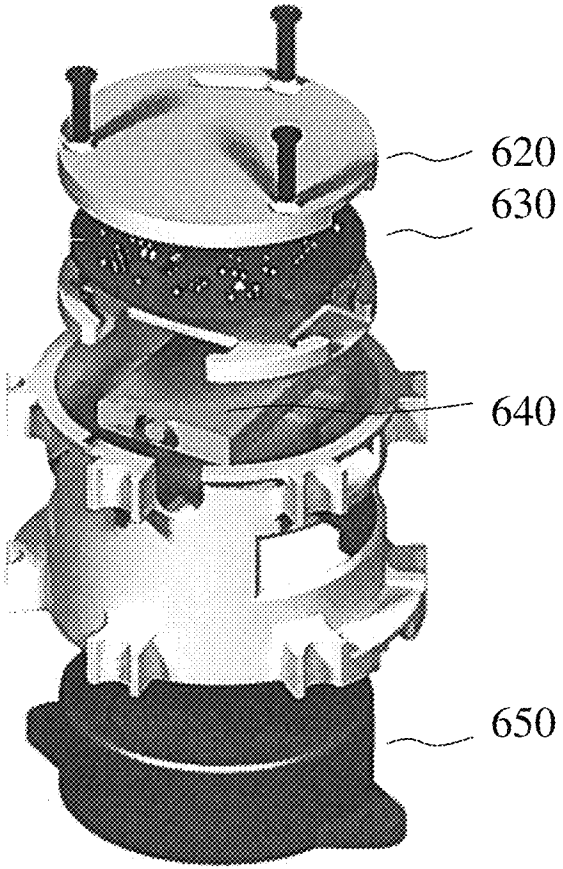
FIG. 6B depicts an exploded assembly of the internal assembly comprising sound duct module and electronics module for the CAAD VIIP providing an exemplary CAAD according to an embodiment of the invention.
Figure 6A:
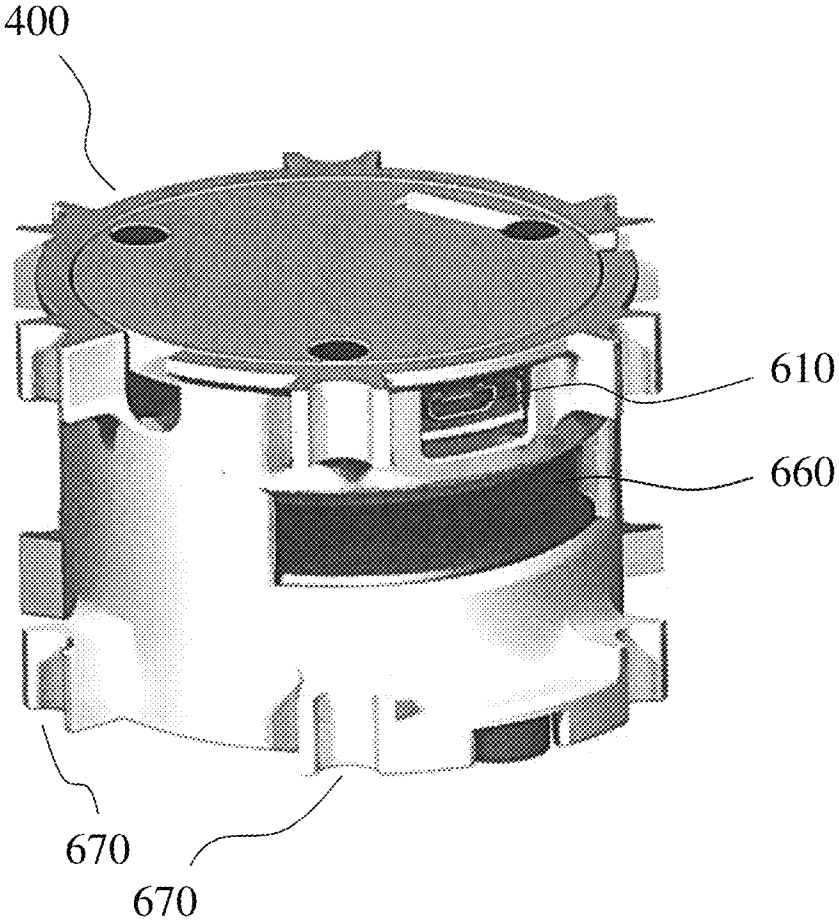
FIG. 6A depicts the internal assembly comprising sound duct module and electronics module for the CAAD VIIP providing an exemplary CAAD according to an embodiment of the invention.

Referring to FIG. 6A the IEM 400 is depicted assembled with the micro-USB interface 610 evident. FIG. 6B depicts the IEM 400 in exploded assembly form. Accordingly, there are depicted:

- Cover 620;
- Electronic circuit 630;
- Lithium-polymer batter 640; and
- Buzzer 650.

Also evident in FIG. 6A are the openings 660 for the sound ducts and the external features 670 to aligning the IEM 700 within the VIIP 300 and retaining it through the external features engaging with the Chicago screws.

Figure 7:
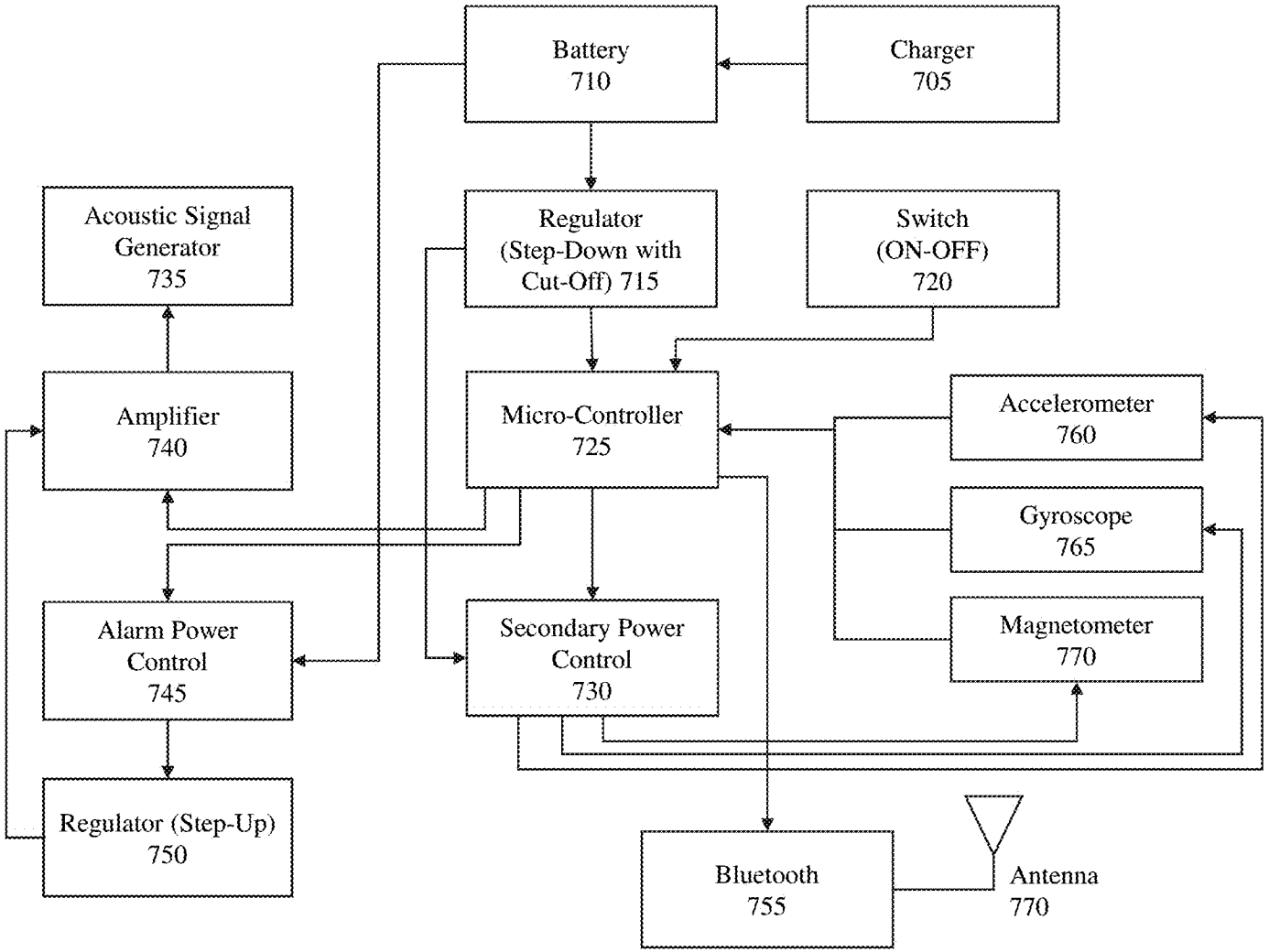
FIG. 7 depicts a schematic electrical circuit diagram for the electronics within the electronics module for the CAAD VIIP providing an exemplary CAAD according to an embodiment of the invention.
Figure 8:
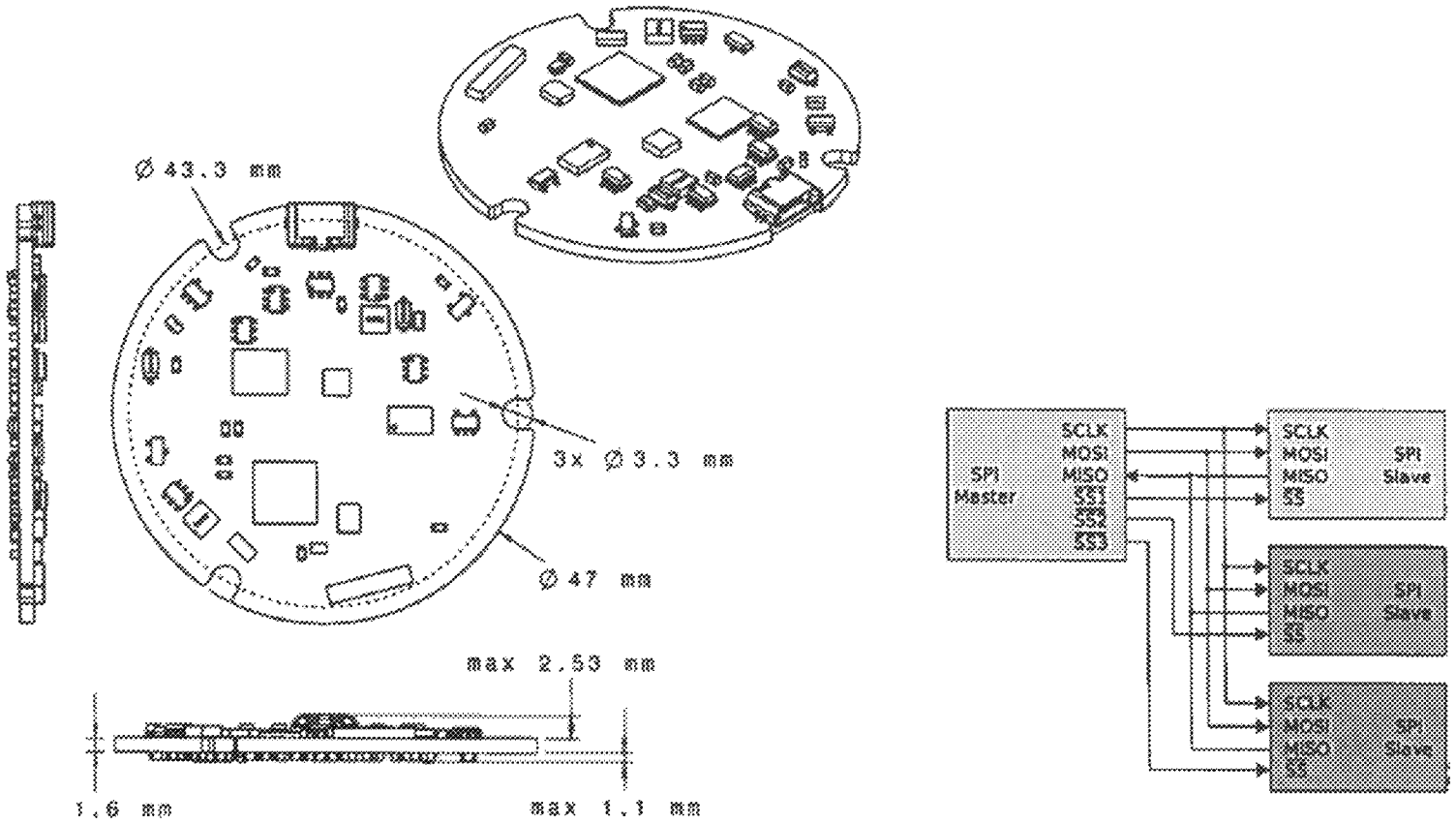
FIG. 8 depicts schematically components of the electronics module for the CAAD VIIP providing an exemplary CAAD according to an embodiment of the invention.

Electronic Module—Electronic Circuit: The behavior of the VIIP 300 is analyzed by an electronic circuit whose diagram is depicted in FIG. 7. The electronic circuit depicted in FIGS. 8 and 9 integrates an accelerometer (supporting measurements to 200 G), a gyroscope and a magnetometer, each of which is connected to a microcontroller which will activate the piezoelectric buzzer (which operates off a 12 V power supply) with a loudness of 100 dB at 1 meter. Tables 1A to 1C detail the characteristics of the main components. The whole of system is powered by a lithium-polymer battery (providing 3.7 V) with an in-built protection circuit whose particular design goals were that it be ultra-thin and light (8 grams) in addition to offering 6 hours operation for the electronic circuit. Programming of the microcontroller exploit one or more dormancy modes to ensure module operates with the lowest possible power consumption. Recharging of the battery is achieved via USB connector although alternatively a wireless charging protocol could be employed or within other embodiments of the invention removable/replaceable batteries through an alternate design providing an externally accessible battery compartment.

Accordingly, the electronic circuit as depicted in FIG. 7 comprises a charger interface 705 which allows for charging of the internal battery 710. The battery 710 is connected to a regulator 715 which provides step-down conversion with cut-off to power the microcontroller 725. The regulator 715 is also connected to a secondary power control circuit 730 as is the microcontroller 730. The battery 710 is also connected to an amplifier 740. The microcontroller 730 provides in addition to an output to the secondary power control 730 outputs to the amplifier 740 and an alarm power control circuit 745. The output of the alarm power control circuit 745 is coupled to the amplifier 740 via a second regulator 750 which provides a step-up function. The output of the amplifier is coupled to the acoustic signal generator 735.

The secondary power control 730 provides the appropriate power signals to the accelerometer 760, gyroscope 765, and magnetometer 770. Optionally, the secondary power control 730 may provide other sensor(s) not depicted for clarity. The microcontroller 725 is also coupled to a short range wireless interface, depicted as Bluetooth 755, and therein an antenna 775.

TABLE 1A

| Principal Electronic Circuit Components | |
|---|---|
| Flash Memory | Accelerometer |
| 64 Mb | ADXL375 |
| Stores sufficient data for 2 hour continuous use | Acceleration only |
| Maximum speed 85 MHz | 200 G maximum |
| Supports SPI communication | |
| Used for telemetry data recording | |

TABLE 1B

| Principal Electronic Circuit Components | |
|---|---|
| 3.3 V Regulator | 12 V Regulator |
| Switching buck-boost type | Switching step-up |
| Quiescent current 6-30 μA | 1.2-2 mA Current in Active mode |
| Always active | 0.01-1 μA in shutdowns mode |
| Transistors to activate or deactivate external modules of VIIP | |

TABLE 1B

| Principal Electronic Circuit Components | |
|---|---|
| Battery Charger | Magnetic Sensor |
| Supports 3.7 V lithium-polymer battery | Hall effect sensor |
| Recharge rate 100 mAhr | Used to power on VIIP |
| | Average current of 350 nA |

Electronic Module—Activation: The activation of the VIIP 300 is achieved through integration of a Hall effect sensor within the electronic circuit such that activation of the electronics is achieved through bringing a magnet close to the Hall effect sensor. Accordingly, the VIIP 300 can be activated without requiring the outer casing being opened or a switch being accessible on the outer casing which could turned off during use.

The microcontroller 725 based upon the inputs from the accelerometer 760, gyroscope 765 and magnetometer 770 determines different types of motion, for example stationary, moving, moving in the air, and impact. With the aid of the regulators, the audible alarm (buzzer or acoustic signal generator 735) is started after the detection of movement. The audible alarm is deactivated after a predetermined period of inactivity which can be configured by a user. After the predetermined period of inactivity, the electronic circuit allows the puck to exit the game mode and enter sleep mode in order to save energy, avoid ringing during transport for example. The VIIP 300 may be transitioned out of the standby mode either by use of the magnet or based upon the microcontroller determining a predetermined condition, e.g. the VIIP is moving above a predetermined speed, the VIIP has experienced an impact whilst in sleep-mode (e.g. dropped by linesman as play starts or re-starts).

Figure 10:
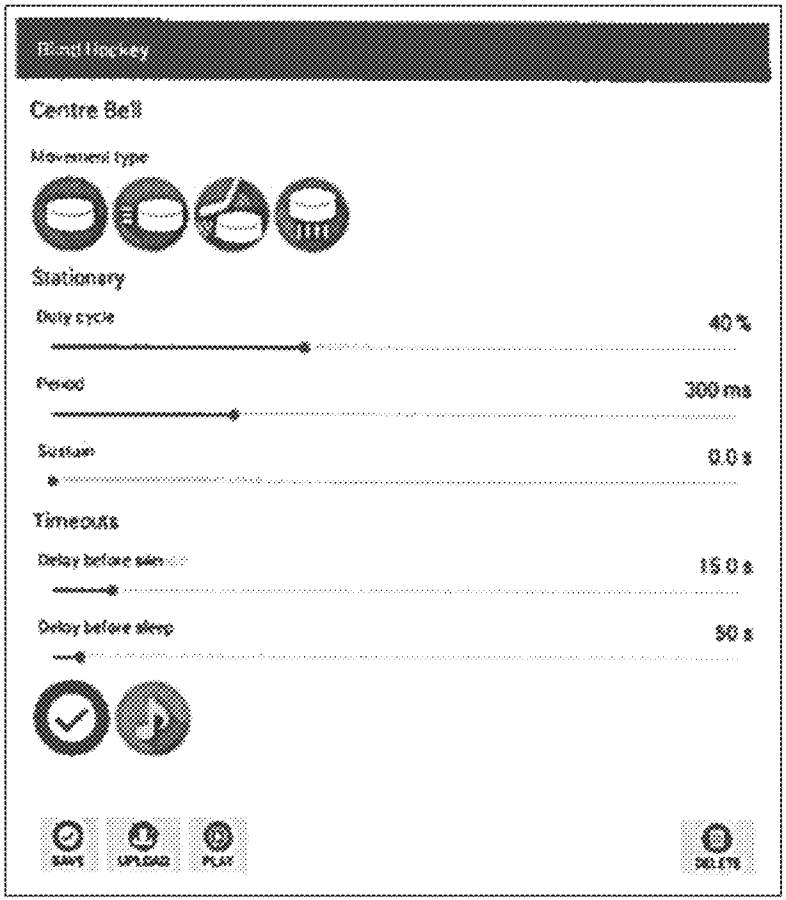
FIG. 10 depicts an exemplary user interface provided to a user of an application configuring the CAAD VIIP providing an exemplary CAAD according to an embodiment of the invention.
Figure 9:
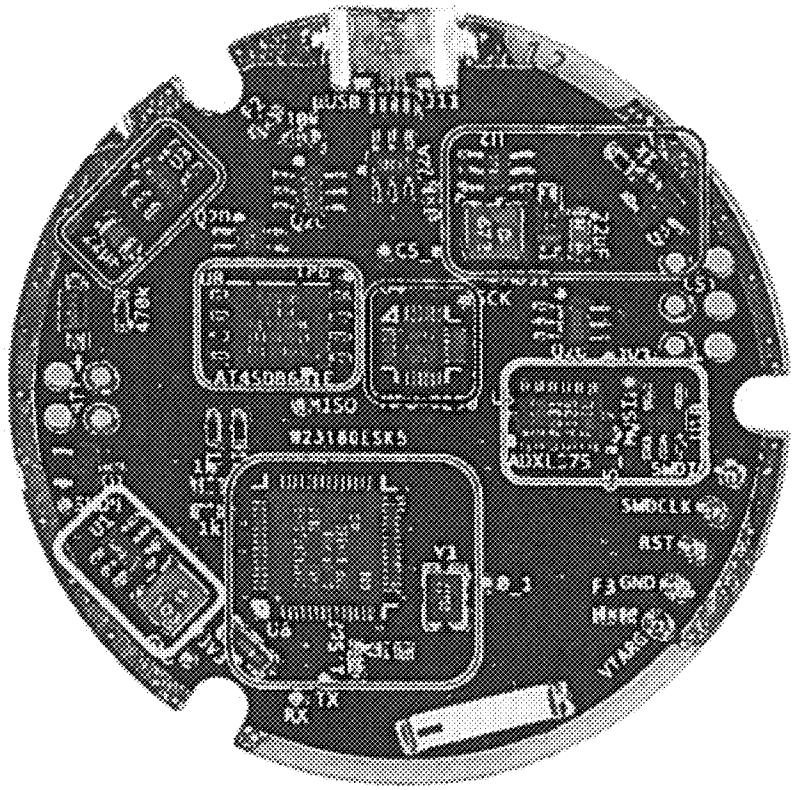
FIG. 9 depicts an optical micrograph of the electronics module for the CAAD VIIP providing an exemplary CAAD according to an embodiment of the invention.

Electronic Module—Android Interface: The VIIP 300 electronic circuit as described and depicted with respect to FIGS. 7 through 9 respectively incorporates an external flash memory, although a flash memory could be integrated into the circuit, and a short range wireless interface, Bluetooth, allowing the electronics to be interfaced via an Android application in execution upon PED or FED. The Android application (application) allowing, for example, the battery level of the VIIP 300 to be monitored, allow detection and connection to the VIIP 300, manage, generate and/or transfer user profiles, generate and/or transfer arena profiles, generate and/or transfer sound profiles, establish and transfer thresholds for different detected types of movement, transfer data from the flash memory generated by the microcontroller or generate additional data from the transferred data relating to aspects of the session of use of the VIIP 300. For example, this transferred or generated data may include, but not be limited to, work cycles/period, idle time, and statistics related to the use of the puck. FIG. 10 depicts an exemplary screenshot of a graphical user interface (GUI) of such an application.

Figure 11:
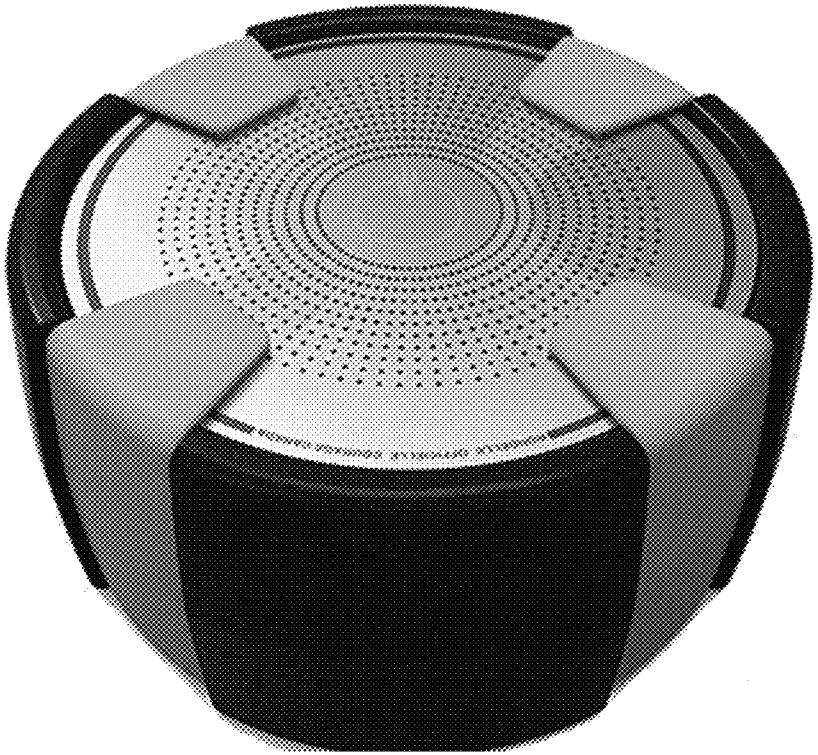
FIG. 11 depicts an external view of an ice puck for the CAAD VIIP providing an exemplary CAAD according to an embodiment of the invention.
Figure 12:
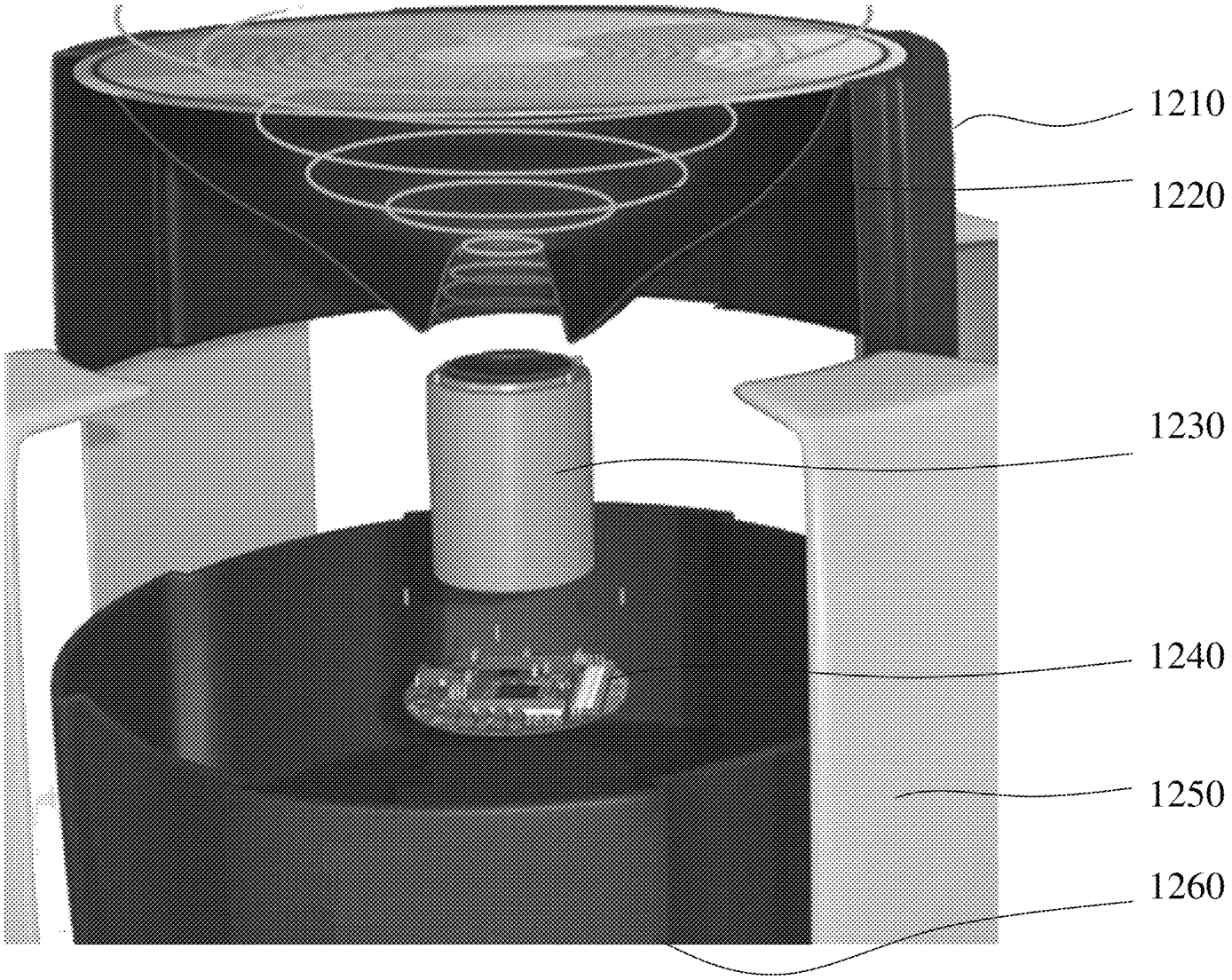
FIG. 12 depicts a perspective sectioned exploded schematic of the CAAD VIIP providing an exemplary CAAD according to an embodiment of the invention.

Overview Description of Contextually Aware Alarm Device (CAAD) Visually Impaired Ice Puck (VIIP)—Design B Referring to FIG. 11 there is depicted an alternate CAAD VIIP 1100, hereinafter VIIP 1100, according to an embodiment of the invention. As depicted in the exploded cross-sectional assembly depicted in FIG. 12 the VIIP 1100 comprises:

an upper body 1210;
sound cone 1220;
loudspeaker 1230;
electronics 1240;
outer body 1250; and
lower body 1260.

Within this design the shape of the sound cone 1220 is designed to be similar to that of a cone within a loudspeaker allowing for the sound to be homogenously distributed through the cover of the upper body 1210 which is perforated. The actuator for the sound generator may be a piezoelectric buzzer, membrane, etc.

Overview Description of Contextually Aware Alarm Device (CAAD) Visually Impaired Ice Puck (VIIP)—Design C As described above a VIIP provides ice hockey players with a contextually aware alarm device (CAAD). VIIPs 300 and 1100 as depicted in FIGS. 3A and 11 respectively being two different designs for the CAAD VIIP according to embodiments of the invention. The different elements of a third design of a CAAD VIIP according to an embodiment of the invention are depicted in FIGS. 13 to 22 as described below. The external appearance of the fully assembled CAAD VIIP being similar to VIIPs 300 depicted in FIG. 3A and described in FIGS. 3B to 9 respectively. However, the inventors established the design described and depicted with respect to FIGS. 13 to 22 to provide alternate featured and performance. For example, the VIIP as described below provides:

Increased overall strength of the VIIP;

Improved deformation control of the VIIP;

A light pipe to allow viewing of the state of the VIIP without having to open it;

Dual audio generators for higher sound intensity; and

Modification of the electronic module housing to integrate the two audible warning devices (audio generators).

A rugged power jack rather than USB interface provides improved reliability and allows the VIIP to be recharged without having to open it.

Figure 13:
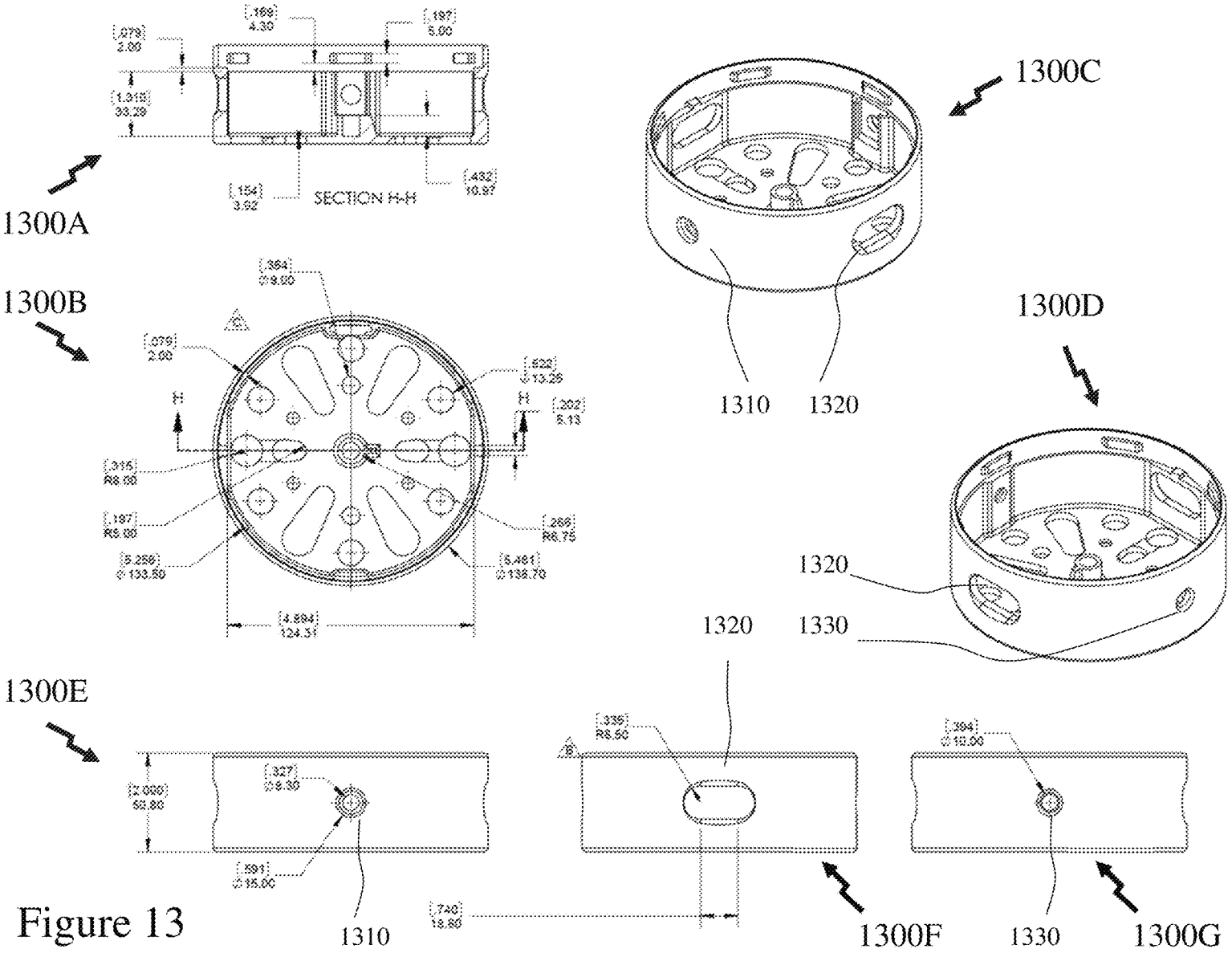
FIGS. 13 and 14 depict CAD drawings and rendered model views of an outer casing for a CAAD VIIP providing an exemplary CAAD according to an embodiment of the invention.
Figure 14:
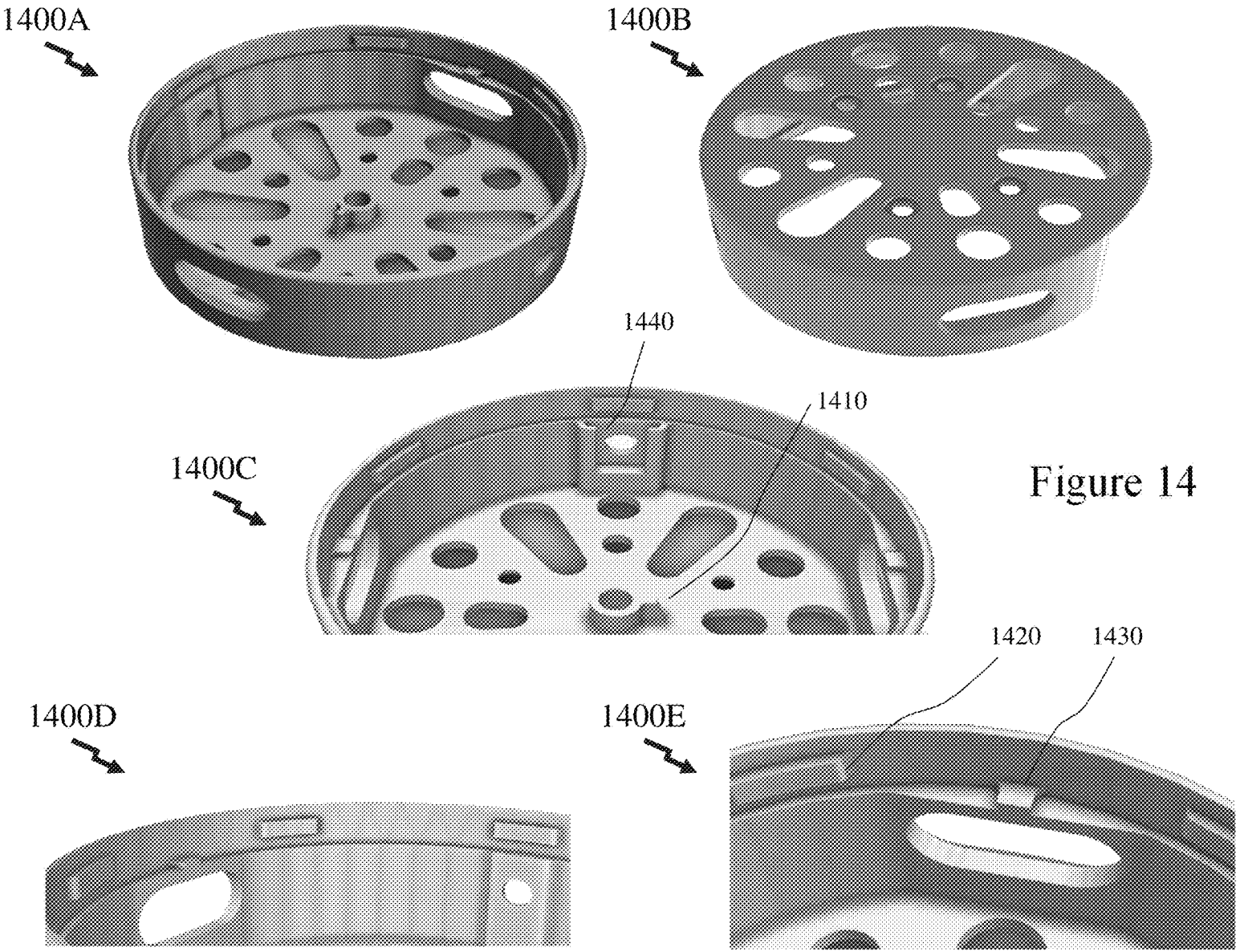

The VIIP comprises an outer casing and a cover for the outer casing within which is disposed an electronic module housing surrounded by foam elements and an acoustic guide. A light guide provides a visual port through the VIIP to the LEDs on the inner electronic module housing whilst other openings provide the audio outlets and power jack. Referring to FIGS. 13 and 14 there are depicted CAD drawings and rendered model views of an outer casing for a CAAD VIIP providing an exemplary CAAD according to an embodiment of the invention. Accordingly, FIG. 13 depicts first to seventh views 1300A to 1300G comprising:

First view 1300A which is a top cross-sectional engineering drawing of the outer casing along Section H-H in second image 1300B;

Second view 1300B which is a front view engineering drawing of the outer casing;

Third view 1300C is a perspective view of the outer casing from one perspective showing jack opening 1310 (for the power jack to be accessed through) and sound opening 1320;

Fourth view 1300D is a perspective view of the outer casing from one perspective showing light pipe opening 1330 (for viewing the status LED on the electronic module) and the other sound opening 1320;

Fifth view 1300E which is a bottom elevation view of the outer casing showing the jack opening 1310;

Sixth view 1300F which is a side elevation view of the outer casing showing the sound opening 1320; and Seventh view 1300G which is a top elevation view of the outer casing showing the light pipe opening 1330.

Now referring to FIG. 14 there are depicted first to fifth views 1400A to 1400E, these comprising:

First view 1400A is a top perspective view of the outer casing rendered within a CAD software application (hereinafter referred to as a CAD tool);

Second view 1400B a bottom is a perspective view of the outer casing rendered within the CAD tool;

Third view 1400C is a zoomed top perspective view of the outer casing rendered within the CAD tool showing the support and key feature 1410 at the centre for supporting and locking orientation of the electronic module housing; and Fourth view 1400D and fifth view 1400E are zoomed top perspective views of the outer casing rendered within the CAD tool showing keys 1420 for retaining the cover and locking key 1430 which locks the orientation of the cover relative to the casing.

Also depicted in third image 1400C of FIG. 14 is fitting 1440 for the light pipe.

Figure 15:
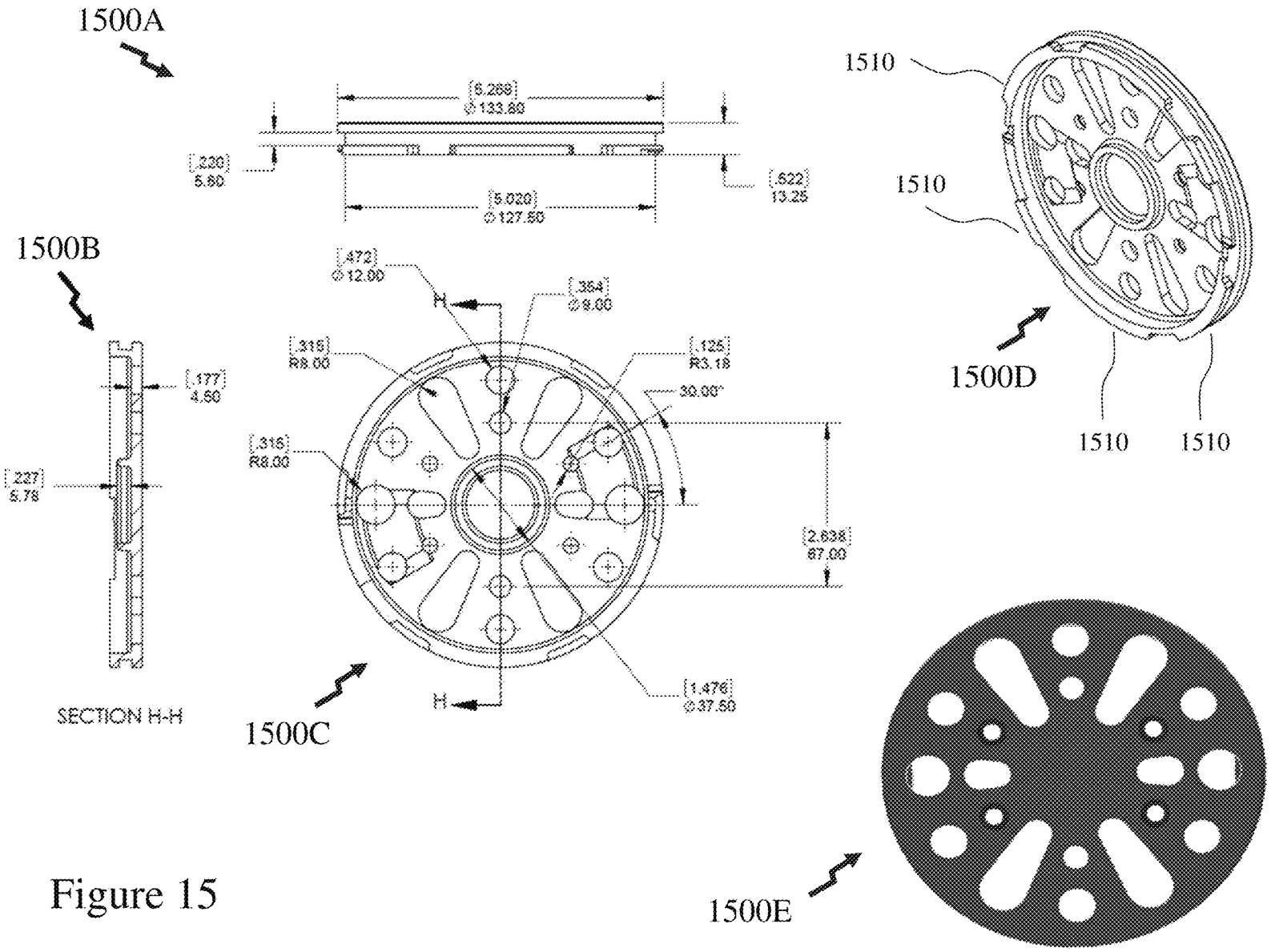
FIG. 15 depicts CAD drawings and rendered model views of a cover for a CAAD VIIP providing an exemplary CAAD according to an embodiment of the invention.

Now referring to FIG. 15 there are depicted CAD drawings and rendered model views of a cover for a CAAD VIIP providing an exemplary CAAD according to an embodiment of the invention. As depicted first to fifth view 1500A to 1500E present:

First view 1500A is a top view engineering drawing of the cover;

Second view 1500B is a cross-sectional side elevation view engineering drawing of the cover along section line H-H as depicted in third view 1500C;

Third view 1500C is a front view engineering drawing of the cover;

Fourth view 1500D is a perspective engineering drawing of the cover depicting the wrench features 1510 around its periphery which engage with the keys 1420 in the outer casing for retaining the cover once mounted and rotated; and Fifth view 1500E is a bottom view rendered with the CAD tool.

Figure 16:
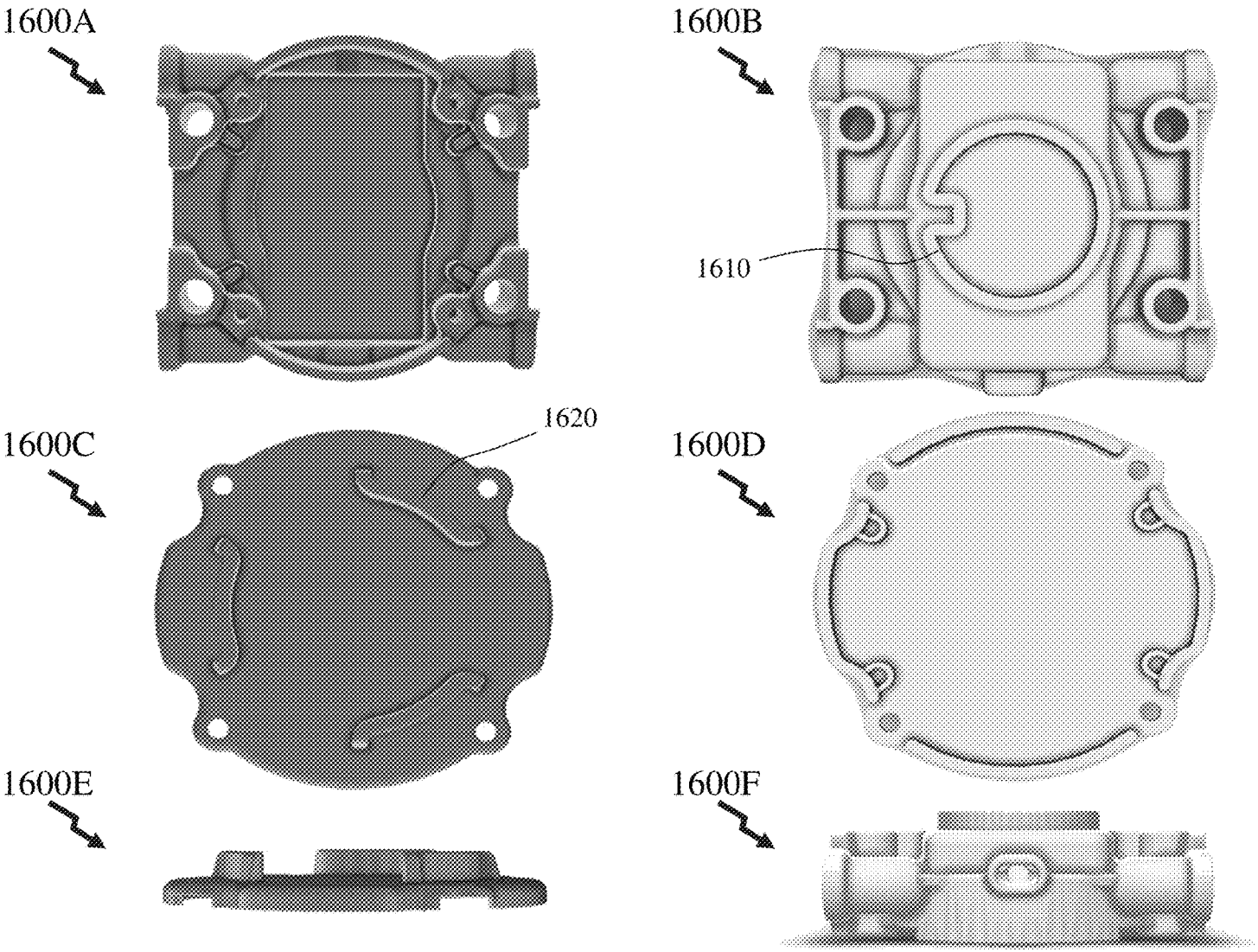
FIGS. 16 and 17 depict rendered model views of an electronic housing for a CAAD VIIP providing an exemplary CAAD according to an embodiment of the invention.
Figure 17:
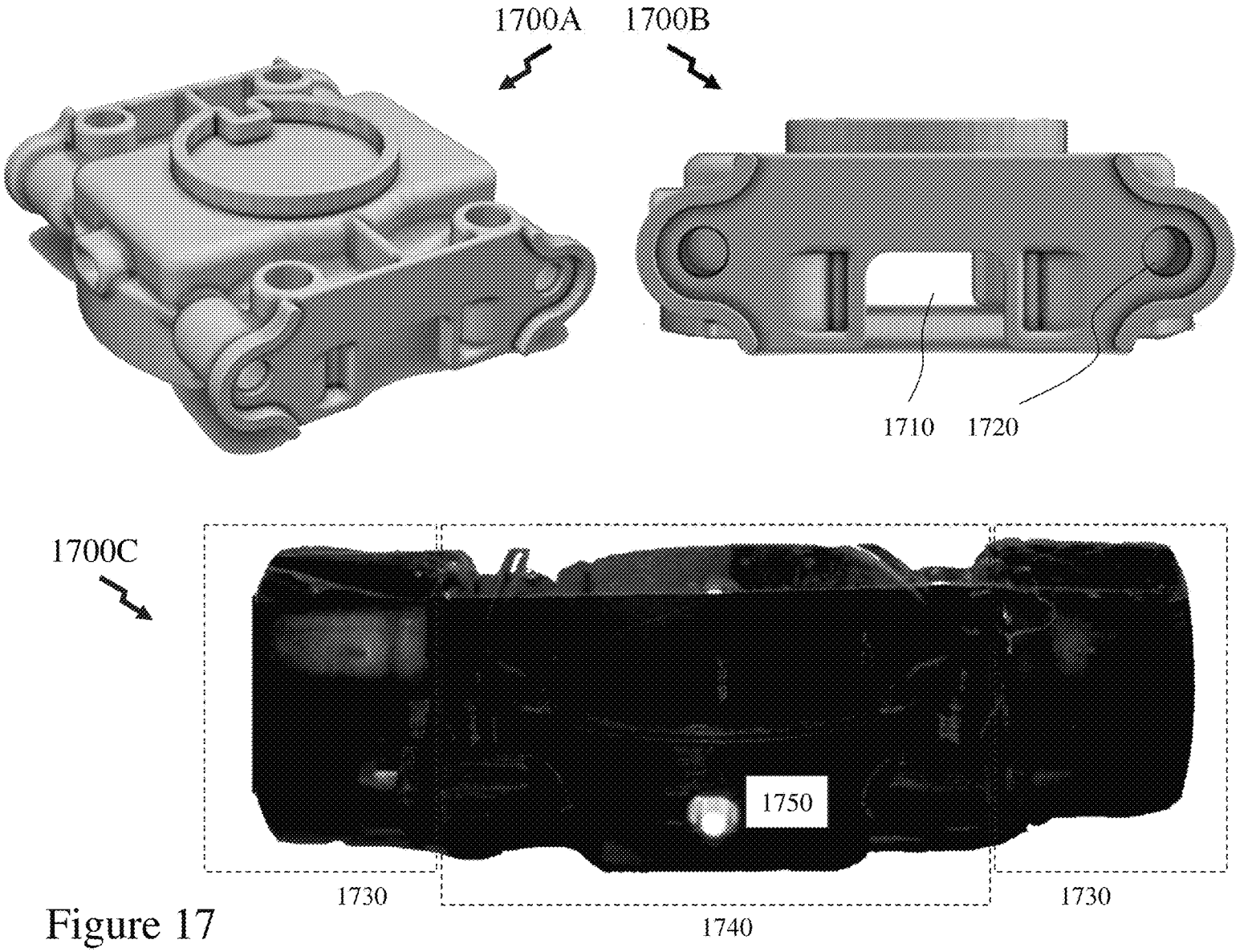

Now referring to FIGS. 16 and 17 there are depicted rendered model views of an electronic module housing for a CAAD VIIP providing an exemplary CAAD according to an embodiment of the invention. The electronic module housing incorporates all of the electronics for the CAAD VIIP into a single integrated module. Accordingly, as described within this specification this can include, but not be limited to, sensor(s), microprocessor(s), LED(s), acoustic generator(s), battery, and wireless transceiver(s). It may also integrate other elements, including, but not limited to, light pipe(s) and acoustic guide(s). Accordingly, referring to FIG. 16 there are depicted first to sixth images 1600A to 1600F respectively, these comprising:

First view 1600A is a rendered front view of a body portion of the electronic module housing;

Second view 1600B is a rendered rear view of the body portion of the electronic module housing with base key 1610;

Third view 1600C is a rendered front view of a cover portion of the electronic module housing showing a series of cover keys 1620;

Fourth view 1600D is a rendered rear view of the cover portion of the electronic module housing;

Fifth view 1600E is a rendered bottom view of the cover portion of the electronic module housing;

Sixth view 1600F is a rendered bottom view of the assembled electronic module housing.

The series of cover keys 1620 on the cover portion with the key 1610 on the body portion stabilize the electronic module housing within the outer casing and cover for the outer casing. Within an embodiment of the invention the cover of the electronic module housing is attached to the body of the electronic module housing with Chicago screws which keep the electronic module housing tightly closed even during impacts.

FIG. 17 depicts first to third image 1700A to 1700C respectively, these comprising:

First view 1700A is a rendered perspective view of the body portion of the electronic module housing;

Second view 1700B is a rendered end view of a body portion of the electronic module housing showing openings 1710 for passing wires from the external acoustic generators to the electronics within the electronic module housing and the mounts 1720;

Third view 1700C is an optical micrograph of the assembled unit comprising electronic module housing 1740 to which are attached the acoustic generators with their associated horns 1730. Also depicted is the LED 1750 providing the status indication that is viewed through the light pipe.

By providing the external light pipe the status indicator LED 1750 can be integrated into the electronic module housing such that this can be assembled and sealed to prevent ingress of moisture, water, snow, dirt, particulates etc.

Figure 18:
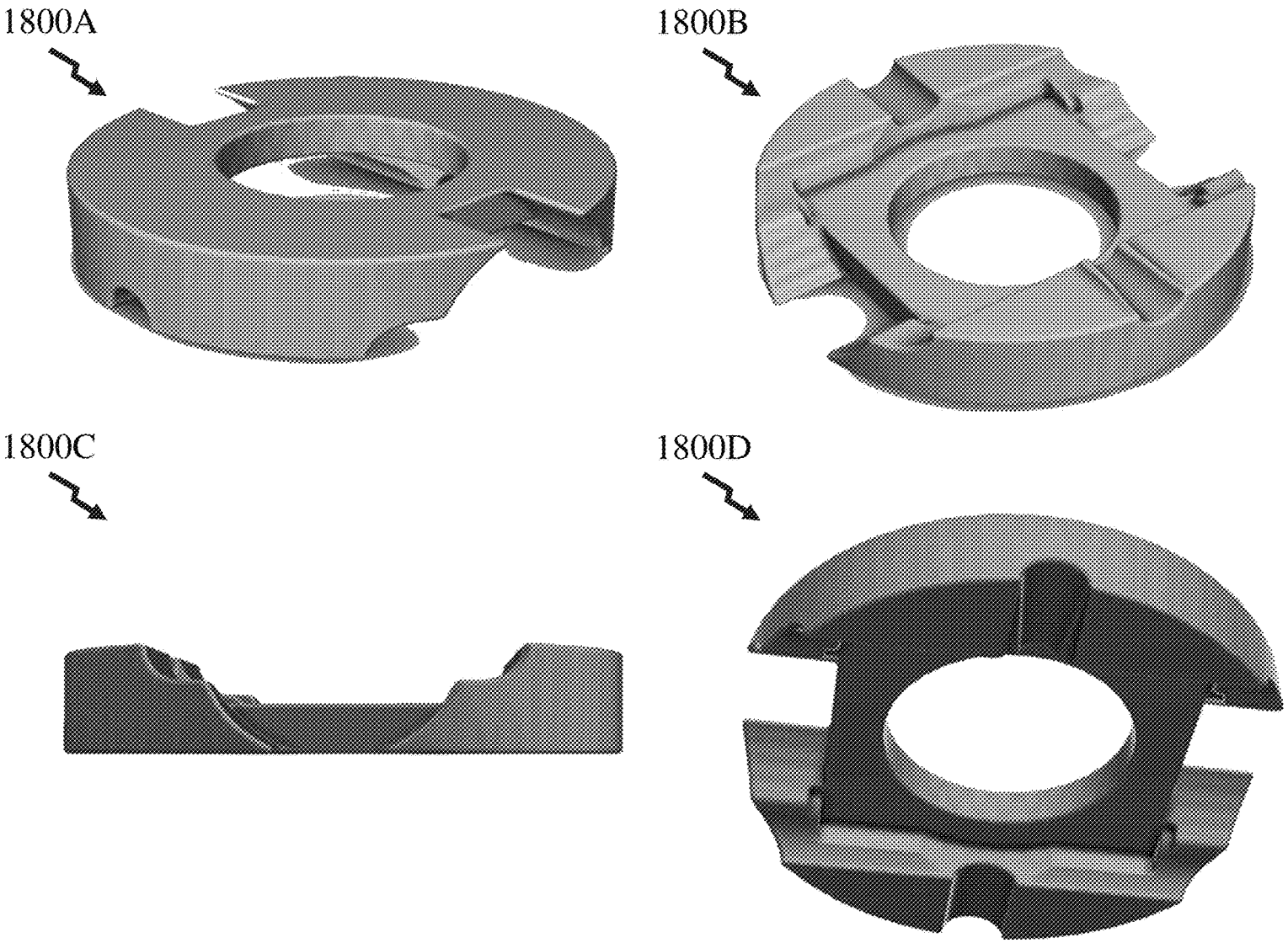
FIGS. 18 and 19 depict CAD drawings and rendered model views of protective foam elements disposed between the cover/casing of the VIIP and the electronics housing for a CAAD VIIP providing an exemplary CAAD according to an embodiment of the invention.
Figure 19:
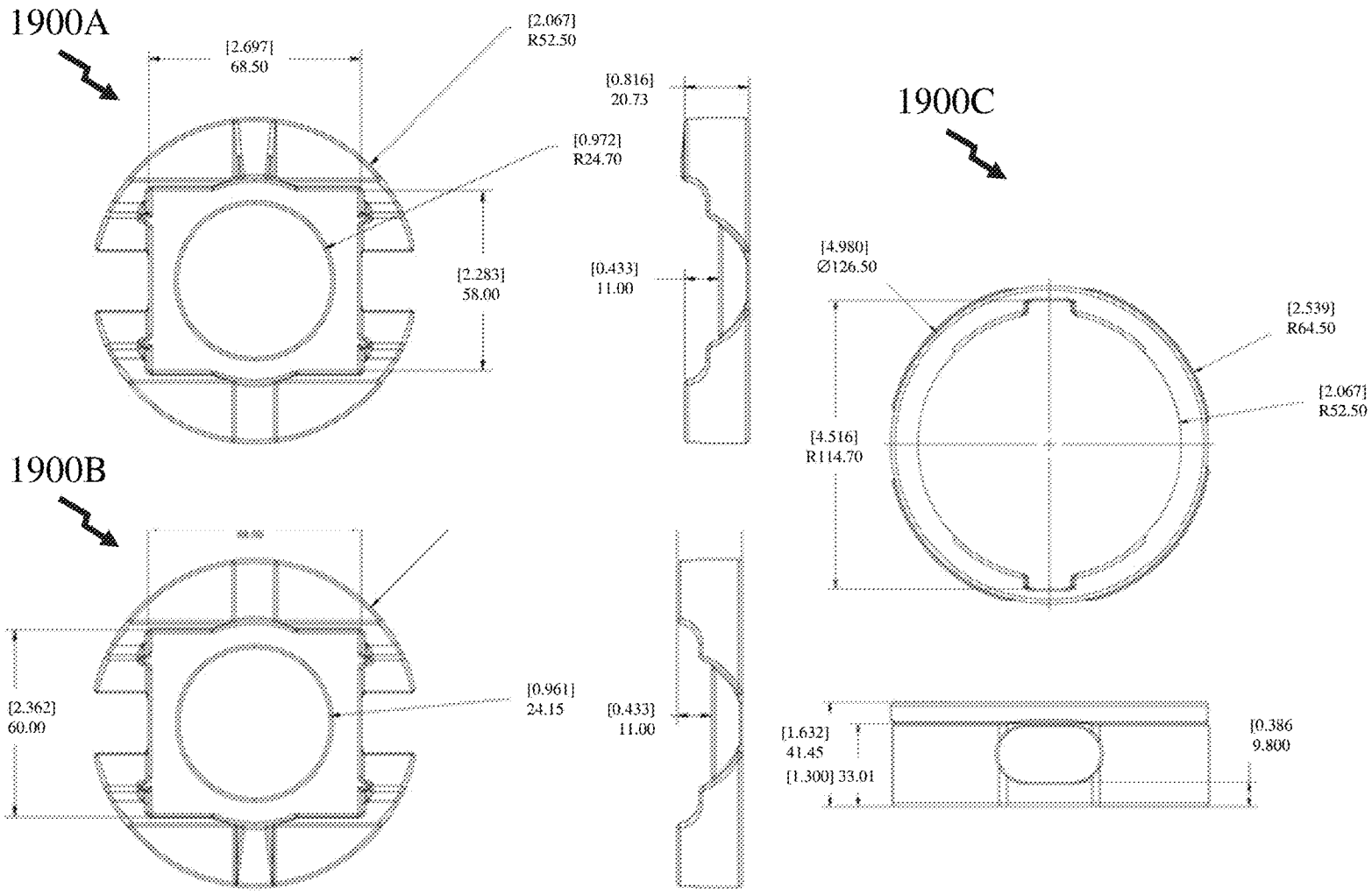

Referring to FIGS. 18 and 19 there are depicted CAD drawings and rendered model views of protective foam elements disposed between the cover/casing of the VIIP and the electronics housing for a CAAD VIIP providing an exemplary CAAD according to an embodiment of the invention. The "protective module" comprises a bottom portion, a top portion and a ring portion which are formed in a lightweight material, e.g. molded in polyurethane foam, in order to protect the electronic module against impacts and water infiltration by surrounding it. Accordingly, the top portion, bottom portion, and ring portion are designed to fit around the electronic module with the acoustic generators/horns, light pipe etc.

Referring to FIG. 18 there are depicted first to fourth images 1800A to 1800D respectively, these comprising:

First image 1800A is a rendered top perspective view of a top portion or bottom portion (which as evident from FIG. 19 vary in the dimension of the inner annulus and dimensions of the central square portion);

Second image 1800B is a rendered bottom perspective view of a top portion or bottom portion Third image 1800C is a rendered end perspective view of a top portion or bottom portion; and Fourth image 1800D. is a rendered bottom perspective view of a top portion or bottom portion FIG. 19 depicts in first and second images 1900A and 1900B respectively engineering drawings for the top and bottom portions of the protective module whilst third image 1900C depicts the ring portion of the protective module.

Figure 20:
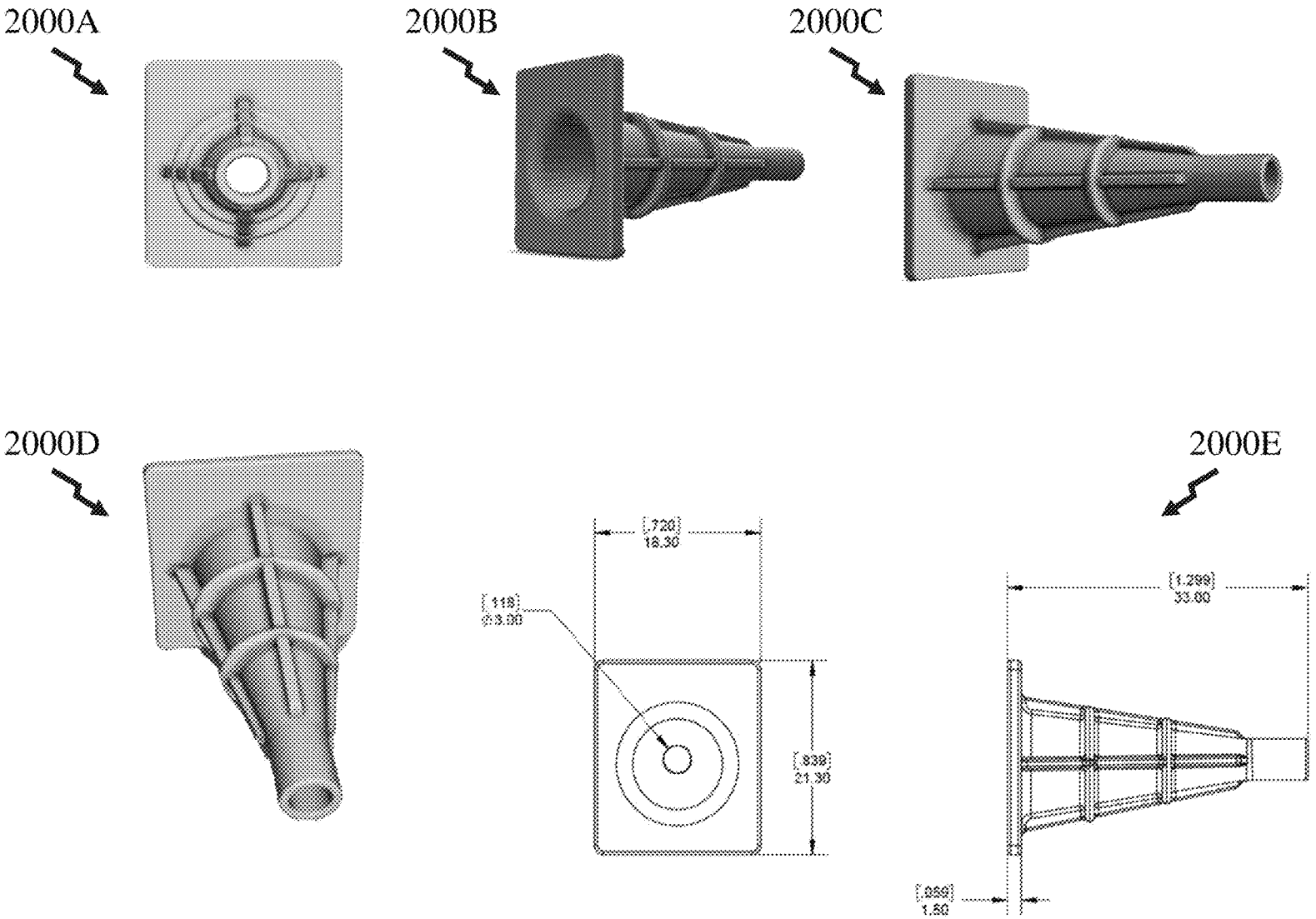
FIG. 20 depicts CAD drawings and rendered model views of an optical light pipe for a CAAD VIIP providing an exemplary CAAD according to an embodiment of the invention.

As described above a LED status indicator is provided on the sealed electronic module. In order allow this to be viewed externally to the CAAD VIIP a light pipe as depicted in FIG. 20 is provided. The square rear of the light pipe fits into a fitting, fitting 1440, of the outer casing. The light pipe may within an embodiment of the invention be formed from a flexible material such that it can withstand bending, flexing, and compression under deformation of the outer casing etc. A cover may be disposed over either end of the light pipe or be integrated with the light pipe to limit ingress of moisture, water, snow, dirt, particulates etc.

FIG. 20 depicts CAD drawings and rendered model views of an optical light pipe for a CAAD VIIP providing an exemplary CAAD according to an embodiment of the invention. These comprising:

First image 2000A is a rendered end perspective view of the light pipe;

Second image 2000B is a rendered rear perspective view of the light pipe;

Third image 2000C is a rendered front side perspective view of the light pipe;

Fourth image 2000D is a rendered front upper perspective view of the light pipe;

Fifth image 2000E is an engineering drawing of the light pipe.

As evident in FIGS. 3A, 3D, and 13-15 the outer casing and cover of the CAAD VIIP 300 have holes. Disposed inside the outer casing and cover between these and the protective module are disposed two coloured films, e.g. a polycarbonate sheet. These cover and seal the pierced wall prevent snowing, ice, etc. from entering the CAAD VIIP 300A. Holes are provided to pass the necessary components and screws etc. The colored film makes it possible to effect a style through the openings whereby with a high visibility colour, e.g. Pantone Yellow 109 C, the colour can provide some individuals with enhanced visibility of the CAAD VIIP 300A. Optionally, other effects such as logos, branding etc. can be patterned into the CAAD VIIP 300A in this manner as well as through other means as known in the art.

Figure 21:
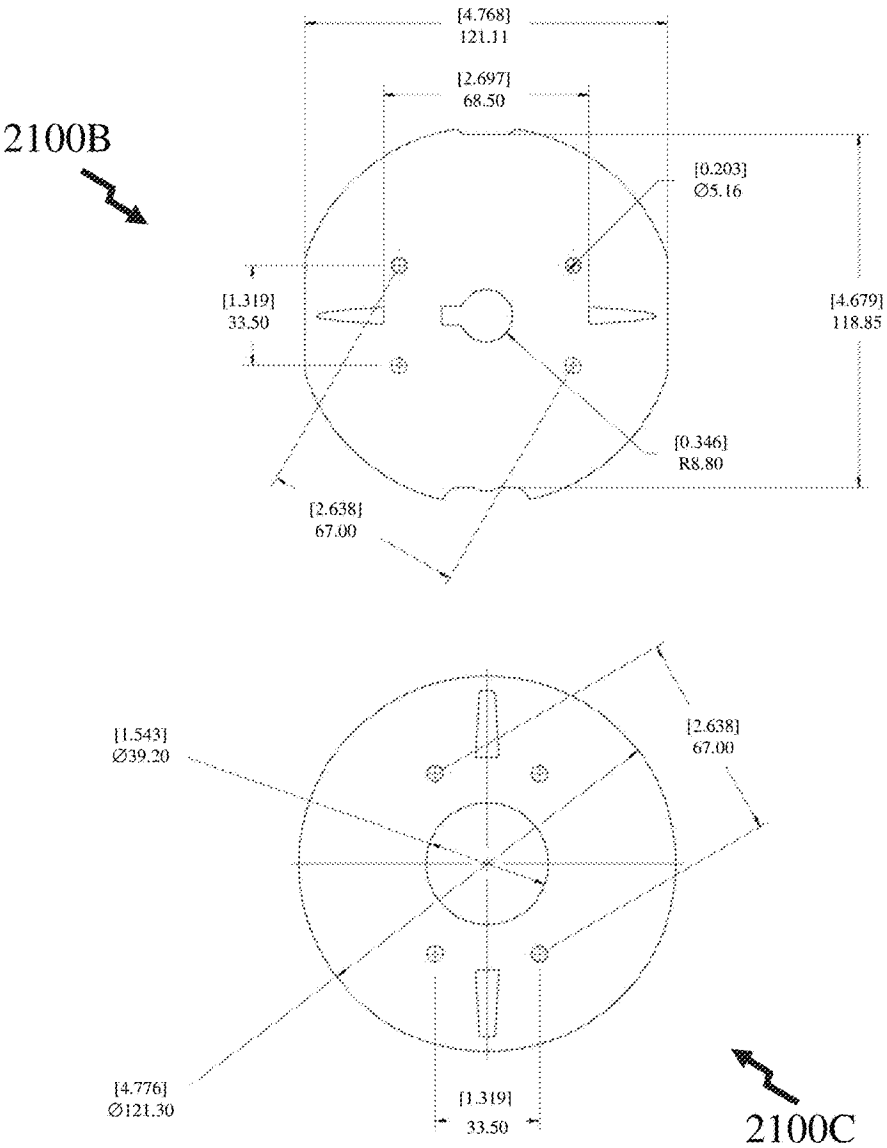
FIG. 21 depicts CAD drawings and rendered model views of a film employed improved visual acquisition of a CAAD VIIP providing an exemplary CAAD according to an embodiment of the invention.
Figure 21:
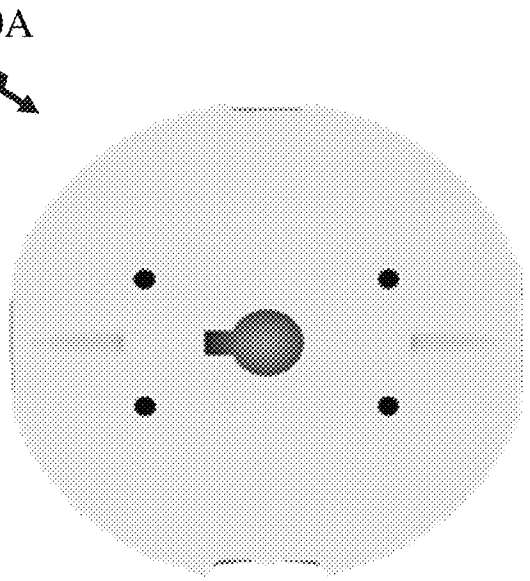

FIG. 21 depicts CAD drawings and rendered model views of a film employed improved visual acquisition of a CAAD VIIP providing an exemplary CAAD according to an embodiment of the invention. These being first image 2100A which is a rendered front perspective view of the film disposed in the bottom of the outer casing. Second and third images 2100B and 2100C respectively depict engineering drawings of the films disposed in the bottom of the outer casing and under the cover attached to the outer housing respectively.

Figure 22:
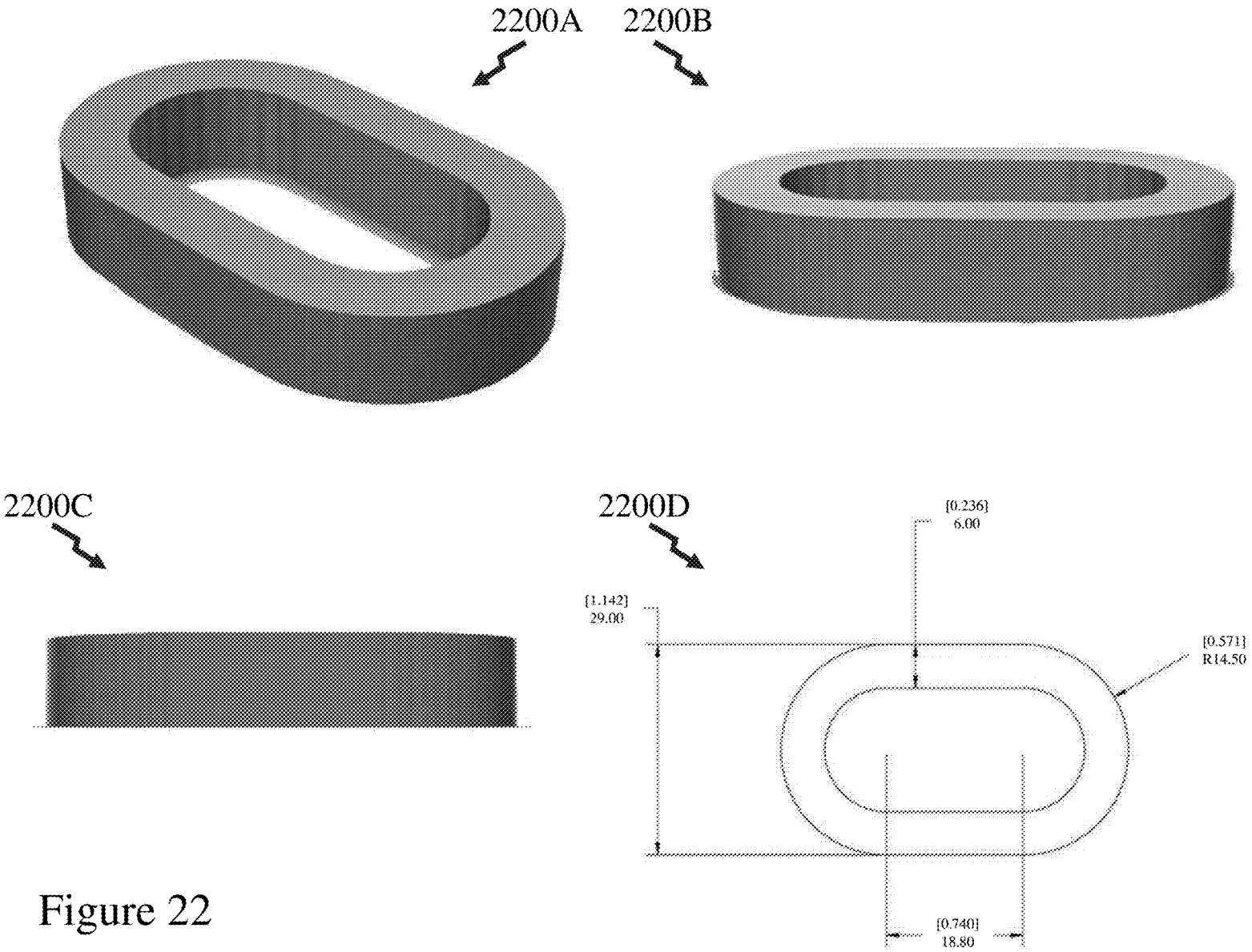
FIG. 22 depicts CAD drawings and rendered model views of a foam sound conduit and protective element for a CAAD VIIP providing an exemplary CAAD according to an embodiment of the invention.

FIG. 22 depicts CAD drawings and rendered model views of a foam sound conduit and protective element for a CAAD VIIP providing an exemplary CAAD according to an embodiment of the invention. First to third images 2200A to 2200C being rendered upper side perspective, upper front perspective and side views of the sound conduit. Fourth image 2200D being an engineering drawing of the sound conduit. A pair of the sound conduits are employed one on each side disposed between each acoustic generator and the respective opening 1320 in the outer casing. By forming them from the appropriate material these act as a sound guide from the acoustic generator to the opening as well as absorbing deformations in the outer casing from impacts etc. to avoid damage to the central electronic module.

A membrane may be applied over the end of the acoustic generator and/or at the openings 1320 in the outer casing to prevent water, snow, dust, particulate ingress. However, the membrane should provide low acoustic attenuation. Accordingly, the inventors have employed Gore-Tex™ GAW111 Series Portable Electronic Vents within exemplary embodiments of the invention.

Overview Description of Contextually Aware Alarm Device (CAAD) Visually Impaired Ice Puck (VIIP)—Design D Subsequent to the establishment of the design of the CAAD according to an embodiment of the invention as depicted by the elements, sub-assemblies and assemblies in FIGS. 13 to 22 further designs were established by the inventors which are depicted and described below with respect to FIGS. 23 to 34 as representing another embodiment of the invention. This embodiment of the invention was implemented to improve the robustness of the CAAD whilst incorporating elements which are sensitive to impact such as the acoustic generators which within embodiments of the invention are implemented using acoustic transducers exploiting a piezoelectric diaphragm. This design according to an embodiments of the invention further integrated improvements with respect to the electronic module as well as the integration of a second PCB for controlling the piezoelectric based acoustic generators. Additionally, this embodiments of the invention provides for improved solidity of the CAAD whilst addressing the constraints of weight, resistance to cold (as the CAAD is a hockey puck for visually impaired ice hockey players), resistance to physical impact and to provide improvement control over the deformation of the ribs within the design to provide mechanical rigidity with reduced weight.

Figure 23:
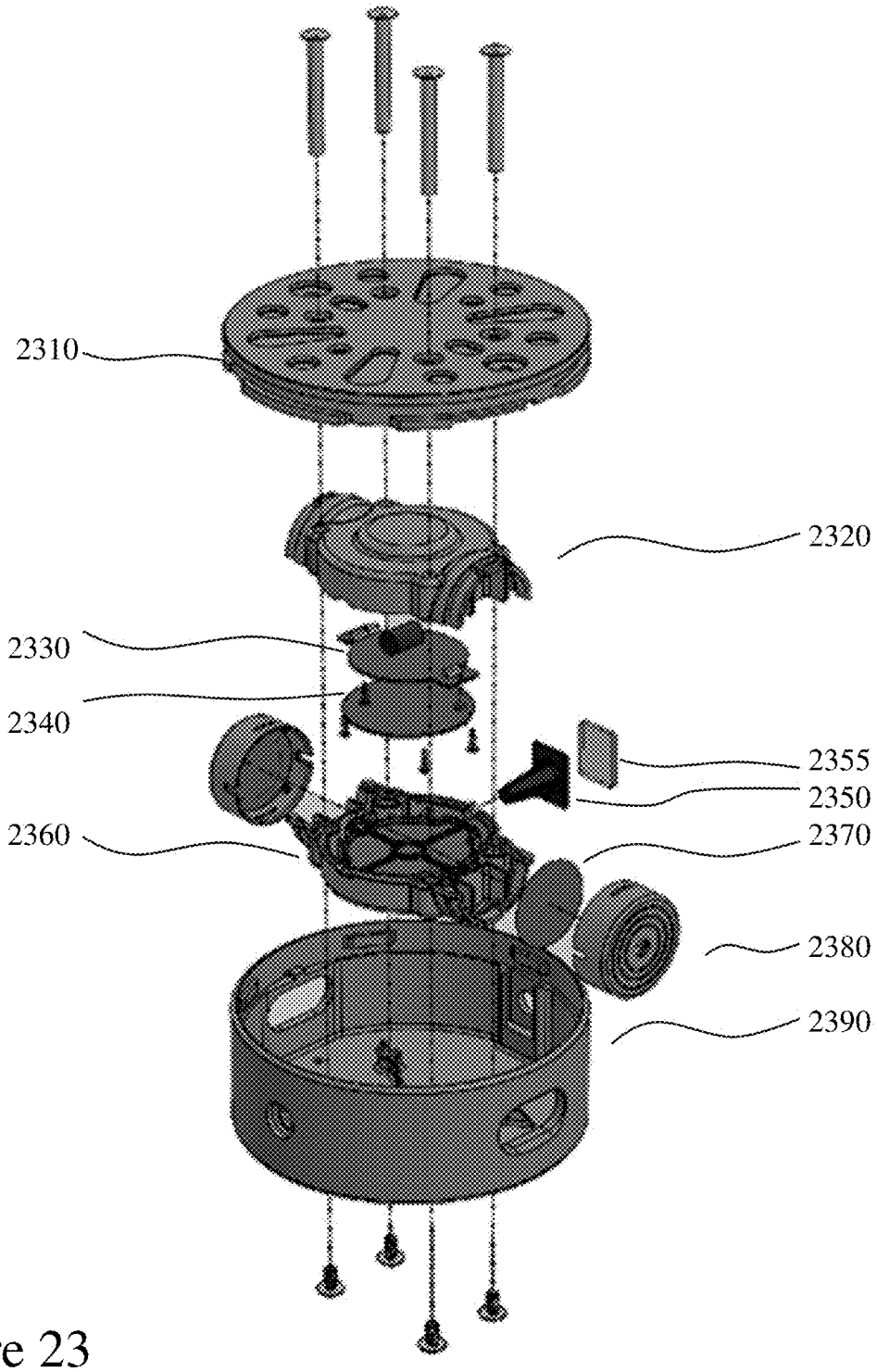
FIG. 23 depicts an exploded assembly view of a CAAD according to an embodiment of the invention.

Referring to FIG. 23 there is depicted an exploded assembly view of the CAAD according to the embodiment of the invention wherein the following elements are identified (the battery being omitted for clarity):

Case Cover 2310 which mounts to the Case Body and encloses the electronics, transducers etc.;

Upper Housing 2320 of Electronic Module;

Secondary PCB 2330 for Acoustic Transducers;

PCB 2340 for Control/Configuration/Communications/Processing/Memory etc. of the CAAD;

Light Pipe 2350 such as described and depicted with respect to FIG. 20;

Light Tube Seal 2355 which covers the external opening of the Light Pipe 2350 and may be formed from a material such as an optically transparent over all or part of the visible wavelength range of a human eye as defined by the light source(s) (e.g. LED(s) within the Electronic Module;

Lower Housing 2360 of the Electronic Module;

Acoustic Transducer Module 2370, e.g. piezoelectric diaphragm based acoustic transducer;

Acoustic Resonator Case 2380; and

Case Body 2390 to which the Case Cover 2310 attaches and encloses the electronics, transducers etc.

The CAAD as described with respect to FIGS. 23 to 34 also includes a power socket allowing the CAAD to be recharged as a sealed unit, without having to open it. Further, as will be evident from the discussion below the Light Pipe 2350 has been modified relative to the design in FIG. 20 by reducing its length in order to avoid damage/breakage when wall of the Case 2390 deforms under impact/pressure etc.

The external geometry of the Case 2390 with Case Cover 2310 is that of a cylindrical segment or truncated cylinder where the two planes defining the truncated cylinder are parallel to one another and perpendicular to a longitudinal axis of the cylinder.

The outer case comprises the Case Body 2390 and Case Cover 2310, as depicted in FIG. 23, which may be formed from UMHW polyethylene for example wherein FIGS. 24 and 25 depict the design of the Case Body 2390 in more detail. Relative to the outer casing for a CAAD VIIP depicted in FIG. 13 the Case Body 2390 within Variant D of the CAAD VIIP eliminates the requirement for spacers such that the inner electronic case comprising Upper Housing 2320 and Lower Housing 2360 thereby allowing the electronics case to be mounted in the center of the outer case of the CAAD VIP thereby preserving the balance of the CAAD VIIP such that it does not deviate on a long trajectory and does not skip on the ice. A spacer has been added on the inner electronic case to facilitate the assembly and closing of the Case Cover 2310.

Referring to FIG. 24 there are depicted perspective and cross-sectional views 2400A and 2400B of the exemplary CAAD VIIP without the Case Cover 2310 attached. FIG. 25 depicts a perspective view of the Case Body 2390 of the CAAD VIIP Design D wherein compared to the case body depicted in FIGS. 13 and 14 it is evident that the Key Feature 1410 is now omitted. However, the other elements of the Case Body 2390 and dimensions etc. are as per FIGS. 13 and 14. The Case Cover 2310 is the same as the case cover depicted in FIG. 15 are its key elements and dimensions.

The shape and pattern of the openings (orifices) within the Case Body 2390 and Case Cover 2310 have been designed based upon CAD modelling to provide both structural solidity for the CAAD VIIP but also distribution of the energy during impacts whilst removing material from each of the Case Body 2390 and Case Cover 2310 in order to reduce the CAAD VIIP's weight and improving its used within the ice hockey game. However, in contrast to Design C the CAAD VIIP Design D has an additional thin plastic layer (e.g. 0.8 mm or 1/32 inch) is employed across the inner surfaces of the Case Body 2390 and Case Cover 2310 as necessary to block the openings machined within the Case Body 2390 and Case Cover 2310 to aid in sealing the case. Through CAD modelling the additional material weight was removed elsewhere within the Case Body 2390 and Case Cover 2310 without impacting overall performance characteristics.

The thin film may be a plastic with lower density than the UMHW employed for the Case Body 2390 and Case Cover 2310 or within other embodiments of the invention the openings may be re-designed to be blocked with a thin residual layer blocking them. A thin plastic film may allow thinner layers to block the Case Body 2390 and Case Cover 2310 whilst allowing low cost molding and/or machining of the Case Body 2390 and Case Cover 2310 by removing the tolerance to thickness in these orifices. Within other embodiments a thinner film (e.g. 0.4 mm or 1/64 inch) may be employed for example as may other thickness and/or materials.

Within the CAAD VIIP Design D the design and construction of the electronic module housing has been modified to incorporate a new electronics PCB as well as the pair of piezoelectric diaphragms serving as acoustic transducers and their associated acoustic resonators which replace the acoustic generators with their associated horns 1730 employed in conjunction with the electronic module housing 1740 of the CAAD VIIP Version C as depicted in third image 1700C in FIG. 17. This design improved the mechanical performance of the electronics module of Design D relative to Design C. However, the overall external appearance of the new electronics module with piezoelectric diaphragms and acoustic resonators still visually appears similar to electronic module housing 1740 in FIG. 17.

Referring to FIG. 26 there is depicted a perspective view of the Electronics Module 2610 with the pair of Acoustic Resonators 2620 attached, where each piezoelectric diaphragm serving as an acoustic transducer is disposed within an Acoustic Resonator 2620 between it and the Electronic Module 2610. In FIG. 27 the Electronics Module 2610 is shown depicted deployed with the Case Body 2390 and Case 2310 (which are depicted semi-transparently to allow viewing the Electronics Module 2610). Disposed between the Case Body 2390 and the lower surface of the Electronics Module 2610 are Lower Spacers 2710. Upper Spaces 2720 are depicted disposed between the Case Cover 2310 and the upper surface of the Electronics Module 2610. Within embodiments of the invention the Lower Spacers 2710 and Upper Spaces 2720 may be the same design or of different designs. Equally each Lower Spacer 2710 may be the same as or different to other Lower Spacers 2710 as may each Upper Spacer 2710 may be the same as or different to other Upper Spacers 2720.

The shape of the case of the Electronics Module 2610 and the Acoustic Resonators 2620 is designed to accommodate and protect the battery and two electronic circuits (PCBs), the piezoelectric diaphragms (acoustic transducers), the light pipe, and the passage of the necessary wires (which are omitted for clarity) between the Electronics Module 2610 and charging port and the Electronics Module 2610 and the acoustic transducers. The Electronics Module 2610 and the Acoustic Resonators 2620 comprise four (4) parts, for example 4 UHMW parts, that fit together to form a solid and waterproof assembly as depicted in FIG. 26. An upper part of the Electronics Module 2610 serves as a support for the battery and fits into the lower part of the Electronics Module 2610 which serves to house and support the PCBs. To these two parts are added the pair of Acoustic Resonators 2620 which integrate the piezoelectric diaphragms between them and the Electronics Module 2610.

Within an embodiment the invention the Acoustic Resonators 2620 may be screwed onto each end of the Electronics Module 2610 therein closing the entire case of the Electronics Module 2610 and sealing in the electronics. Within other embodiments of the invention the Acoustic Resonators 2620 may snap fit onto the Electronic Module 2610 or they may be glued, fixed with fastening etc. Similarly, the upper and lower case elements of the Electronics Module 2610 may snap fit to one another, be glued, sealed via a gasket or fixed with fastenings etc. For example, the upper and lower case elements of the Electronics Module 2610 may be attached to one another through 4 Chicago screws. The ends of the screw passages end with positioning studs (Lower Spacers 2710 and Upper Spacers 2720) which enabled the Electronics Module 2610 to be held in the center of the CAAD VIIP.

Referring to FIG. 28 there is depicted a partially exploded assembly view of the Electronics Module 2610 together with the Acoustic Resonators 2630 and Piezoelectric Diaphragms 2810. The Electronics Module 2610 comprising Upper Case Element 2820 and Lower Case Element 2830. The pair of PCBs (of which only 1 PCB 2840) are assembled into the Lower Case Element 2830 and wires to the charging port exit through First Wire Port 2850A whilst those to the Piezoelectric Diaphragm 2810 exit through Second Wire Ports 2850B at either end. Also depicted in Light Opening 2860 which aligns with the Light Pipe to provide a visible indication to a user. Depicted on the upper outer surface of the Upper case Element 2820 are Ribs 2825 which are described below.

Figure 29:
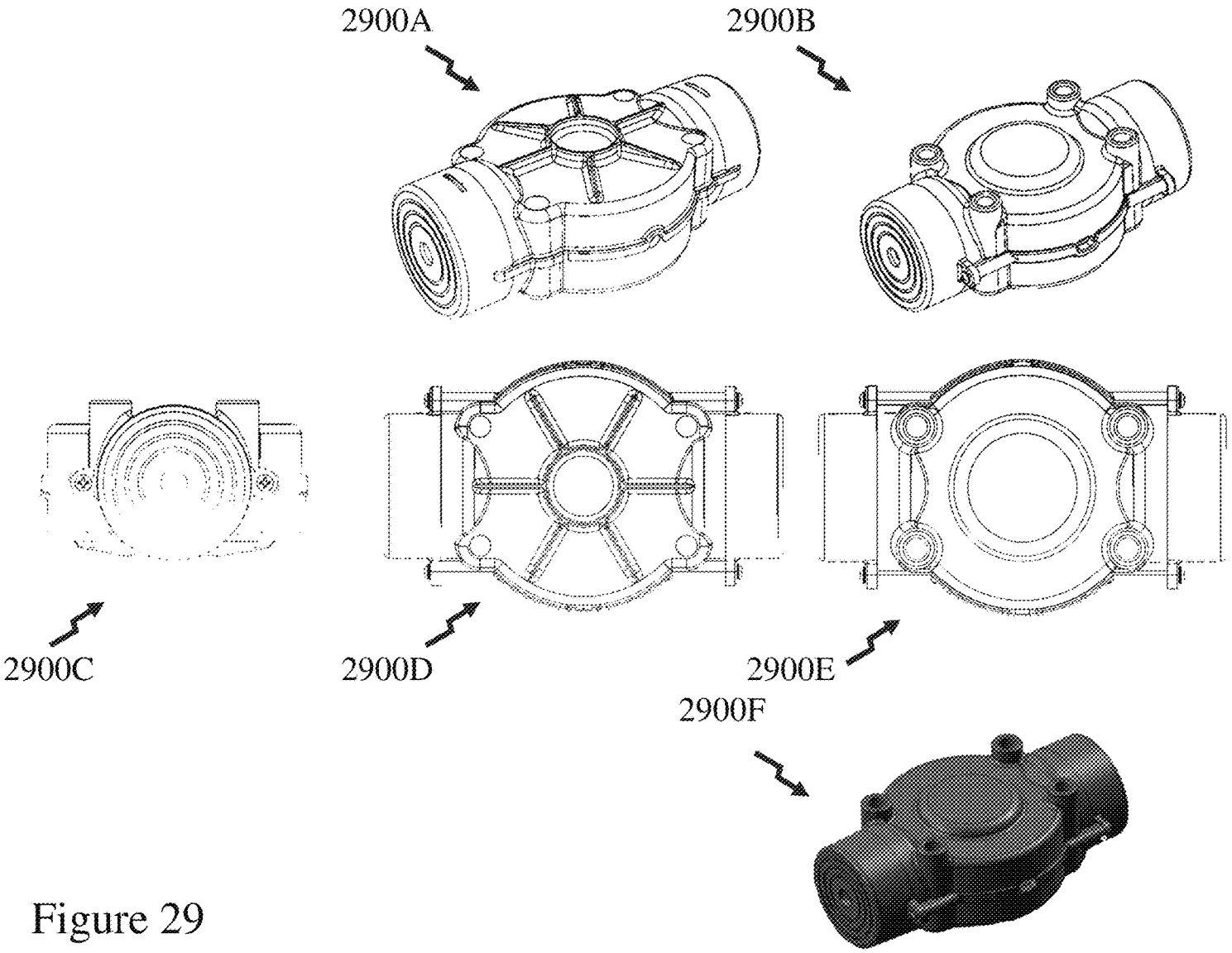
FIG. 29 depicts the electronics module of FIG. 26 together with the acoustic resonator.

As shown in FIG. 29, the exterior shape has been designed to accommodate the space required by the battery and the PCBs, but also to meet the impact strength requirements. Thus, a set of ribs has been strategically positioned in radii outside the upper part to reinforce the module because the battery having a high mass, exerts the highest force on the case during a slap shot. This shape prevents the module from shearing during this type of impact. The shape of the lower part makes it possible to release the electronic components from the PCB. As depicted in FIG. 29 there are first to sixth Images 2900A to 2900F respectively, these being:

- First Image 2900A being an upper perspective view of the Electronics Module 2610 with Acoustic Resonators 2620 attached;
- Second Image 2900B being a lower perspective view of the Electronics Module 2610 and Acoustic Resonators 2620 attached;
- Third Image 2900C being an end view of the Electronics Module 2610 with Acoustic resonators 2620 attached;
- Fourth Image 2900D being a plan view of the Electronics Module 2610 with Acoustic resonators 2620 attached;
- Fifth Image 2900E being bottom view of the Electronics Module 2610 with Acoustic resonators 2620 attached; and
- Sixth Image 2900F being another lower view of the Electronics Module 2610 with Acoustic resonators 2620 attached.

The ends of screw passages in the lower case, as depicted in FIG. 30, finish in positioning Studs 3010 which allow the module to be held in the center of the CAAD VIIP.

Figure 31:
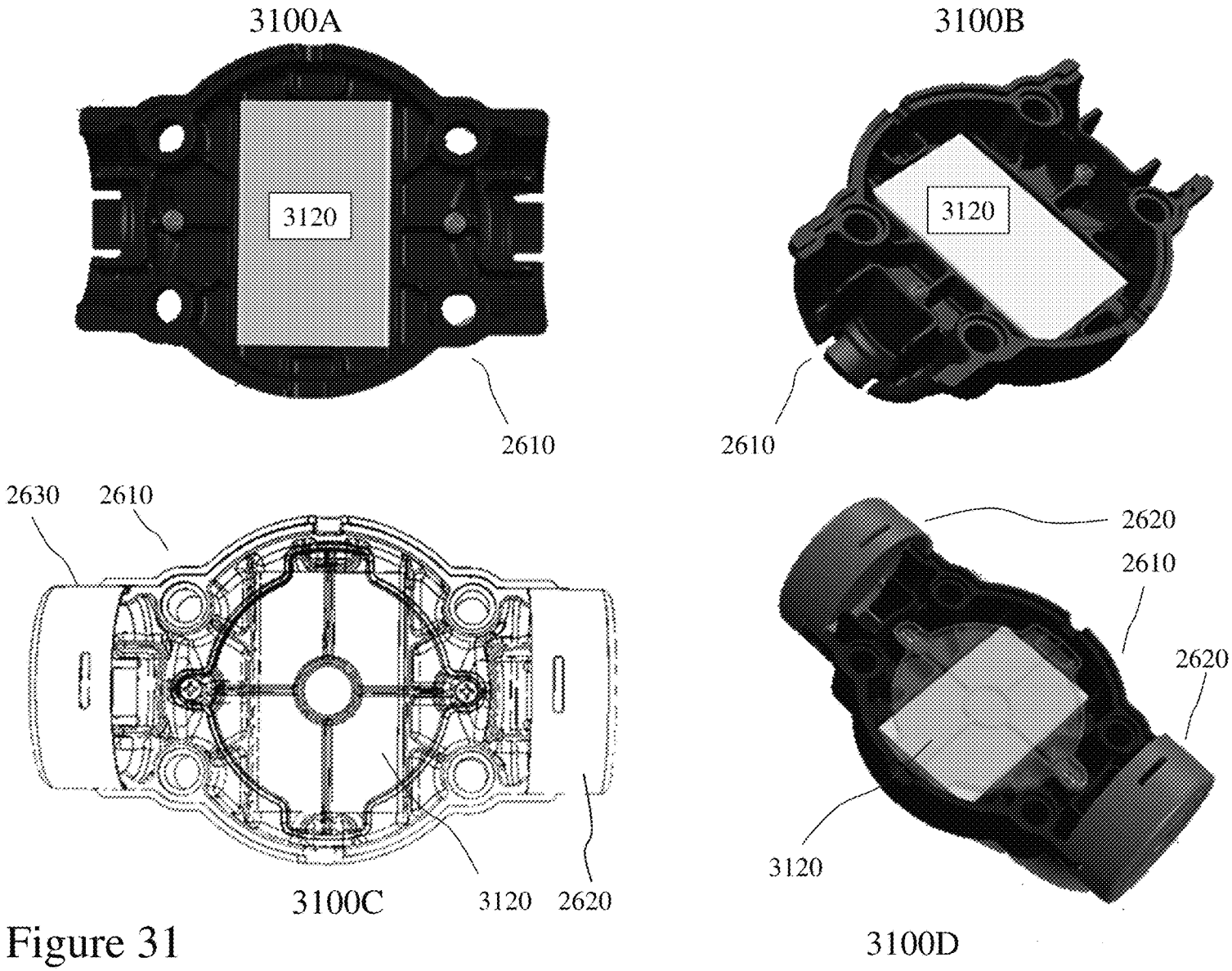
FIG. 31 depicts an upper case portion of the electronics module of FIG. 26.

The design of the Upper Case Element 2820 was established after multiple CAD iterations on different concepts and impact testing in order to determine the Ribs 2825 (see FIG. 28). The Upper Case Element 2820 is designed to hold the Battery 2910 as depicted in FIG. 29 for the CAAD. However, the mass of the Battery 2910 can easily result in failure of the Upper Case Element 2820 during an impact such as a slap shot or hitting the hard boards at the edge of the ice surface. The Ribs 2925 allow for the Upper Case Element 2820 to maintain the Battery 2910 in place and to dissipate the forces towards the perimeter of the Upper Case Element 2820. A circular cover secures it and prevents it from bending under impact, thus protecting it against short circuits or the risk of fire etc. Referring to FIG. 31 there are depicted first to fourth Images 3100A to 3100D of the Upper Case Element 2620. These being:

- First Image 3100A being a bottom view of the Upper Case Element 2820 with Battery 3110 in place and Protective Cover 3120 removed;
- Second Image 3100B being a lower perspective view of the Upper Case Element 2820 with Battery 3110 in place and Protective Cover 3120 removed;
- Third Image 3100C being a bottom view of the Upper Case Element 2820 with the Protective Cover 3120 in place and Acoustic Resonators 2620 attached; and
- Fourth Image 3100D being a lower perspective view of the Upper Case Element 2820 with the Protective Cover 3120 in place and Acoustic Resonators 2620 attached.

The design of the Lower Case Element 2830 similarly employs a circular geometry as with the Upper Case Element 2820 where these are deployed within the CAAD VIIP which is circular in external geometry. However, it would be evident that the CAAD, the Lower Case Element 2830 and the Upper Case Element 2820 may have different external geometries and that the Lower Case Element 2830 and the Upper Case Element 2820 geometries may be different to the external geometry of the CAAD and in some embodiments of the invention different to each other.

Accordingly, as with the Upper Case Element 2820 the design of the Lower Case Element 2830 is a tradeoff between mechanical integrity under impact, rigidity to protect the internal electronics, and low weight. Accordingly, the design employs a combination of internal reinforcements and material (e.g. a specific UHMW material) to provide the structural solidity required to absorb the impacts of the game for the CAAD VIIP with low weight. Whilst the Upper Case Element 2820 is designed to house and protect the battery the Lower Case Element 2830 is designed to house, support and protect a pair of PCBs although within other embodiments of the invention it may be a single PCB, three PCBs etc. Optionally, within other embodiments of the invention the Lower Case Element 2830 may also support and house the battery. It would also be evident that the terms Lower Case Element 2830 and Upper Case Element 2820 are essentially arbitrary as the overall electronics module may be employed upside down in a static environment or within a dynamically orientated CAAD such as the CAAD VIIP these terms are applicable solely from a consideration of design/structure as assembled rather than within use.

Figure 32:
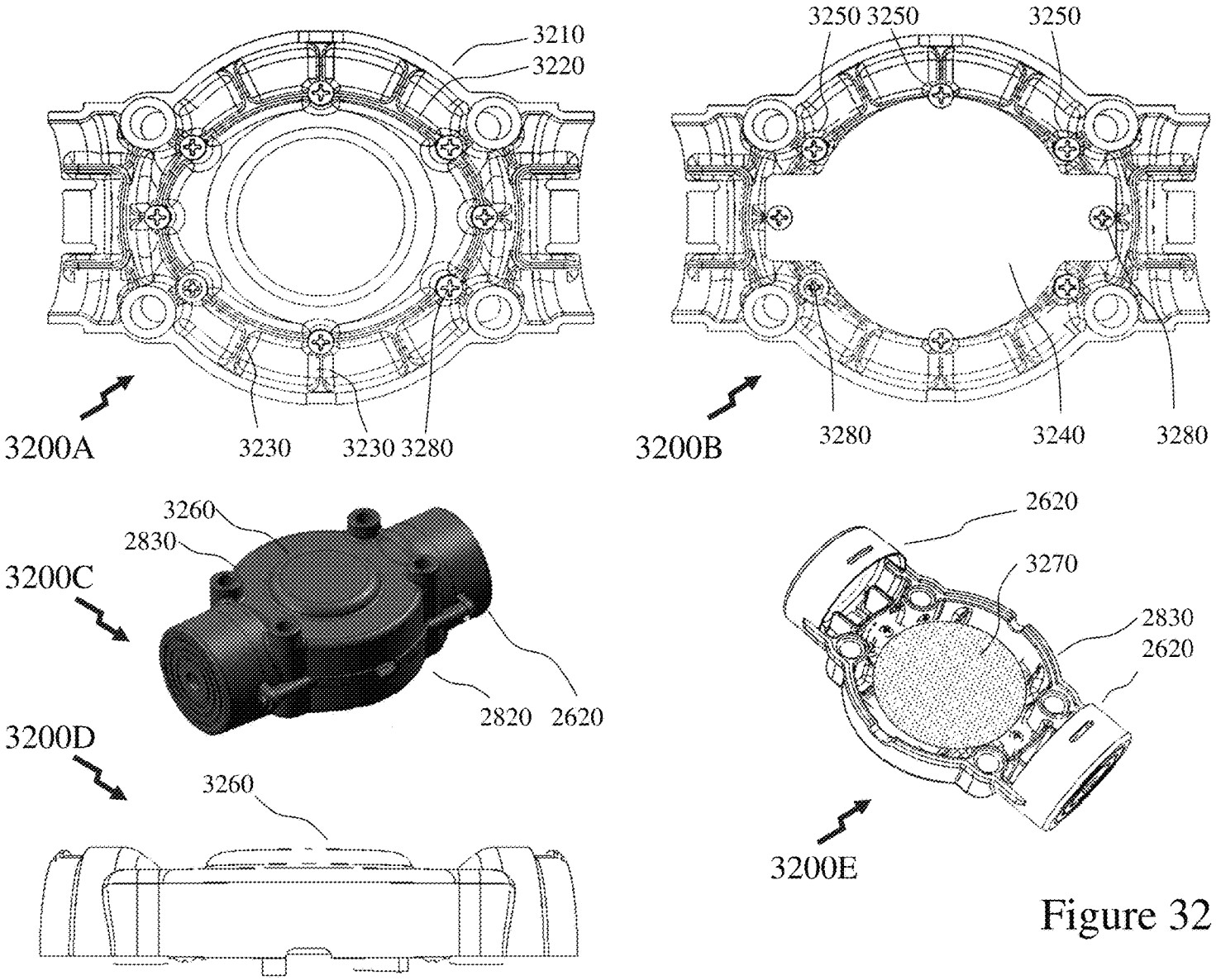
FIG. 32 depicts a lower case portion of the electronics module of FIG. 26.

Referring to FIG. 32 there are depicted first to fifth Images 3200A to 3200E respectively of the Lower Case Element 2830 discretely, with assembled electronics or assembled with the Upper Case Element 2820. These being:

- First Image 3200A which is a top view of the Lower Case Element 2830 without assembled electronics showing an Outer Shell 3210, Inner Shell 3220 and a series of Ribs 3230 between the Inner Shell 3220 and Outer Shell 3210 to provide rigidity with low weight (Screws 3280 are depicted inserted into screw studs);
- Second Image 3200B which is a top view of the Lower Case Element 2830 with the Acoustic Transducer PCB 3240 assembled and retained by four Screws 3280, where the Motherboard PCB 3270 is assembled between the Lower Case Element 2830 and the Acoustic Transducer PCB 3240 where it is similar retained by four Screws 3280;

Third Image 3200C which is a bottom perspective view of the assembled electronics module with Lower Case Element 2830, Upper Case Element 2820 and Acoustic Resonators 2620 with a Dome Portion 3260 of the Lower Case Element 2830 in the central region;

Fourth Image 3200D which is a side perspective view of the Lower Case Element 2830 identifying the Dome Region 3260; and Fifth Image 3200E which is a partially assembled perspective view of the Lower Case Element 2830 and Acoustic Resonators 3260 with the Upper Case Element 2820 and Acoustic Transducer PCB 3240 such that the Motherboard PCB 3270 is visible.

It would be evident that the Motherboard PCB 3270 and Acoustic Transducer PCB 3240 may be reversed in position and hence design within other embodiments of the invention.

The Dome Portion 3260 was designed within the Lower Case Element 2830 to allow coiled electronic elements of the Motherboard PCB 3270 to be raised away from the Motherboard 3270 allowing for improved heat dissipation. Further, the Dome Portion 3260 reinforces the central planar face of the Lower Case Element 2830. The positioning of the interior Ribs 3230 and the screw studs (within which Screws 3280 are screwed and hence only partially visible in first and second Images 3200A and 3200B respectively allow for nesting the pair of the PCBs one above each other. The inner and outer double walls, Inner Shell 3220 and Outer Shell 3210 respectively, are linked by 12 transverse Ribs 3230 which provide increased strength to withstand impacts. It would be evident to one of skill in the art that other designs may be configured exploiting these design methodologies.

Within the preceding description of the CAAD VIIP Design D has outlined that the acoustic transducers are piezoelectric diaphragms, e.g. Piezoelectric Diaphragm 2810 in FIG. 28, where each is employed in conjunction with an acoustic resonator, e.g. Acoustic Resonator 2620 in FIG. 28. The acoustic resonator increasing the audible output of the piezoelectric diaphragms to a level commensurate with its use as a VIIP within an ice hockey game.

Figure 33:
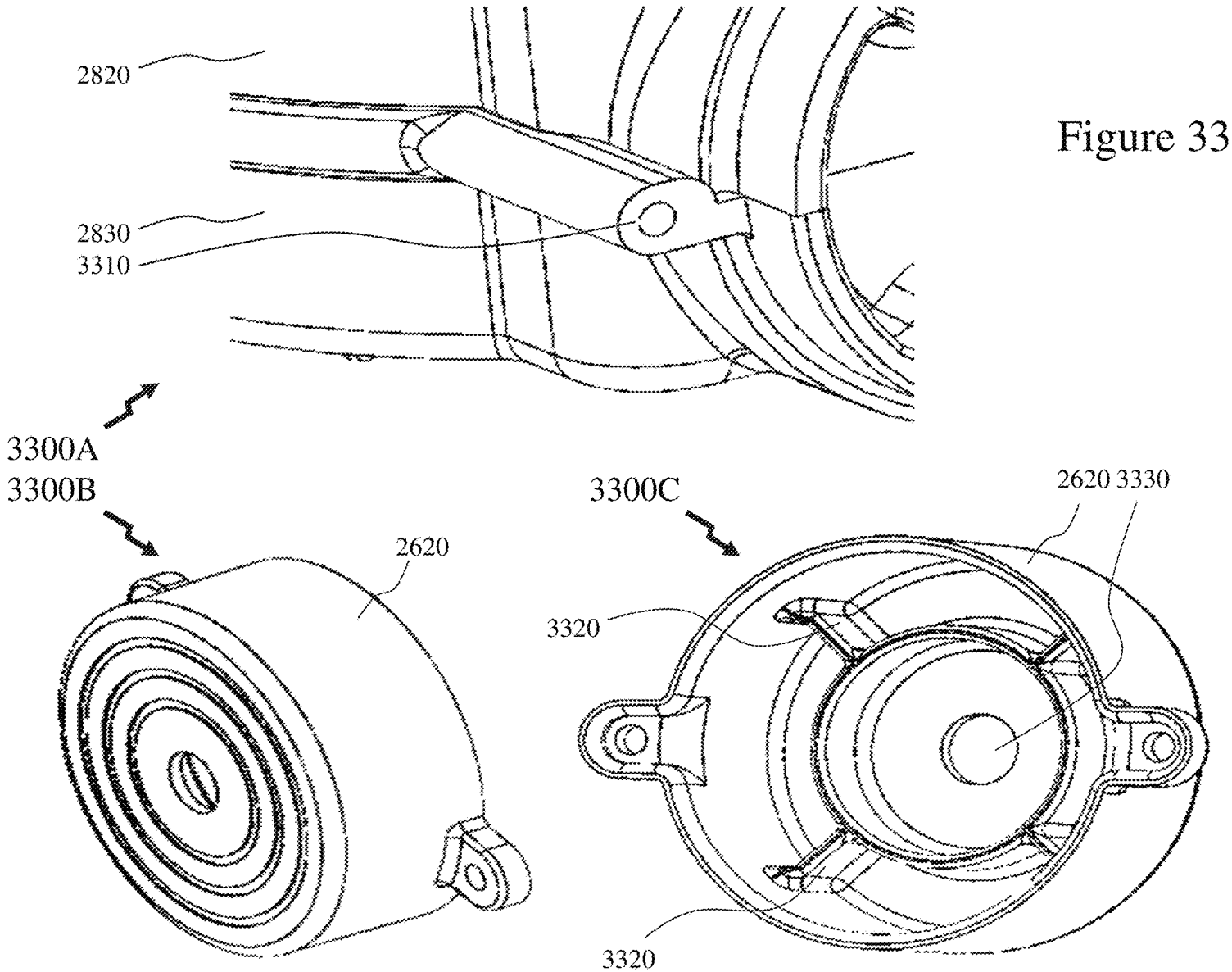
FIG. 33 depicts an acoustic resonator as attached to an electronics module of FIG. 26 together with its mounting means to the electronics module.

Each Acoustic Resonator 2620 houses a piezoelectric diaphragm, e.g. Piezoelectric Diaphragm 2610 in FIG. 28, which provide audible signals as part of the functionality of the CAAD. Each Acoustic Resonator 2620 is assembled with two screws to a pair of Screw Stud 3310 located on the Upper Case Element 2820. Referring to FIG. 33 there are depicted first to third Images 3300A to 3300C respectively comprising a perspective view of a mounting of an acoustic resonator according to an embodiment of the invention to an electronics module together with exterior and interior perspective views of the acoustic resonator.

Figure 34:
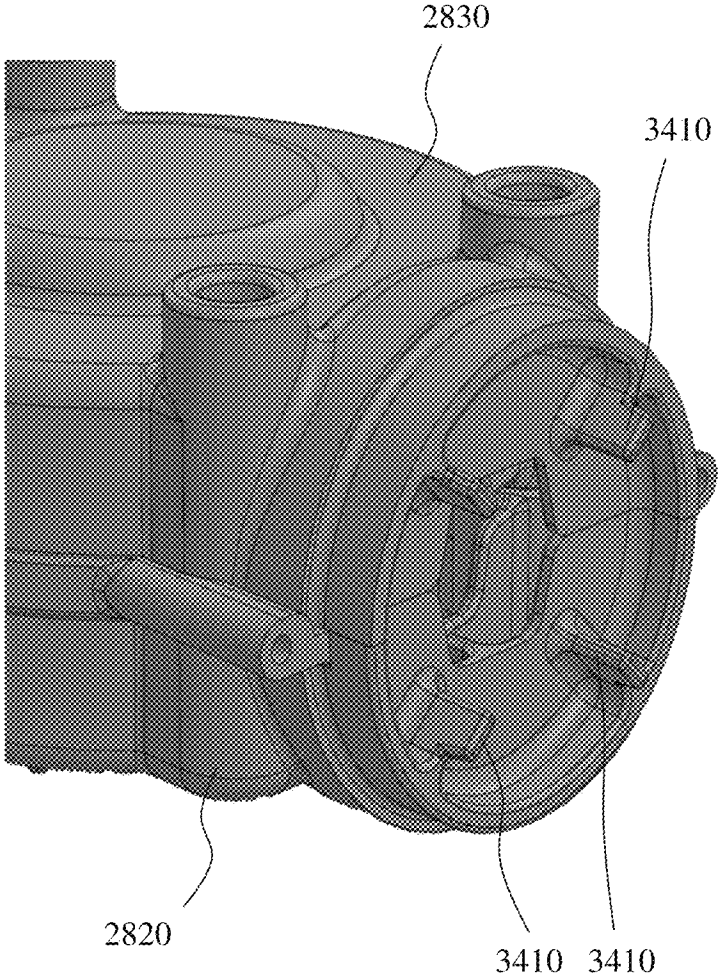
FIG. 34 depicts the supporting structures for the piezoelectric acoustic transducer and attachment means of the acoustic resonator on the upper and lower case portions of the electronics module.

Within an embodiment of the invention each piezoelectric diaphragm module is 35 mm in diameter and in place by first Diaphragm Ribs 3320 within the Acoustic Resonator 2620, as depicted in third Image 3300C in FIG. 33 and second Diaphragm Ribs 3410, as depicted in FIG. 34, which are formed on the ends of the Upper Case Element 2820 and Lower Case Element 2830 respectively where the piezoelectric diaphragm modules and Acoustic Resonators 2620 mount. The central Opening 3330 is covered with a membrane, e.g. a GORE® Portable Electronic Vent) which allows the acoustic signals to be coupled to the external environment but block dust, moisture, splashed liquids etc. This may be glued or otherwise attached within the interior of the Acoustic Resonator 2620 covering the Opening 3330. A GORE® Portable Electronic Vent comprises a permeable membrane with an outer ring of adhesive.

Optionally, within embodiments of the invention the VIIP may generate a variable audible and/or optical alarm in dependence upon:

Speed;

Height relative to the ice surface;

Region of the ice arena; and

Play is active or paused, halted, etc.

Accordingly, the VIIP as an example of a CAAD device may generate acoustic signals which are:

a first fixed frequency signal when stationary on the ice or within a predetermined height of the ice (allowing players to locate it);

a second fixed frequency signal when stationary above the predetermined height from the ice surface (e.g. within the referee or linesman hand or goalie glove etc.)

a third range of frequencies when the VIIP is moving on the ice or within a predetermined height of the ice, wherein the frequency within the third range of frequencies is dependent upon the speed of the VIIP;

a fourth range of frequencies when the VIIP is moving above the predetermined height from the ice surface, wherein the frequency within the third range of frequencies is dependent upon the speed of the VIIP;

a first additional tone to indicate the VIIP is within the blue zone at one end of the area;

a second additional tone to indicate the VIIP is within the other blue zone at the other end of the arena;

a third additional tone to indicate the VIIP is within the central zone of the arena;

pulse modulate the emitted signal to indicate that play is suspended so that a puck in motion above the ice can still be heard/located even if the linesman or referee has suspended play.

Within an alternate embodiment of the invention the CAAD device may issue a specific alarm or alarms as generated by a user associated with the CAAD. For example, considering the VIIP then a referee may trigger an alarm independent of the current status of the VIIP. For example, the VIIP may issue an alarm indicating a goal, play being suspended, an injured player on the ice etc. through a wireless connection from a PED associated with the referee or linesman in addition to the automatically generated alarms from the CAAD as determined by the microcontroller in dependence upon the inputs from the sensor(s) coupled to the microcontroller or microprocessor.

Within embodiments of the invention the microcontroller of a CAAD may receive data from one or more internal sensors as well as from one or more external sensors upon which an alarm may be triggered and/or an alarm varied to provide additional information to users within its vicinity or to those receiving the alarm remotely. Such sensors may include, but not be limited to, environmental sensors, medical sensors, biological sensors, chemical sensors, ambient environment sensors, position sensors, motion sensors, thermal sensors, location sensors, infrared sensors, visible sensors, RFID sensors, and medical testing and diagnosis devices.

Within embodiments of the invention the microcontroller of a CAAD may receive data relating to the location of the CAAD absolutely (e.g. via a global positioning system), locally (e.g. via location referencing infrastructure elements such as wireless cell towers), relatively (e.g. via location referencing relative to local beacons). Accordingly, the alarm(s) may be varied automatically according to this location information. For example, a CAAD associated with a device in Mexico may issue alarms in Spanish automatically based upon determining its location but when moved to Florida now issues the alarms in English automatically or English and Spanish. Within other embodiments of the invention the CAAD may vary the alarm according to the location information in another manner such that a reversing vehicle within an industrial park generates a different alarm when it is in a residential neighborhood and yet another alarm when it is within the vicinity of a school for example. Further, the alarm may vary according to the speed of the vehicle's reversing so that additional contextual information is provided to those hearing the alarm whilst the alarm is generated in dependence upon the context. So merely putting the vehicle into reverse may not trigger an alarm but once the vehicle is moving the alarm is generated and the alarm varies according to vehicle speed to further aid those nearby to understand that not only is it reversing but faster than perhaps usual.

Within embodiments of the invention described above the CAAD has been described and depicted with respect to audible alarms. However, it would be evident that within other embodiments of the invention the CAAD may exploit visual alarms alone or in combination with audible alarms.

However, it would be evident that within other embodiments of the invention the CAAD may exploit directly or indirectly gustatory alarms alone or in combination with one or more of audible alarms and visual alarms.

However, it would be evident that within other embodiments of the invention the CAAD may exploit directly or indirectly olfactory alarms alone or in combination with one or more of gustatory alarms, audible alarms and visual alarms.

However, it would be evident that within other embodiments of the invention the CAAD may exploit directly or indirectly somatic alarms alone or in combination with one or more of olfactory alarms, gustatory alarms, audible alarms and visual alarms.

However, it would be evident that within other embodiments of the invention the CAAD may exploit directly or indirectly tactile alarms alone or in combination with one or more of somatic alarms, olfactory alarms, gustatory alarms, audible alarms and visual alarms.

However, it would be evident that within other embodiments of the invention the CAAD may exploit directly or indirectly through another device one or more changes (perceived as alarms by the user) with respect to the user's vestibular sense, thermoception, or nociception for example.

Within embodiments of the invention described above the CAAD has been described and depicted with respect to alarms which are generated by the CAAD directly itself. However, it would be evident that within other embodiments of the invention that the alarms generated may be communicated to another PED and/or FED which presents or displays the alarms discretely or in combination with the CAAD. These communications may be by one or more interfaces including, but not limited to, wired interfaces, wireless interfaces, optical interfaces, microwave interfaces, and acoustic interfaces.

Within embodiments of the invention described above the CAAD employs sensors which are contained within the CAAD. However, it would be evident that within other embodiments of the invention the CAAD may exploit additional sensors which are external to the CAAD but provide data to the CAAD directly or indirectly. Such data may be communicated by one of interfaces including, but not limited to, wired interfaces, wireless interfaces, optical interfaces, microwave interfaces, and acoustic interfaces. Optionally, the data from the external sensors may be stored remotely and pushed to the CAAD or it may be pulled by the CAAD. Optionally, the data from the external sensors may be stored by each external sensor and periodically pushed to the CAAD or periodically pulled by the CAAD.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above and/or a combination thereof.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be rearranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages and/or any combination thereof. When implemented in software, firmware, middleware, scripting language and/or microcode, the program code or code segments to perform the necessary tasks may be stored in a machine readable medium, such as a storage medium. A code segment or machine-executable instruction may represent a procedure, a function, a subprogram, a program, a routine, a subroutine, a module, a software package, a script, a class, or any combination of instructions, data structures and/or program statements. A code segment may be coupled to another code segment or a hardware circuit by passing and/or receiving information, data, arguments, parameters and/or memory content. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor and may vary in implementation where the memory is employed in storing software codes for subsequent execution to that when the memory is employed in executing the software codes. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, wireless channels and/or various other mediums capable of storing, containing or carrying instruction(s) and/or data.

The methodologies described herein are, in one or more embodiments, performable by a machine which includes one or more processors that accept code segments containing instructions. For any of the methods described herein, when the instructions are executed by the machine, the machine performs the method. Any machine capable of executing a set of instructions (sequential or otherwise) that specify actions to be taken by that machine are included. Thus, a typical machine may be exemplified by a typical processing system that includes one or more processors. Each processor may include one or more of a CPU, a graphics-processing unit, and a programmable DSP unit. The processing system further may include a memory subsystem including main RAM and/or a static RAM, and/or ROM. A bus subsystem may be included for communicating between the components. If the processing system requires a display, such a display may be included, e.g., a liquid crystal display (LCD). If manual data entry is required, the processing system also includes an input device such as one or more of an alphanumeric input unit such as a keyboard, a pointing control device such as a mouse, and so forth.

The memory includes machine-readable code segments (e.g. software or software code) including instructions for performing, when executed by the processing system, one of more of the methods described herein. The software may reside entirely in the memory, or may also reside, completely or at least partially, within the RAM and/or within the processor during execution thereof by the computer system. Thus, the memory and the processor also constitute a system comprising machine-readable code.

In alternative embodiments, the machine operates as a standalone device or may be connected, e.g., networked to other machines, in a networked deployment, the machine may operate in the capacity of a server or a client machine in server-client network environment, or as a peer machine in a peer-to-peer or distributed network environment. The machine may be, for example, a computer, a server, a cluster of servers, a cluster of computers, a web appliance, a distributed computing environment, a cloud computing environment, or any machine capable of executing a set of instructions (sequential or otherwise) that specify actions to be taken by that machine. The term "machine" may also be taken to include any collection of machines that individually or jointly execute a set (or multiple sets) of instructions to perform any one or more of the methodologies discussed herein.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A device comprising:

a microprocessor;

an alarm generator; and a plurality of sensors comprising at least an accelerometer and a gyroscope, each sensor generating data relating to a context of the device, the accelerometer providing data relating to acceleration of the device, the gyroscope providing data relating to movement of the device allowing the microprocessor to establish a position of the device;

wherein the microprocessor processes the data generated by the plurality of sensors to determine a current overall context of the device;

wherein the microprocessor generates a current alarm of a plurality of alarms with the alarm generator, where the current alarm of the plurality of alarms relates to the current overall context of the device;

wherein the current overall context of the device is established in dependence upon whether the device is one of stationary, moving below a predetermined height from a defined playing surface, moving above another predetermined height from the defined playing surface, has just been subjected to an impact, and is currently being subjected to an impact; and wherein each overall context of the device of the plurality of overall contexts is associated with a defined alarm of the plurality of alarms.

2. The device according to claim 1, further comprising:

an outer case having an external geometry comprising:

a cylindrical segment, where two planes defining upper and lower surfaces of the truncated cylinder are parallel to one another and perpendicular to a longitudinal axis of the cylindrical segment, a base disposed at an end of the cylindrical segment, and a cover disposed at another distal end of the cylindrical segment;

an electronics module disposed within the outer case and comprising:

a casing within which is disposed a battery, a control circuit comprising at least the microprocessor, and the alarm generator, comprising a pair of diametrically opposed acoustic signal generators coupled to the control circuit and configurable by the control circuit to generate the current alarm of the plurality of alarms; and a pair of sound guides, where each sound guide is disposed between an acoustic signal generator of the pair of diametrically opposed acoustic signal generators and an opening within the cylindrical segment;

wherein the pair of sound guides absorb deformations in the cylindrical segment of the outer case arising from impacts, thereby isolating the electronics module from these cylindrical segment deformations.

3. The device according to claim 2, wherein the casing of the electronics module comprises:

a first case portion housing the battery and preventing motion of the battery under an impact of the device to another object, a second case portion housing the control circuit and preventing motion of the control circuit under the impact, and a pair of acoustic resonators;

wherein each acoustic resonator of the pair of acoustic resonators is attached to the first case portion and the second case portion at predetermined locations; and wherein each acoustic signal generator of the pair of diametrically opposed acoustic signal generators is disposed within a chamber formed by an acoustic resonator of the pair of acoustic resonators, the first case portion, and the second case portion.

4. The device according to claim 1, wherein each alarm of the plurality of alarms generated by the alarm generator is provided by a means selected from the group comprising a visual means, an audible means, a tactile means, an olfactory means, and a gustatory means, or a combination thereof.

5. The device according to claim 1, further comprising an interface operating according to a defined standard which employs at least one of an optical means, a wireless means, and a wired means;

wherein the microprocessor triggers generation of another alarm by another device in communication with the device via the interface; and wherein the another alarm is directed to a remote user different from a user local to the device.

6. The device according to claim 1, further comprising a wireless interface operating according to a defined wireless standard;

wherein the current overall context of the device is further established in dependence upon other data acquired by the microprocessor via the wireless interface from at least one other sensor remote from the device.

7. The device according to claim 1, wherein the current overall context of the device is one of a plurality of overall contexts of the device;

wherein each overall context of the plurality of overall contexts comprises:

a first portion defining whether the device is one of stationary, moving below a predetermined distance from the playing surface, moving above another predetermined distance from the playing surface, has just been subjected to an impact, and is currently being subjected to an impact, and a second portion defining a section of a plurality of sections the device is currently within, where the plurality of sections are defined with respect to a defined boundary of the playing surface; and wherein each overall context of the plurality of overall contexts is associated with a defined alarm of the plurality of alarms.

8. The device according to claim 1, further comprising a wireless interface operating according to a predetermined wireless standard;

wherein the microprocessor receives configuration data via the wireless interface from a remote electronic device to establish a plurality of overall contexts of the device and the plurality of alarms;

wherein each overall context of the plurality of overall contexts comprises:

a first portion defining whether the device is one of stationary, moving below a predetermined distance from the playing surface, moving above another predetermined distance from the playing surface, has just been subjected to an impact, and is currently being subjected to an impact, and a second portion defining a section of a plurality of sections the device is currently within, where the plurality of sections are defined with respect to a defined boundary of the playing surface; and wherein each overall context of the plurality of overall contexts is associated with a defined alarm of the plurality of alarms.

9. The device according to claim 1, wherein the alarm generator comprises a pair of acoustic signal generators, where each acoustic signal generator is coupled to a control circuit comprising at least the microprocessor;

wherein each acoustic signal generator of the pair of acoustic signal generators generates one or more audible signals whilst the device is at least in motion; and wherein each acoustic signal generator of the pair of acoustic signal generators is either coupled to an acoustic resonator or disposed within a chamber formed by an acoustic resonator and one or more portions of a case of the device.

10. The device according to claim 1, wherein the alarm generator comprises a pair of diametrically opposed acoustic signal generators, where each acoustic signal generator is coupled to a control circuit comprising at least the microprocessor;

wherein each acoustic signal generator of the pair of diametrically opposed acoustic signal generators generates one or more audible signals whilst the device is at least in motion; and wherein each acoustic signal generator of the pair of diametrically opposed acoustic signal generators is aligned with an axis of the device and emits the audible signals in a direction with respect to the axis of the device such that the pair of diametrically opposed acoustic signal generators emit audible signals in opposite directions with respect to the axis of the device.

11. The device according to claim 10, wherein each acoustic signal generator of the pair of diametrically opposed acoustic signal generators is one of:

coupled to an acoustic resonator;

disposed within a chamber formed by an acoustic resonator and at least one portion of a case of the device; and an acoustic horn.

12. The device according to claim 1, wherein the alarm generator comprises a pair of acoustic signal generators, where each acoustic signal generator is coupled to a control circuit comprising at least the microprocessor;

wherein each acoustic signal generator of the pair of acoustic signal generators generates one or more audible signals whilst the device is at least in motion; and wherein each acoustic signal generator of the pair of acoustic signal generators is coupled to an acoustic horn that couples acoustic signals generated by the acoustic signal generator to an environment surrounding the device.

13. The device according to claim 1, wherein the plurality of sensors further comprise at least a magnetometer;

wherein the current overall context of the device is one of a plurality of overall contexts of the device, where each overall context of the device of the plurality of overall contexts comprises:

a first portion defining a velocity of the device and a height of the device relative to a defined surface, and a second portion defining a section of a plurality of sections the device is currently within, where the plurality of sections are defined with respect to a defined boundary of the defined surface; and wherein each overall context of the device of the plurality of overall contexts is associated with a defined alarm of the plurality of alarms such that the generated alarm varies according to the section of the plurality of sections the device is currently within, the velocity of the device, and the device's height relative to the defined surface.

14. The device according to claim 1, wherein the plurality of sensors further comprise at least a magnetometer;

wherein the current overall context of the device is one of a plurality of overall contexts of the device, where each overall context of the device of the plurality of overall contexts comprises:

a first portion defining a velocity of the device, a direction of motion of the device relative to the defined surface, and a height of the device relative to a defined surface, and a second portion defining a section of a plurality of sections the device is currently within, where the plurality of sections are defined with respect to a defined boundary of the defined surface; and wherein each overall context of the device of the plurality of overall contexts is associated with a defined alarm of the plurality of alarms such that the generated alarm varies according to the section of the plurality of sections the device is currently within, the velocity of the device, the direction of motion of the device relative to the defined surface, and the device's height relative to the defined surface.

15. The device according to claim 1, further comprising:

an outer case having an external geometry comprising:

a cylindrical segment, where two planes define upper and lower surfaces of a truncated cylinder which are parallel to one another and perpendicular to a longitudinal axis of the cylindrical segment, a base disposed at an end of the cylindrical segment, and a cover disposed at another distal end of the cylindrical segment;

an electronics module disposed within the outer case and comprising:

a casing within which is disposed a battery, a control circuit comprising at least the microprocessor, the alarm generator, comprising a pair of diametrically opposed acoustic signal generators coupled to the control circuit and configurable by the control circuit to generate the current alarm of the plurality of alarms, and a pair of diametrically opposed optical signal generators coupled to the control circuit and configurable by the control circuit to generate one or more optical indicators;

a pair of sound guides, where each sound guide is disposed between an acoustic signal generator of the pair of diametrically opposed acoustic signal generators and an opening within the cylindrical segment; and a pair of light pipes, where each light pipe is disposed between an optical signal generator of the pair of diametrically opposed optical signal generators and an other opening within the cylindrical segment;

wherein the pair of sound guides absorb deformations in the cylindrical segment of the outer case arising from impacts, thereby isolating the electronics module from the deformations; and wherein the pair of light pipes absorb at least one of bending, flexing, and compression under deformation of the outer case, thereby isolating the electronics module from the at least one of bending, flexing, and compression.

16. The device according to claim 1, further comprising:

an outer case having a defined external geometry;

an electronics module disposed within the outer case and comprising:

a casing within which is disposed a battery, a control circuit comprising at least the microprocessor, the alarm generator, comprising a pair of diametrically opposed acoustic signal generators coupled to the control circuit and configurable by the control circuit to generate the current alarm of the plurality of alarms, and a pair of diametrically opposed optical signal generators coupled to the control circuit and configurable by the control circuit to generate one or more optical indicators;

a pair of sound guides, where each sound guide is disposed between an acoustic signal generator of the pair of diametrically opposed acoustic signal generators and an opening within the outer case; and a pair of light pipes, where each light pipe is disposed between an optical signal generator of the pair of diametrically opposed optical signal generators and an other opening within the outer case;

wherein the pair of sound guides absorb deformations in the outer case arising from impacts, thereby isolating the electronics module from the deformations; and wherein the pair of light pipes absorb at least one of bending, flexing, and compression under deformation of the outer case, thereby isolating the electronics module from the at least one of bending, flexing, and compression.

17. The device according to claim 1, further comprising:

an outer case having a defined external geometry; and an electronics module disposed within the outer case and comprising:

a first case portion housing the battery and preventing motion of the battery under an impact between the device and another object, a second case portion housing the control circuit and preventing motion of the control circuit under the impact, and the alarm generator;

wherein the first case portion comprises:

a body having a central portion having an outer wall and an internal wall, the internal wall disposed around a region of the central portion within which the battery can be inserted, a plurality of ribs, each rib of the plurality of ribs being disposed between a first defined position on an inner surface of the outer wall and a second defined position on an outer surface of the internal wall, and a first portion of a fitting, configured for attachment of the alarm generator to the body of the first case portion;

wherein the second case portion comprises:

an other body having another central portion having an other outer wall and an other internal wall having a plurality of fittings disposed around the inner wall, an other plurality of ribs, each rib of the other plurality of ribs disposed between a defined position on an inner surface of the other outer wall and a defined position on an outer surface of the other internal wall, and a second portion of the fitting, configured for the attachment of the alarm generator to the body of the second case portion; and wherein the control circuit is attached to the plurality of fittings disposed around the inner wall.

18. The device according to claim 17, wherein an outer surface of the central portion of the body of the first case portion comprises a ring raised from the outer surface of the central portion of the body of the first case portion and a plurality of further ribs where each further rib of the plurality of further ribs extends radially from a defined position on the ring to an outer periphery of the central portion of the body; and wherein an outer surface of the central portion of the body of the second case portion comprises a domed region extending over a portion of the central portion of the body of the second case portion.

19. The device according to claim 17, wherein the alarm generator comprises a pair of diametrically opposed acoustic signal generators;

wherein the first portion of the fitting for attachment of the alarm generator to the body of the first case portion comprises a pair of diametrically opposed fittings, where each opposed fitting of the pair of diametrically opposed fittings supports attachment of an acoustic signal generator of the pair of diametrically opposed acoustic signal generators; and wherein the second portion of the fitting for attachment of the alarm generator to the other body of the second case portion comprises a pair of diametrically opposed other fittings, where each opposed other fitting of the pair of diametrically opposed other fittings supports attachment of an acoustic signal generator of the pair of diametrically opposed acoustic signal generators.

20. A device comprising:

an outer case having an external geometry comprising:

a cylindrical segment, where two planes defining upper and lower surfaces of a truncated cylinder are parallel to one another and perpendicular to a longitudinal axis of the cylindrical segment, a base having a plurality of holes within a predetermined pattern, a cover having another plurality of holes within another predetermined pattern, and a cylindrical wall;

an electronics module disposed within the outer case, the electronics module comprising a casing within which are disposed a battery and a microprocessor-based control circuit, the casing comprising a first case portion housing the battery and preventing motion of the battery under an impact between the device and another object, and a second case portion housing the control circuit and preventing motion of the control circuit under the impact, each of the first case portion and the second case portion comprising a circular bottom portion and a cylindrical wall portion, the cylindrical wall portions abutting, each circular bottom portion being substantially parallel to the base and cover of the outer case when the device is assembled, each cylindrical wall portion comprising an inner wall, an outer wall, and a plurality of radially disposed ribs each joined at one end to the inner wall and at a distal second end to the outer wall; and a pair of acoustic resonators, each acoustic resonator of the pair of acoustic resonators being attached to the first case portion and the second case portion at predetermined locations;

a pair of acoustic signal generators coupled to the control circuit, the acoustic signal generators generating at least one audible signal whilst the device is at least in motion, each acoustic signal generator of the pair of acoustic signal generators being disposed within a chamber formed by an acoustic resonator of the pair of acoustic resonators, the first case portion, and the second case portion;

wherein the outer case provides mechanical protection for the electronics module under impact.

* * * * *